US012291372B2

(12) United States Patent
Meador et al.

(10) Patent No.: US 12,291,372 B2
(45) Date of Patent: May 6, 2025

(54) METAL CONTAINER WITH A CARRIER RING AND METHODS OF MAKING THE SAME

(71) Applicant: BELVAC PRODUCTION MACHINERY, INC., Lynchburg, VA (US)

(72) Inventors: Gerald Meador, Lynchburg, VA (US); Dennis E. Green, Lynchburg, VA (US); Erika S. Love, Lynchburg, VA (US); Paul Whittaker, Lynchburg, VA (US)

(73) Assignee: BELVAC PRODUCTION MACHINERY, INC., Lynchburg, VA (US)

( * ) Notice: Subject to any disclaimer, the term of this patent is extended or adjusted under 35 U.S.C. 154(b) by 0 days.

(21) Appl. No.: 18/608,778

(22) Filed: Mar. 18, 2024

(65) Prior Publication Data

US 2024/0308717 A1 Sep. 19, 2024

Related U.S. Application Data

(60) Provisional application No. 63/613,396, filed on Dec. 21, 2023, provisional application No. 63/452,988, filed on Mar. 17, 2023.

(51) Int. Cl.

| | |
|---|---|
| ***B21D 51/40*** | (2006.01) |
| ***B21D 51/24*** | (2006.01) |
| ***B65D 1/02*** | (2006.01) |

(52) U.S. Cl.

CPC ..... *B65D 1/0246* (2013.01); *B21D 51/24* (2013.01)

(58) Field of Classification Search

CPC ..... B65D 1/0246; B65D 1/023; B65D 41/34; B65D 1/02; B21D 51/24

(Continued)

(56) References Cited

U.S. PATENT DOCUMENTS

| | | | |
|---|---|---|---|
| 3,688,538 | A | 9/1972 | Hoyne |
| 3,782,315 | A | 1/1974 | Passenheim |

(Continued)

FOREIGN PATENT DOCUMENTS

| | | | |
|---|---|---|---|
| CA | 1084781 | A | 9/1980 |
| CH | 686721 | A5 | 6/1996 |

(Continued)

OTHER PUBLICATIONS

Sykes, J., Husky Injection Molding Systems Ltd., PCO-1819 Voluntary Standard 28mm CSD Finish, May 29, 1998 (1 page).

(Continued)

*Primary Examiner* — Don M Anderson

*Assistant Examiner* — Elizabeth J Volz

(74) *Attorney, Agent, or Firm* — NIXON PEABODY LLP

(57) ABSTRACT

A method of forming a carrier ring on a metal article having an open end and a sidewall extending therefrom. The method includes contacting an inner surface of the sidewall with an inner roller to form a protrusion and contacting an outer surface of the sidewall with an outer roller to form a first groove positioned below the protrusion. The protrusion forms a gap therein. The method further includes contacting a portion of the outer sidewall with at least one second outer roller to form a second groove below the protrusion. The method further includes contacting a portion of the outer sidewall with at least one third outer roller to flatten the protrusion, such that the gap is substantially reduced or eliminated. The flattened protrusion forms the carrier ring.

21 Claims, 47 Drawing Sheets

(58) Field of Classification Search
USPC ..... 215/40, 43, 44
See application file for complete search history.

(56) References Cited

U.S. PATENT DOCUMENTS

| | | | |
|---|---|---|---|
| 4,070,888 | A | 1/1978 | Gombas |
| 4,402,202 | A | 9/1983 | Gombas |
| 4,418,828 | A | 12/1983 | Wilde |
| 4,512,172 | A | 4/1985 | Abbott et al. |
| 4,606,207 | A | 8/1986 | Slade |
| 4,723,430 | A | 2/1988 | Hahn |
| 4,823,537 | A | 4/1989 | Duke |
| 5,076,087 | A | 12/1991 | Slater |
| 5,291,769 | A | 3/1994 | Miyano |
| 5,660,902 | A | 8/1997 | Unterlander et al. |
| 5,704,240 | A | 1/1998 | Jordan |
| 5,718,352 | A | 2/1998 | Diekhoff |
| 5,727,411 | A | 3/1998 | Sakakibara |
| 5,822,843 | A | 10/1998 | Diekhoff |
| 5,823,040 | A | 10/1998 | Stodd |
| 6,010,028 | A | 1/2000 | Jordan |
| 6,079,249 | A | 6/2000 | Turner et al. |
| 6,082,418 | A | 7/2000 | Naecker et al. |
| 6,089,072 | A | 7/2000 | Fields |
| 6,499,329 | B1 | 12/2002 | Enoki |
| 6,666,062 | B2 | 12/2003 | Dole |
| 6,776,018 | B2 | 8/2004 | Hamm |
| 6,935,152 | B2 | 8/2005 | Dole |
| 7,191,032 | B2 | 3/2007 | MacEwen et al. |
| 7,555,927 | B2 | 7/2009 | Hanafusa et al. |
| 7,588,808 | B2 | 9/2009 | Hutchinson et al. |
| 7,905,130 | B2 | 3/2011 | Marshall |
| 8,037,728 | B2 | 10/2011 | Hosoi |
| 8,037,734 | B2 | 10/2011 | Hanafusa |
| 8,091,402 | B2 | 1/2012 | Hanafusa et al. |
| 8,360,266 | B2 | 1/2013 | Adams et al. |
| 8,435,027 | B2 | 5/2013 | Nemoto et al. |
| 8,499,601 | B2 | 8/2013 | Hanafusa |
| 8,683,837 | B2 | 4/2014 | Mallory et al. |
| 8,726,710 | B2 | 5/2014 | Biondich et al. |
| 8,740,001 | B2 | 6/2014 | Hanafusa |
| 8,800,248 | B2 | 8/2014 | Imatani et al. |
| 8,956,707 | B2 | 2/2015 | Hanan |
| 9,149,856 | B2 | 10/2015 | Hosoi |
| 9,339,864 | B2 | 5/2016 | Hosoi |
| 9,517,498 | B2 | 12/2016 | Siles et al. |
| 9,707,615 | B2 | 7/2017 | Dick et al. |
| 9,714,117 | B2 | 7/2017 | Paauwe et al. |
| 9,821,926 | B2 | 11/2017 | Robinson et al. |
| 9,844,805 | B2 | 12/2017 | Siles et al. |
| 10,040,593 | B2 | 8/2018 | Ross et al. |
| 10,105,745 | B2 | 10/2018 | Adams |
| 10,220,983 | B1 | 3/2019 | Gilliam |
| 10,315,242 | B2 | 6/2019 | Kaanta et al. |
| 10,384,838 | B2 | 8/2019 | Olson et al. |
| 10,407,203 | B2 | 9/2019 | Adams et al. |
| 10,464,707 | B2 | 11/2019 | Dick |
| 10,518,940 | B2 | 12/2019 | Vanon et al. |
| 10,525,517 | B2 | 1/2020 | Dole |
| 10,562,088 | B2 | 2/2020 | LaRochelle |
| 10,577,143 | B2 | 3/2020 | Robinson et al. |
| 10,875,684 | B2 | 12/2020 | Ross et al. |
| 10,961,009 | B2 | 3/2021 | Tanaka et al. |
| 11,001,405 | B2 | 5/2021 | Enoki et al. |
| 11,130,606 | B2 | 9/2021 | Ross |
| 11,179,765 | B2 | 11/2021 | Enoki et al. |
| 11,185,909 | B2 | 11/2021 | Ross et al. |
| 2009/0211329 | A1 | 8/2009 | Hanafusa |
| 2012/0255962 | A1 | 10/2012 | Yoo |
| 2012/0312066 | A1 | 12/2012 | Myers |
| 2014/0008320 | A1 | 1/2014 | Hosoi |
| 2014/0166607 | A1 | 6/2014 | Washizaki |
| 2015/0027974 | A1 | 1/2015 | Niec |
| 2015/0344166 | A1* | 12/2015 | Davis ..... B65D 1/0207 413/1 |
| 2016/0256910 | A1 | 9/2016 | Niec et al. |
| 2016/0288945 | A1 | 10/2016 | Huels et al. |
| 2016/0368650 | A1 | 12/2016 | Davis |
| 2017/0008656 | A1 | 1/2017 | Go |
| 2017/0320637 | A1 | 11/2017 | Jones et al. |
| 2018/0229900 | A1 | 8/2018 | Ross |
| 2019/0001390 | A1* | 1/2019 | Dick ..... B21C 51/005 |
| 2019/0184441 | A1 | 6/2019 | Dole |
| 2019/0248532 | A1 | 8/2019 | Enoki |
| 2019/0291913 | A1 | 9/2019 | Enoki |
| 2019/0329925 | A1 | 10/2019 | Aihara et al. |
| 2021/0016915 | A1 | 1/2021 | Kuroiwa et al. |
| 2021/0069770 | A1 | 3/2021 | Deuser et al. |
| 2021/0114077 | A1 | 4/2021 | Niec et al. |
| 2021/0187587 | A1 | 6/2021 | Endo et al. |
| 2022/0055785 | A1 | 2/2022 | Hasegawa et al. |

FOREIGN PATENT DOCUMENTS

| | | | |
|---|---|---|---|
| CN | 104029881 | A | 9/2014 |
| CN | 104554960 | A | 4/2015 |
| CN | 104029881 | B | 5/2017 |
| CN | 109051204 | A | 12/2018 |
| CN | 109153474 | A | 1/2019 |
| CN | 109746342 | A | 5/2019 |
| CN | 113182455 | A | 7/2021 |
| EP | 0510291 | A1 | 10/1992 |
| EP | 0865390 | A1 | 9/1998 |
| EP | 2010342 | A1 | 1/2009 |
| EP | 2835188 | A | 2/2015 |
| EP | 2859966 | A1 | 4/2015 |
| EP | 3075675 | A1 | 10/2016 |
| GB | 2031775 | A | 4/1980 |
| GB | 2391545 | A | 2/2004 |
| JP | 60-120920 | U | 8/1985 |
| JP | 61-051314 | U | 4/1986 |
| JP | H10-509095 | A | 9/1998 |
| JP | 2001162344 | A | 6/2001 |
| JP | 2001213416 | A | 8/2001 |
| JP | 2003205924 | A | 7/2003 |
| JP | 2006143433 | A | 6/2006 |
| JP | 4098570 | B2 | 6/2008 |
| WO | 2011059854 | A1 | 5/2011 |
| WO | 2011113732 | A1 | 9/2011 |
| WO | 2012133391 | A1 | 10/2012 |
| WO | 2012144490 | A1 | 10/2012 |
| WO | 2013123495 | A1 | 8/2013 |
| WO | 2015054284 | A1 | 4/2015 |
| WO | 2017008656 | A1 | 1/2017 |
| WO | 2017044362 | A1 | 3/2017 |
| WO | 2018159278 | A1 | 9/2018 |
| WO | 2020223501 | A1 | 11/2020 |
| WO | 2022112564 | A1 | 6/2022 |

OTHER PUBLICATIONS

ISBT International Society of Beverage Technologists, Voluntary Standard 28mm PCO 1881 CSD Finish, Feb. 14, 2007 (1 page).

* cited by examiner

METAL CONTAINER WITH A CARRIER RING AND METHODS OF MAKING THE SAME

CROSS-REFERENCE TO RELATED APPLICATIONS

This application claims the benefit of and priority to U.S. Provisional Patent Application No. 63/452,988, filed Mar. 17, 2023, and U.S. Provisional Patent Application No. 63/613,396, filed Dec. 21, 2023, each of which are hereby incorporated by reference herein in its entirety.

FIELD

The present disclosure relates generally to the field of forming or processing an article, such as a container. More specifically, the invention relates to a method and apparatus for forming a metal container with a carrier ring, along with the resulting metal container.

BACKGROUND

Plastic containers, such as polyethylene terephthalate (PET) bottles, have a feature known as a carrier ring. The carrier ring serves multiple purposes. According to one purpose, the carrier ring is the primary contact when using an air conveyor to transport the plastic containers through processing lines, such as a manufacturing line or a filling line. The carrier ring slides along an air conveyor channel. Air forces the plastic containers to glide along the air conveyor channel while the container is suspended by the carrier ring. As an example, the air conveyor channel can transport the plastic bottles from a blow molder or a depalletizer to an infeed of a rinser/filler/capper on a filling line.

Brand owners are looking for an alternative to plastic containers. Metal containers are a viable alternative. However, metal containers do not have carrier rings because of the differences in how metal containers are formed as compared to plastic containers, which make it difficult to include a carrier ring on metal containers.

Accordingly, it would be desirable to have a metal container that includes a carrier ring that makes containers compatible with existing manufacturing lines with air conveyor channels for transporting the containers and assists in the filling and capping processes. It would also be desirable to have a process for manufacturing metal containers with a carrier ring.

SUMMARY

A first implementation of the present disclosure includes a turret-head assembly for forming an article. The turret-head assembly includes a top plate and a housing extending from a first side the top plate in a first direction. The housing includes a plurality of cams rigidly attached thereto. The turret-head assembly further includes a base plate having a generally central aperture configured to receive an open end of the article therethrough. The base plate is coupled to the top plate via a plurality of alignment pins. The turret-head assembly further includes a rolling assembly slidably coupled to the base plate. The rolling assembly includes a plurality of roller arms. Each of the plurality of roller arms has a roller coupled thereto. Each of the plurality of roller arms further includes a cam follower configured to engage a respective one of the plurality of cams such that the rollers are configured to move radially with respect to a turret-head assembly axis extending generally through the center of the turret-head assembly between the top plate and the base plate. The radial movement corresponds with axial movement of the forming tool.

An aspect of the first implementation, alone or in combination with any other aspect of the first implementation, includes the article including a narrowed neck extending from the open end, a body portion, and a shoulder portion bridging the neck and the body portion. The generally central aperture of the rolling assembly includes a guide configured to allow the neck of the article therethrough and block the shoulder portion of the article.

An aspect of the first implementation, alone or in combination with any other aspect of the first implementation, includes the guide being slidably coupled along the axis of the forming tool, and the guide being axially coupled to a resilient device configured to urge the guide in the first direction.

An aspect of the first implementation, alone or in combination with any other aspect of the first implementation, includes the turret-head assembly further having a plurality of resilient devices coupled to the plurality of alignment pins.

An aspect of the first implementation, alone or in combination with any other aspect of the first implementation, includes the turret-head assembly further having a pilot positioned through the aperture in the base plate and configured to be received through the open end of the article. The pilot includes a step configured to contact the open end of the article.

An aspect of the first implementation, alone or in combination with any other aspect of the first implementation, includes the pilot being slidably coupled for axial movement relative to the rolling assembly and being axially coupled to the rolling assembly via a resilient device.

An aspect of the first implementation, alone or in combination with any other aspect of the first implementation, includes the plurality of roller arms including at least one outer roller arm having an outer roller coupled thereto and an inner roller arm having an inner roller coupled thereto.

An aspect of the first implementation, alone or in combination with any other aspect of the first implementation, includes the inner roller extending through the aperture in the base plate.

An aspect of the first implementation, alone or in combination with any other aspect of the first implementation, includes the at least one outer roller arm being coupled to the inner roller arm via a resilient device.

An aspect of the first implementation, alone or in combination with any other aspect of the first implementation, includes the radial movements of the at least one outer roller and the inner roller being in generally opposite directions.

An aspect of the first implementation, alone or in combination with any other aspect of the first implementation, includes the plurality of roller arms including a plurality of outer roller arms having respective outer rollers coupled thereto.

An aspect of the first implementation, alone or in combination with any other aspect of the first implementation, includes each of the plurality of outer rollers including more than one rolling surface for contacting the article, and the more than one rolling surface is separated by a recess.

An aspect of the first implementation, alone or in combination with any other aspect of the first implementation, includes the radial movement of the rollers being generally perpendicular to the turret-head assembly axis.

An aspect of the first implementation, alone or in combination with any other aspect of the first implementation, includes the turret-head assembly further having at least one cam follower positioned adjacent to a second side of the top plate.

A second implementation of the present disclosure includes a method of forming a carrier ring on a metal article. The method includes providing at least one turret-head assembly including having a top plate. The at least one turret-head assembly further includes a housing extending from a first side of the top plate in a first direction. The housing includes a plurality of cams rigidly attached thereto. The at least one turret-head assembly further includes a base plate having a generally central aperture configured to receive an open end of the article therethrough. The base plate is coupled to the top plate via a plurality of alignment pins. The at least one turret-head assembly further includes a rolling assembly including a plurality of roller arms. Each of the plurality of roller arms has a roller coupled thereto. Each of the plurality of roller arms further includes a cam follower configured to engage a respective one of the plurality of cams such that the rollers are configured to move radially with respect to the turret-head assembly axis extending generally through the center of the turret-head assembly between the top plate and the base plate. The radial movement corresponds with axial movement of the forming tool. The method further includes axially advancing at least one of the rolling assembly and an open end of an article toward one another such that the open top end of the article passes through the aperture in the base plate forming tool, such axial advancement causing the plurality of cam followers to engage the plurality of cams, thereby radially moving the rollers toward the turret-head assembly axis. The method further includes rotating at least one of the at least one turret-head assembly or the article about the turret-head assembly axis. The method further includes engaging the rollers with a portion of the article, thereby at least partially forming a carrier ring on the article.

An aspect of the second implementation, alone or in combination with any other aspect of the second implementation, includes the article including a narrowed neck extending from the open end, a body portion, and a shoulder portion bridging the neck and the body portion.

An aspect of the second implementation, alone or in combination with any other aspect of the second implementation, includes the axial advancing occurring via the shoulder portion to abut and apply a force against the aperture of the base plate.

An aspect of the second implementation, alone or in combination with any other aspect of the second implementation, includes the axial advancing occurring via an external mechanism.

An aspect of the second implementation, alone or in combination with any other aspect of the second implementation, includes the external mechanism being a cam mechanism, a linkage mechanism, a servo-mechanism, a hydraulic or pneumatic cylinder, a linear motor, or any combination thereof.

An aspect of the second implementation, alone or in combination with any other aspect of the second implementation, includes the turret-head assembly being coupled to a forming turret. The turret-head assembly has a cam follower configured to engage with a cam on the forming turret. The engagement causes the rolling assembly to axially move toward the open end of an article.

An aspect of the second implementation, alone or in combination with any other aspect of the second implementation, includes the cam including a profile such that once the rolling assembly advances to a maximum displacement position, the rolling assembly disengages from the article and retreats to its initial position.

An aspect of the second implementation, alone or in combination with any other aspect of the second implementation, includes the cam including a profile. The profile includes a working portion during which the rolling assembly contacts the article. The working portion is sloped along its entirety.

An aspect of the second implementation, alone or in combination with any other aspect of the second implementation, includes a plurality of resilient devices being coupled to the top plate and the forming tool.

An aspect of the second implementation, alone or in combination with any other aspect of the second implementation, includes the axially advancing compressing the plurality of resilient devices.

An aspect of the second implementation, alone or in combination with any other aspect of the second implementation, includes the at least one turret-head assembly further including a pilot positioned through the aperture in the base plate. The pilot includes a step configured to contact the open end of the article.

An aspect of the second implementation, alone or in combination with any other aspect of the second implementation, includes the step assisting in applying an axial load to the open end of the article.

An aspect of the second implementation, alone or in combination with any other aspect of the second implementation, includes the maximum axial load being about 890 Newtons.

An aspect of the second implementation, alone or in combination with any other aspect of the second implementation, includes the axial advancing occurring via the open end of the article engaging the pilot.

An aspect of the second implementation, alone or in combination with any other aspect of the second implementation, includes the plurality of roller arms including at least one outer roller arm having an outer roller coupled thereto and an inner roller arm having an inner roller coupled thereto.

An aspect of the second implementation, alone or in combination with any other aspect of the second implementation, includes the inner roller extending through the aperture in the base plate through the open end of the article.

An aspect of the second implementation, alone or in combination with any other aspect of the second implementation, includes the at least one outer roller arm being coupled to the inner roller arm via a resilient device.

An aspect of the second implementation, alone or in combination with any other aspect of the second implementation, includes the radial movements of the at least one outer roller and the inner roller being in generally opposite directions.

An aspect of the second implementation, alone or in combination with any other aspect of the second implementation, includes the plurality of roller arms including a plurality of outer roller arms having a plurality of outer rollers coupled thereto.

An aspect of the second implementation, alone or in combination with any other aspect of the second implementation, includes each of the plurality of outer rollers including more than one rolling surfaces for contacting the article, and the more than one rolling surfaces are separated by a recess.

An aspect of the second implementation, alone or in combination with any other aspect of the second implementation, includes the at least one turret-head assembly being at least three turret-head assemblies. Further, the plurality of roller arms of a first turret-head assembly includes at least one outer roller arm having an outer roller coupled thereto and an inner roller arm having an inner roller coupled thereto. The plurality of roller arms of a second turret-head assembly includes a plurality of outer roller arms having a plurality of outer rollers coupled thereto. The plurality of roller arms of a third turret-head assembly includes a second plurality of outer roller arms having a second plurality of outer rollers coupled thereto. The second plurality of outer rollers includes more than one rolling surface for contacting the article. The more than one rolling surfaces are separated by a recess. The article is engaged by the first, second, and third turret-head assemblies in sequence.

An aspect of the second implementation, alone or in combination with any other aspect of the second implementation, includes the radial movement of the rollers being generally perpendicular to the turret-head assembly axis.

An aspect of the second implementation, alone or in combination with any other aspect of the second implementation, includes the method further including moving at least one of the turret-head assembly and the article away from one another such that the article having the carrier ring formed thereon is configured to be removed from the opening in the base plate.

An aspect of the second implementation, alone or in combination with any other aspect of the second implementation, includes the at least one turret-head assembly being incorporated into a machine line.

An aspect of the second implementation, alone or in combination with any other aspect of the second implementation, includes the at least one turret-head assembly being at least four turret-head assemblies. The plurality of roller arms of a fourth turret-head assembly includes a third plurality of outer roller arms having a third plurality of outer rollers coupled thereto. The third plurality of outer rollers includes more than one rolling surface for contacting the article being separated by a recess. The recess of the third plurality of outer rollers is smaller than the recess of the second plurality of outer rollers.

A third implementation of the present disclosure includes a metal container. The metal container includes a base, an open top end, and a sidewall bridging the base and the open top end. The metal container further includes a shoulder curving inward and extending up from the sidewall. The metal container further includes a neck extending up from the shoulder. The neck includes a carrier ring having a top surface and a bottom surface around the neck. The neck further includes a first groove formed on the neck adjacent to the top surface of the carrier ring. The neck further includes a second groove formed on the neck adjacent to the bottom surface of the carrier ring. A level of annealing on a portion of the neck having the carrier ring is no greater than a level of annealing on other portions of the container.

An aspect of the third implementation, alone or in combination with any other aspect of the third implementation, includes the radius of the carrier ring measured from a center line through the neck being from about 12 mm to about 21 mm.

An aspect of the third implementation, alone or in combination with any other aspect of the third implementation, includes the radius of the carrier ring being about 7% to about 25% greater than the radius of the open top end.

An aspect of the third implementation, alone or in combination with any other aspect of the third implementation, includes the top surface of the carrier ring being positioned about 10 mm to about 35 mm from the open top end.

A fourth implementation of the present disclosure includes a method of forming a metal article. The method includes providing at least one turret-head assembly. The at least one turret-head assembly includes a top plate and a housing having a first end extending from a first side of the top plate in a first direction. The housing includes a plurality of cams rigidly attached thereto. The at least one turret-head assembly further includes a base plate positioned adjacent to a second end of the housing. The base plate has a generally central aperture configured to receive an open end of the article therethrough. The at least one turret-head assembly further includes a rolling assembly including an outer roller arm and an inner rolling arm. The outer roller arm has an outer roller coupled thereto. The inner roller arm has an inner roller coupled thereto. Each of the outer and inner roller arms includes a cam follower configured to engage a respective one of the plurality of cams such that the rollers are configured to move radially with respect to a turret-head assembly axis extending generally through the center of the turret-head assembly between the top plate and the base plate. The radial movement corresponds with axial movement of the forming tool. The method further includes axially advancing at least one of the rolling assembly and an open end of an article toward one another such that the open top end of the article passes through the aperture in the base plate and such that the inner roller is generally positioned within the open end of the article. The axial advancement causes the cam follower of the inner roller arm to engage one of the plurality of cams, thereby radially moving the inner roller outward to contact an inner sidewall of the article. The method further includes axially advancing at least one of the rolling assembly and an open end of an article toward one another. The further axial advancement causes the cam follower of the outer roller arm to engage one of the plurality of cams, thereby radially moving the outer roller inward to contact an outer sidewall of the article. The engagement of the inner rollers with the inner sidewall of the article forms a protrusion and said engagement of the outer roller with the outer sidewall of the article forming a groove.

A fifth implementation of the present disclosure includes a method of forming a carrier ring on a metal article having an open end and a sidewall extending therefrom. The method includes contacting an inner surface of the sidewall with an inner roller to form a protrusion and contacting an outer surface of the sidewall with an outer roller to form a first groove positioned below the protrusion. The protrusion forms a gap therein. The method further includes contacting a portion of the outer sidewall with at least one second outer roller to form a second groove below the protrusion. The method further includes contacting a portion of the outer sidewall with at least one third outer roller to flatten the protrusion, such that the gap is substantially reduced or eliminated, the flattened protrusion forming the carrier ring.

An aspect of the fifth implementation, alone or in combination with any other aspect of the fifth implementation, includes the method further including providing a pilot having a generally inwardly sloped portion. The pilot is positioned within the open end during the contacting the portion of the outer surface of the sidewall with the at least one second outer roller.

An aspect of the fifth implementation, alone or in combination with any other aspect of the fifth implementation, includes each second outer roller of the at least one second outer roller having a single contact area.

An aspect of the fifth implementation, alone or in combination with any other aspect of the fifth implementation, includes each of the inner roller and the outer roller having a single contact area.

An aspect of the fifth implementation, alone or in combination with any other aspect of the fifth implementation, includes the method further including applying an axial load to the open end of the article during at least one of the contacting steps.

An aspect of the fifth implementation, alone or in combination with any other aspect of the fifth implementation, includes the method further including contacting a portion of the outer surface of the sidewall with at least one fourth outer roller to flatten the protrusion prior to the contacting the portion of the outer surface of the sidewall with at least one third outer roller. Each fourth outer roller of the at least one fourth outer roller has two contact areas separated by a recessed portion.

An aspect of the fifth implementation, alone or in combination with any other aspect of the fifth implementation, includes the method further including providing a pilot within the open end during the contacting the portion of the outer surface of the sidewall with the at least one fourth outer roller. The pilot does not axially extend as far as the protrusion within the sidewall.

An aspect of the fifth implementation, alone or in combination with any other aspect of the fifth implementation, includes a first contact area of the two contact areas having an upper forming radius of about 1.52 to about 3.05 mm and a lower forming radius of about 0.76 to about 2.29 mm, and a second contact area of the two contact areas having an upper forming radius of about 1.27 to about 3.05 mm and a lower forming radius of about 2.03 to about 6.35 mm.

An aspect of the fifth implementation, alone or in combination with any other aspect of the fifth implementation, includes a height of the recessed portion being about 0.127 to about 3.05 mm.

An aspect of the fifth implementation, alone or in combination with any other aspect of the fifth implementation, includes each third outer roller of the at least one third outer roller having a first contact area and a second contact area separated by a recessed portion.

An aspect of the fifth implementation, alone or in combination with any other aspect of the fifth implementation, includes the first contact area having an upper forming radius of about 1.01 to about 1.52 mm and a lower forming radius of about 1.01 mm, and the second contact area having an upper forming radius of about 1.01 mm and a lower forming radius of about 4.06 mm.

An aspect of the fifth implementation, alone or in combination with any other aspect of the fifth implementation, includes a height of the recessed portion being about 0.89 to about 1.78 mm.

A sixth implementation of the present disclosure includes a metal container including a base, an open top end, and a unitary sidewall bridging the base and the open top end. The sidewall includes a first portion having a first diameter. The sidewall further includes a neck having a second diameter, which is smaller than the first diameter, a first end of the neck terminating at the open top end. The sidewall further includes a curved shoulder bridging the first portion and a second end of the neck. The neck includes a carrier ring forming a protrusion in the sidewall. The carrier ring includes a top and a bottom sidewall portion. Interior surfaces of the top and bottom sidewall portions are in contact with one another. The carrier ring has a second diameter, which is about 7% to about 45% greater than a diameter of the open top end. The neck further includes a first groove adjacent to the top sidewall portion of the carrier ring and a second groove adjacent to the bottom sidewall portion of the carrier ring. The neck has a wall thickness of between about 0.025 and 0.356 mm.

An aspect of the sixth implementation, alone or in combination with any other aspect of the sixth implementation, includes the first groove having a radius of about 0.76 to about 3.05 mm.

An aspect of the sixth implementation, alone or in combination with any other aspect of the sixth implementation, includes the second groove having a radius of about 1.27 to about 6.35 mm.

An aspect of the sixth implementation, alone or in combination with any other aspect of the sixth implementation, includes the first groove having a third diameter. The third diameter is smaller than the diameter of the open top end.

An aspect of the sixth implementation, alone or in combination with any other aspect of the sixth implementation, includes the second groove having a fourth diameter. The fourth diameter is smaller than the diameter of the open top end.

An aspect of the sixth implementation, alone or in combination with any other aspect of the sixth implementation, includes the top and bottom sidewall portions forming a thickness of the carrier ring, which is about 0.33 mm to about 0.46 mm.

An aspect of the sixth implementation, alone or in combination with any other aspect of the sixth implementation, includes a thickness of an outer portion of the carrier ring being greater than a thickness of an inner portion of the carrier ring.

An aspect of the sixth implementation, alone or in combination with any other aspect of the sixth implementation, includes the open top end including a curl formed thereon.

A seventh implementation of the present disclosure includes a method of forming a metal article with a neck having a carrier ring. The method includes positioning an inner roller against an inner surface of a neck of a metal cylindrical preform article. The method further includes deforming a neck of the preform outward, under pressure from the inner roller, in a region of the preform article neck to form an initial protrusion. The method further includes positioning an outer roller against an outer surface of the neck of the preform article, adjacent to the initial protrusion, while the inner roller is positioned against the inner surface at the initial protrusion. The method further includes deforming the neck of the preform article inward, under pressure from the outer roller, while the inner roller bears against the inside surface at the initial protrusion. The method further includes reworking the initial protrusion to form the carrier ring.

An eighth implementation of the present disclosure includes a method of forming a metal article with a neck having a carrier ring. The method includes relatively positioning a rolling assembly and a metal preform article having a neck, such that the neck extends into the forming tool. The method further includes causing relative rotation of the preform article and the forming tool, about an axis perpendicular to an open end of the neck, while displacing an inner roller of the rolling assembly radially outward against an inner surface of the neck to deform the neck radially outward under pressure from the inner roller, until the inner roller reaches a desired maximum radial displacement, to form a metal carrier ring. The method further includes retracting the inner roller from the inner surface of the neck, such that the inner roller disengages from the inner surface of the neck, upon the inner roller reaching the desired maximum radial displacement, so that the inner roller does not dwell at the desired maximum radial displacement. The method further includes reworking the initial protrusion to form a metal carrier ring.

An aspect of the eighth implementation, alone or in combination with any other aspect of the sixth implementation, includes the inner roller disengaging from the inner surface of the neck within 20 degrees of revolution of the relative rotation of the preform article and the rolling assembly.

An aspect of the eighth implementation, alone or in combination with any other aspect of the sixth implementation, includes the inner roller disengaging from the inner surface of the neck within 10 degrees of revolution of the relative rotation of the preform article and the rolling assembly.

An aspect of the eighth implementation, alone or in combination with any other aspect of the sixth implementation, includes the inner roller disengaging from the inner surface of the neck within 1 degree of revolution of the relative rotation of the preform article and the rolling assembly.

An aspect of the eighth implementation, alone or in combination with any other aspect of the sixth implementation, includes the inner roller retracting from the inner surface of the neck within 2-5 revolutions of the relative rotation of the preform article and the rolling assembly rolling assembly after initial contact between the inner roller and the inner surface of the neck.

A ninth implementation of the present disclosure includes a method of deforming a neck of a metal preform article. The method includes forming an initial protrusion about a neck of the preform article. The method further includes relatively positioning a rolling assembly and the preform article such that the neck of the preform article extends into the rolling assembly and a pilot extends into the neck. The pilot has a first portion positioned adjacent an open top end of the neck and a second portion positioned deeper within the neck than the first portion. The first portion has an outer diameter. The second portion has an outer diameter defining a gap with the inner surface of the neck, the outer diameter of the second portion being smaller than the outer diameter of the first portion. The method further includes engaging an outer surface of the neck with a forming roller and deforming the neck into the gap toward the second portion of the pilot under pressure from the forming roller.

An aspect of the ninth implementation, alone or in combination with any other aspect of the ninth implementation, includes the pilot further including a third portion positioned outside of and adjacent to the open top end of the neck. The diameter of the third portion is greater than a diameter of the open top end of the neck.

An aspect of the ninth implementation, alone or in combination with any other aspect of the ninth implementation, includes the method further including applying an axial load to the open top end during the engaging the outer surface of the neck with the forming roller.

A tenth implementation of the present disclosure includes a method of forming a metal article with a neck having a carrier ring. The method includes relatively positioning a rolling assembly and a metal preform article having a neck, such that the neck of the bottle preform extends into the forming tool. The method further includes causing relative rotation of the preform article and the rolling assembly about an axis generally perpendicular to an open end of the neck while displacing an inner roller of the rolling assembly radially outward against an inner surface of the neck to deform the neck radially outward, under pressure from the inner roller, thereby forming an initial protrusion about the neck. The method further includes reworking the initial protrusion, under pressure applied by a second forming tool, to form a metal carrier ring having substantially parallel upper and lower surfaces and a thickness approximately equal to twice a wall thickness of a sidewall of the preform article. A maximum axial load applied by the first and second rolling assembly to the preform article is less than 890 Newtons.

An eleventh implementation of the present disclosure includes a method of forming a metal article with a carrier ring. The method includes forming an initial protrusion about a neck of a metal preform article under pressure applied by a first roller displaced radially outward inside the neck. The method further includes collapsing the initial protrusion axially, by pressure applied by a second roller displaced radially inward outside the neck and an axial load applied to an open top end of the preform article, to form a metal carrier ring extending outwardly on the neck. The metal carrier ring has substantially parallel upper and lower surfaces meeting at a distal edge of the carrier ring. The distal edge has an outer bend radius approximately equal to a thickness of the neck of the preform article.

It is to be understood that both the foregoing general description and the following detailed description are exemplary and explanatory only and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

Figure 1:
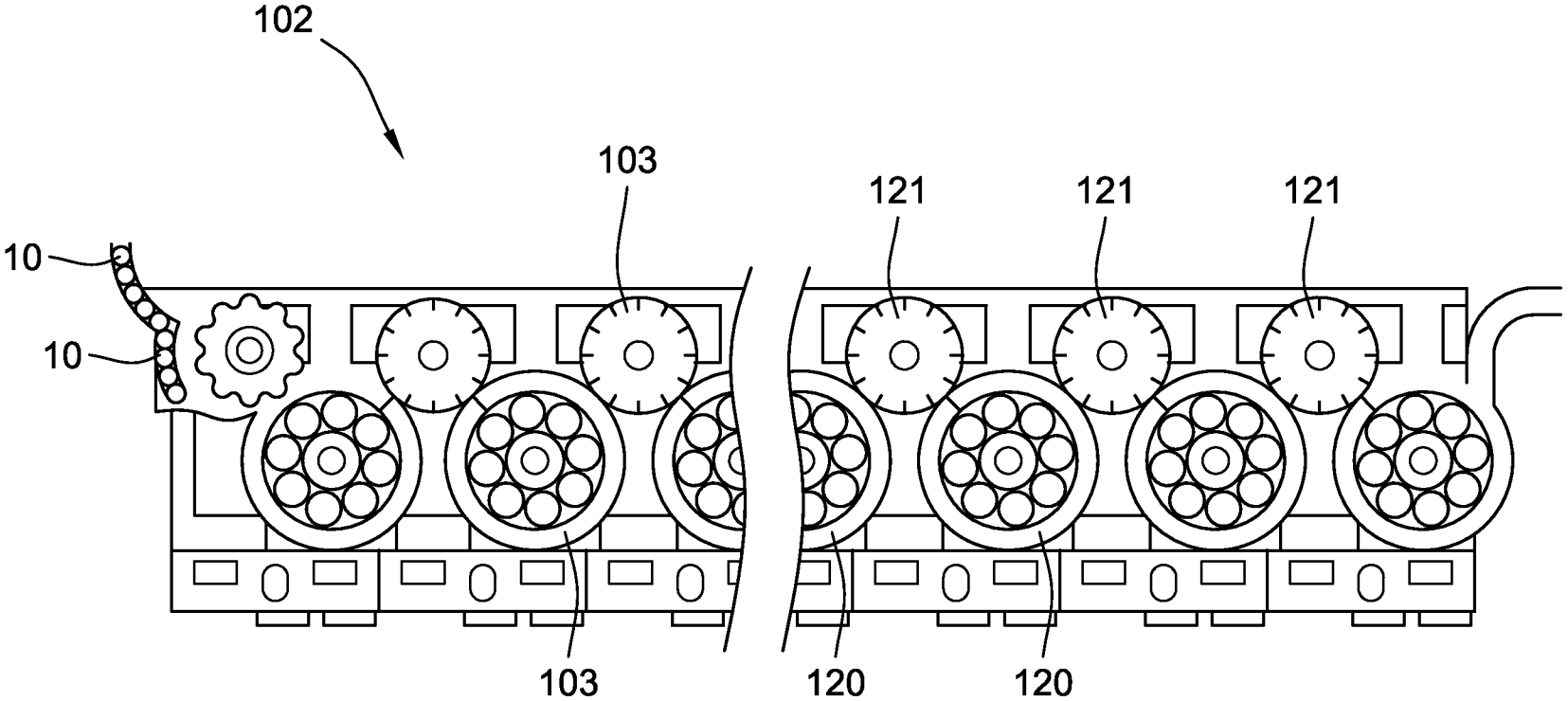
FIG. 1 illustrates a machine line for forming articles, according to one embodiment.

While the invention is susceptible to various modifications and alternative forms, specific forms thereof have been shown by way of example in the drawings and will herein be described in detail. It should be understood, however, that it is not intended to limit the invention to the particular forms disclosed, but, on the contrary, the intention is to cover all modifications, equivalents, and alternatives falling within the spirit and scope of the invention.

DETAILED DESCRIPTION

Objects of the present invention are directed to a metal article (e.g., a container) that can replace current containers formed of plastic resins, such as PET, PVC, etc., and methods for making the metal container. The metal container includes a carrier ring that protrudes radially from the neck of the metal container. The carrier ring is desirably sized to be compatible with current container processing lines that use plastic containers. The carrier ring allows the metal container to be conveyed through existing processing lines, such as washing, filling, and capping processing lines.

Referring to FIG. 1, an exemplary machine line 102 for forming articles is shown. The machine line 102 includes a plurality of modules 103. Each module 103 is configured to perform at least one working step to a received article 10 (see FIG. 2A) prior to passing the article 10 downstream. The modules 103 generally include one or more forming turrets 120 configured to perform a working operation on the article 10. The forming turret(s) generally include at least one forming starwheel having a plurality of pockets and tooling configured to perform a working operation on an article 10 within a respective pocket.

The modules 103 generally further include at least one transfer starwheel (e.g., transfer starwheels 121) having a plurality of pockets thereon. The pockets are configured to receive the articles 10 from an upstream starwheel and transport the article 10 to a downstream starwheel. Optionally, a recirculation system can be employed. An example recirculation system is described in PCT/US2015/018119, which is hereby incorporated herein by reference in its entirety.

The articles described herein may be a can or container, any suitable food or beverage container, jar, bottle, or any other suitable article. As shown in, for example, FIGS. 2A-2B, the articles described herein 10 have an open top end 11 (through which contents of the article 10 may flow) opposite a closed base 12 and a sidewall 14 that extends up from the base 12 and bridges a top edge 25 and the base 12. Alternatively, the article 10 may be open at both ends. The article 10 further includes a shoulder 15 that curves inward and up from the sidewall 14 and a narrowed neck 16 extending up from the shoulder 15 to the top end 11. A top, lid, or other closure may be added to the article 10 after the necking process. The article 10 may be held to a respective device (e.g., a pusher device) using, e.g., a push ram having a vacuum coupled thereto.

Figure 2A:
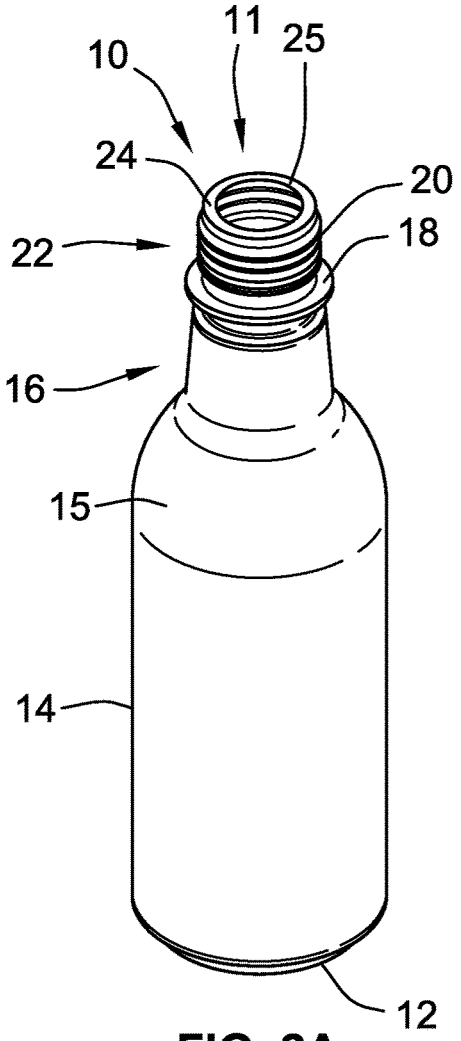
FIG. 2A is a perspective view of a finished article with a carrier ring, according to one embodiment.
Figure 2B:
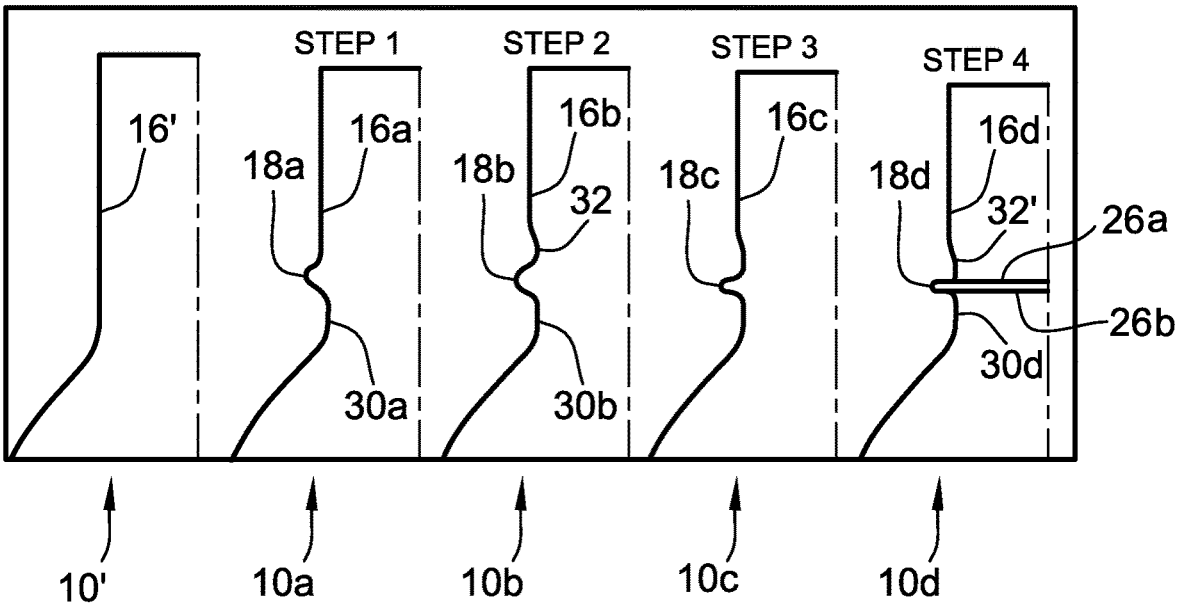
FIG. 2B illustrates articles resulting from various stages of a carrier ring-forming process, according to one embodiment.

During necking procedures, the neck 16 of a generally cylindrical preform article is diametrically reduced in stages to form a generally smooth finished neck 16' of a preform necked article 10' (see FIG. 2B). The procedure is performed in multiple stages to assist in preventing misforming, breaching, or splitting.

Figure 2C:
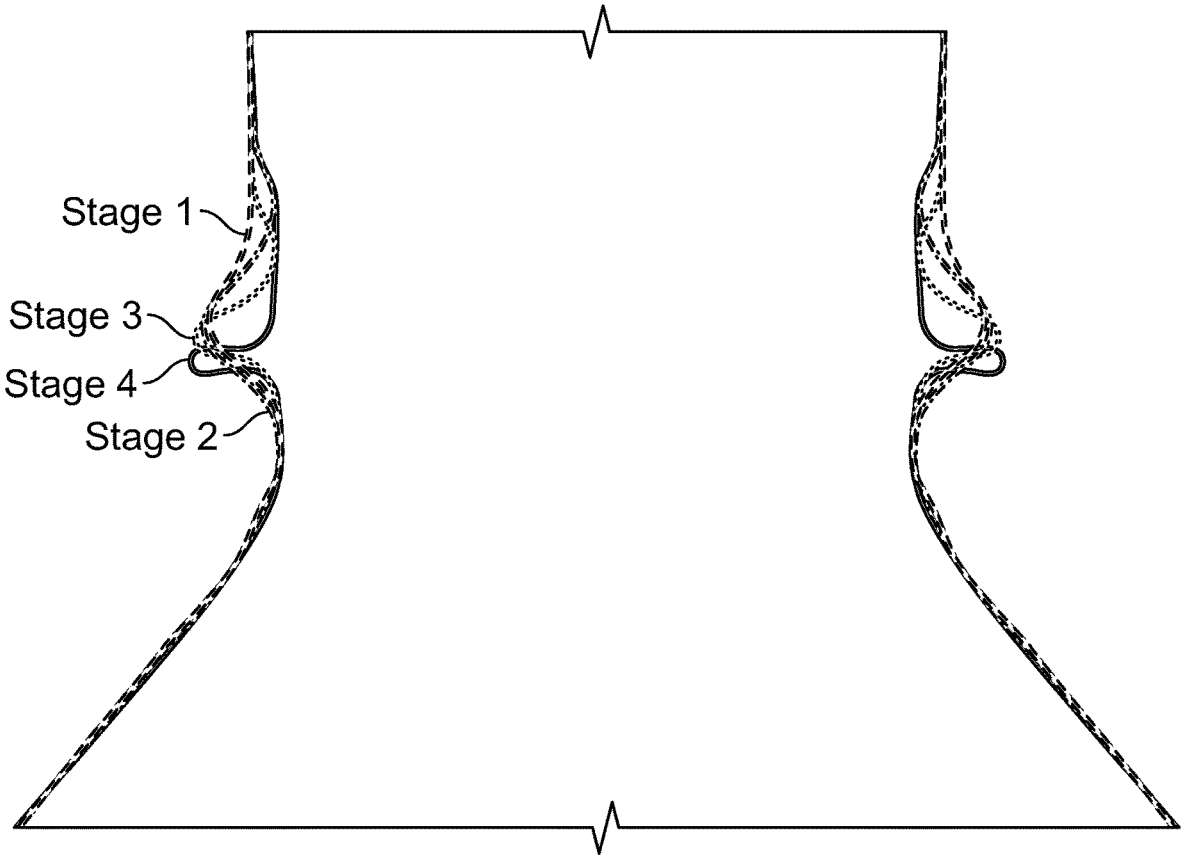
FIG. 2C illustrates a close-up view comparing profiles of a neck portion of an article during various stages of a carrier ring-forming process, according to one embodiment.

According to the embodiments described herein, as the preform necked article 10' is passed downstream, working operations are performed on the neck 16' to form a carrier ring 18 (see FIG. 2A). FIGS. 2B-2C illustrate profile views of a plurality of articles 10', 10*a*, 10*b*, 10*c*, 10*d* at various stages of a process of forming a carrier ring 18 according to one embodiment. As shown in FIG. 2C, a result of the various forming stages described herein, the carrier ring 18 generally moves down the neck 16 of the article 10 (i.e., closer to the shoulder 15 and base 12 of the article 10) as the forming process continues through the various forming stages (described in detail below). For example, the location of the carrier ring may move downward about 1 millimeter (mm) to about 2 mm from the open top end 11 of the article. In other embodiments, the carrier ring may move upward (closer to the open top end 11) as the forming process continues through the various forming stages.

It is contemplated that further necking operations can also be performed to further modify the neck 16 of the article 10 and/or to form a finish 22 having threads 20, a curl 24, a pilfer-band, etc. thereon. The finished neck 16 may be configured to accept a cap for sealing the article 10. It is contemplated that the finished neck 16 may include threads 20 or may be smooth with a press-on/snap closure.

Although a particular geometry and profile are illustrated, it is contemplated that the carrier rings of the articles 10 described herein can have any suitable geometry or profile. In one or more embodiments, however, the geometry and profile of the article 10 can be identical or similar to the geometry and profile of a plastic container. In particular, the article 10 can have the same geometry and profile as a plastic container for which the article 10 is configured to replace. The identical or similar geometry and profile allows the article 10 to, e.g., fit within the air conveyor rails configured for the similarly shaped plastic container.

In one or more embodiments, the neck 16 can have a similar geometry and profile as a corresponding plastic container, but the remainder of the article 10 (e.g., the base 12, the sidewall 14, the shoulder 15, or any combination thereof) can have a different geometry or profile. The neck 16 having the same geometry and profile configures the article 10 to fit within existing processing lines because the neck 16 of the article 10 is the portion that interfaces with an air conveyor channel of existing processing lines. In one or more embodiments, the neck 16 can conform to the 38 mm or 28 mm PCO (Plastic Closure Only) 1881, 1816, or 1810 specifications of the ISBT (International Society of Beverage Technologists). It is contemplated that the embodiments described herein may be used to form articles having any desired width/diameter of opening in the neck 16.

The articles 10 described herein are formed of metal, such as aluminum or stainless steel, or any other metal or metal alloy that can be recycled. As a result, the article 10 is more sustainable and recyclable than a similar plastic container, such as a PET container.

The carrier rings 18 formed using the processes described herein are generally in the shape of a ring radially protruding from the neck 16 of the article 10. The carrier ring 18 can have various cross-sectional shapes, such as rounded, triangular, square, rectangle, etc. In one or more embodiments, a top surface 26*a* (see FIG. 2B) of the carrier ring 18 is generally sloped downwardly. Such a configuration may be desirable such that any excess moisture can more easily roll off of the carrier ring 18. In one or more embodiments, the shape of the carrier ring 18 can depend on the shape of the carrier ring of the plastic container that the metal article 10 is intended to replace. In one or more embodiments, the shape of the carrier ring 18 can match the shape required for an air conveyor channel within which the article 10 is to be used or the shape required for processing of the article 10, such as subsequent rinsing, filling, and/or capping processes.

According to embodiments of the present disclosure, the carrier ring 18 is integrally formed on the neck 16 of the article 10 during manufacturing. As illustrated in FIG. 2A, the carrier ring 18 is formed around the neck 16 and below the finish 22, similar to the location of a carrier ring in a corresponding plastic container. The carrier ring 18 is formed such that, for example, the article 10 can ride the air conveyor rails for a corresponding plastic container. To do so, the carrier ring 18 can be sized to match the corresponding carrier ring on a plastic container. For example, the carrier ring 18 can be sized according to the dimensions of the, e.g., 38 mm or 28 mm PCO 1881, 1816, or 1810 specifications discussed above. It is contemplated that the embodiments described herein may be used to form articles having any desired width/diameter of opening in the neck 16. This makes the carrier ring 18 compatible with air conveyor rails and other machinery used with plastic containers.

Because plastic containers come in various sizes, the carrier ring 18 can also come in various different sizes. In one or more embodiments, the size of the carrier ring 18 can depend on the overall size of the article 10. For example, the larger the article 10, the larger the carrier ring 18 may be, so as to support greater loads during manufacturing or processing using the carrier ring 18.

In some embodiments, after Step/Stage 1 (as described in detail below) the middle of the carrier ring 18*a* may be positioned about 20 mm to about 42 mm from the open top end 11 of an unfinished article 10*a* (see FIG. 2B). In other embodiments, after Stage 1, the middle of the carrier ring 18*a* may be positioned about 23 mm to about 39 mm from the open top end 11 of the unfinished article 10*a*. In still other embodiments, after Stage 1, the middle of the carrier ring 18*a* may be positioned about 26 mm to about 36 mm from the unfinished top end 11 of the article 10*a*. However, the location of the carrier ring 18*a* can vary depending on, for example, the size of the article 10*a*.

In some embodiments, after Stage 2 (as described in detail below), a middle of the carrier ring 18*b* may be positioned about 20 mm to about 42 mm from a top open top end 11 of the unfinished article 10*b* (see FIG. 2B). In other embodiments, after Stage 2, the middle of the carrier ring 18*b* may be positioned about 23 mm to about 39 mm from the open top end 11 of the unfinished article 10*b*. In still other embodiments, after Stage 2, the middle of the carrier ring 18*b* may be positioned about 26 mm to about 36 mm from the open top end 11 of the unfinished article 10*b*. However, the location of the carrier ring 18*b* can vary depending on, for example, the size of the article 10*b*.

In some embodiments, after Stage 3 (described in detail below) a middle of the carrier ring 18*c* may be positioned about 19 mm to about 41 mm from the open top end 11 of an unfinished article 10*c*. In other embodiments, after Stage 3, the middle of the carrier ring 18*c* may be positioned about 22 mm to about 38 mm from the open top end 11 of the unfinished article 10*c*. In still other embodiments, after Stage 3, the middle of the carrier ring 18*c* may be positioned about 25 mm to about 35 mm from the open top end 11 of the unfinished article 10*c*. However, the location of the carrier ring 18*c* can vary depending on, for example, the size of the article 10*c*.

In some embodiments, after Stage 4 (described in detail below) the carrier ring 18*d* may be positioned about 18 mm to about 40 mm from the open top end 11 of the unfinished article 10*d* (see FIG. 2B). In other embodiments, after Stage 4, the carrier ring 18*d* may be positioned about 21 mm to about 37 mm from the open top end 11 of the unfinished article 10*d*. In still other embodiments, after Stage 4, the carrier ring 18*d* may be positioned about 24 mm to about 33 mm from the top end 11 of the unfinished article 10*d*. However, the location of the carrier ring 18 can vary depending on, for example, the size of the article 10.

In some embodiments, a middle of the carrier ring 18 of the finished (e.g., threaded, curled) article 10 may be positioned about 13 mm to about 34 mm from the top of the curl 24 (see FIG. 2A). In other embodiments, the middle of the carrier ring 18 of the finished article 10 may be positioned about 16 mm to about 31 mm from the top of the curl 24. In still other embodiments, the middle of the carrier ring 18 of the finished article 10 may be positioned about 19 mm to about 28 mm from the top of the curl 24. For example, a middle of the carrier ring 18 of the finished article 10 can be located about 17 mm from the top of the curl 24. In another embodiment, the middle of the carrier ring 18 of the finished article 10 can be located about 21.2 mm from the top of the curl 24. In yet another embodiment, the middle of the carrier ring 18 of the finished article 10 can be located about 23.4 mm from the top of the curl 24. However, the location of the carrier ring 18 can vary depending on, for example, the size of the article 10.

In some embodiments, the outer radius of the carrier ring 18 (e.g., an article 10 having an about 28 mm open end diameter) radially outward may be about 12 mm to about 21 mm greater than the radius of the open top end 11 of the unfinished article 10. In other embodiments, the outer radius of the carrier ring 18 may be about 14 mm to about 19 mm greater than the radius of the open top end 11 of the unfinished article 10. In still other embodiments, the outer radius of the carrier ring 18 may be about 16 mm to about 17 mm greater than the radius of the open top end 11 of the unfinished article 10.

In some embodiments, the outer radius of the finished carrier ring 18 may be about 7% to about 45% larger than the outer radius of the top edge 25 of the article 10. In other embodiments, the outer radius of the finished carrier ring 18 may be about 11% to about 40% larger than the outer radius of the top edge 25 of the article 10. In still other embodiments, the outer radius of the finished carrier ring 18 may be about 14% to about 35% larger than the outer radius of the top edge 25 of the article 10.

In some embodiments, the outer radius of the finished carrier ring 18 may be about 15% to about 40% larger than the radius of the adjacent grooves 32', 30*d* (see FIG. 2B) of the neck of the article 10*d*. In other embodiments, the outer radius of the finished carrier ring 18 may be about 20% to about 35% larger than the outer radius of the adjacent grooves 32', 30*d* of the neck of the article 10. In still other embodiments, the outer radius of the finished carrier ring 18 may be about 25% to about 30% larger than the outer radius of the adjacent grooves 32', 30*d* of the neck of the article 10.

According to one non-limiting example, the sidewall thickness of the neck 16 of the article 10 used with the systems and processes described herein ranges from about 0.254 mm to about 0.356 mm (about 0.010 inch to about 0.014 inch). The starting, generally cylindrical preform container body in one embodiment has an outer diameter of about 58.9 mm (about 2.32 inches). The neck 16 of the preform may be diametrically reduced during a necking process(es) to a diameter of about 28.2 mm (about 1.11) inches (see article 10' of FIG. 2B) prior to the carrier ring-forming process. The preform may start with a sidewall thickness of about 0.22 mm to about 0.23 mm (about 0.0085 inch to about 0.0090 inch), which may increase to an average of about 0.318 mm (about 0.0125) during the necking process. The sidewall material of the neck 16, which is generally cylindrical, may vary by +/−0.0127 mm (+/−0.0005 inch). During the carrier ring-forming process described herein, the sidewall thickness of the article may thinned by up to about 0.051 mm (about 0.0020 inch) generally without compromising the integrity of the material and coatings thereon.

According to aspects of the present disclosure, apparatuses and methods are described for improving article (e.g., container) necking processes. Although the embodiments described herein are discussed with respect to carrier ring-forming processes, it is contemplated that the apparatuses and the methods of using the same may also be applied in association with other processes that result in forming a ring, protrusion, and/or recessed portion/groove on or otherwise processing/modifying a neck of an article generally adjacent to or near an open top end of the article.

In accordance with some aspects of the present disclosure, axial movement of a portion of a turret-head assembly (e.g., turret-head assemblies 200*a-d* of FIGS. 3A-6) used to form a carrier ring on a neck of an article in turn causes radial movement of tooling (e.g., rollers) with respect to a turret-head assembly axis. For example, in some embodiments, mechanical actuation of a turret-head assembly into a position to form a processing operation on an article being formed or modified is accomplished using the article itself. This may be advantageous because external components or mechanisms are not required, e.g., to actuate rollers to contact the neck of the article so that a carrier ring may be formed thereon. Thus, less equipment may be required, thereby decreasing the cost associated with forming the carrier ring. In other embodiments, radial movement of the tooling may be actuated by a secondary mechanism (e.g., a cam actuator) external to the turret-head assembly causing axial movement of components of the turret-head assembly.

FIGS. 3A-3I illustrate an example of a turret-head assembly 200*a* used in a first step or stage ("Stage 1") of a carrier-ring forming process, according to aspects of the present disclosure. The turret-head assembly 200*a* includes a top plate 206, a base plate 208, and a housing 204. The top plate 206 and housing 204 support alignment pins 213. The top plate 206 is slidably coupled to the base plate 208 by the alignment pins 213 and a rolling assembly 210*a* (for roller forming tools, e.g., outer roller 224*a* and inner roller 226 (see FIG. 3B). The rolling assembly 210*a* is positioned and slides within the housing 204. A turret-head assembly axis 203 is defined as extending generally through the center of the turret-head assembly 200*a*. In FIGS. 3A-3I, the axis 203 extends through the center of the outside diameters of the top plate 206 and the housing 204. When a force is applied to the rolling assembly 210*a* (e.g., when an article 10 is inserted into the turret-head assembly 200*a*, as described in detail below), the rolling assembly 210*a* (and the components coupled thereto, as described in detail below) slides up along the turret-head assembly axis 203 relative to the housing 204 in the direction of Arrow A.

In the non-limiting embodiment of FIGS. 3A-3I, the turret head-retention device 202 is a screw that fastens the top plate 206 of the rotating turret-head assembly 200*a* to the forming turret (see FIGS. 10A-10D). In other embodiments, the turret head-retention device 202 may be, e.g., a drawbar or other suitable device. In embodiments where the article is rotated (instead of the turret-head assembly 200*a* being rotated), the turret head-retention device 202 simply retains the turret-head assembly 200*a* to a non-rotating feature that is in axial alignment with the forming turret and/or a spindle that rotates the article to be formed.

The turret-head assembly 200*a* further includes a plurality of spring guides 212 having a corresponding plurality of resilient devices (e.g., compression springs 214) coupled thereto for keeping the rolling assembly 210*a* in an open/uncompressed position. In the illustrated embodiment, the spring guides 212 are fixed to the base plate 208. The top plate 206 may include a clearance hole through which the spring guide 212 may be slidably positioned. In other embodiments, the design of the spring guide 212 may be inverted such that the spring guide 212 is mounted to the top plate 206 with a clearance hole in the base plate 208.

In embodiments where the compression springs 214 have a length-to-diameter ratio large enough to possibly buckle when compressed, the spring guides 212 may provide support to the compression springs 214. If sufficient space is available, compression springs 214 having larger diameters that are not susceptible to buckling can be used, in which case the spring guides 212 may be eliminated.

The turret-head assembly 200*a* further includes alignment pins 213 configured to maintain alignment of the rolling assembly 210*a* as it translates (reciprocates). In one embodiment, the base plate 208 is rigidly fixed to the alignment pins 213, and the rolling assembly 210*a* is slidably coupled to the alignment pins 213. In another embodiment, the top plate 206 is slidably coupled to the alignment pins 213, and the rolling assembly 210*a* is rigidly fixed to the alignment pins 213.

It is contemplated that, in some embodiments, other mechanisms internal to or external to the turret-head assembly 200*a* may be used to move (e.g., force the return of) the rolling assembly 210*a*. For example, the compression springs 214 can be removed from the turret-head assembly 200*a*, and the spring guides 212 may extend through the top plate 206, where a force from an external source may be applied. In another embodiment, air cylinders, air springs, leaf springs, or the like can be installed in place of the compression springs 214.

Figure 3A:
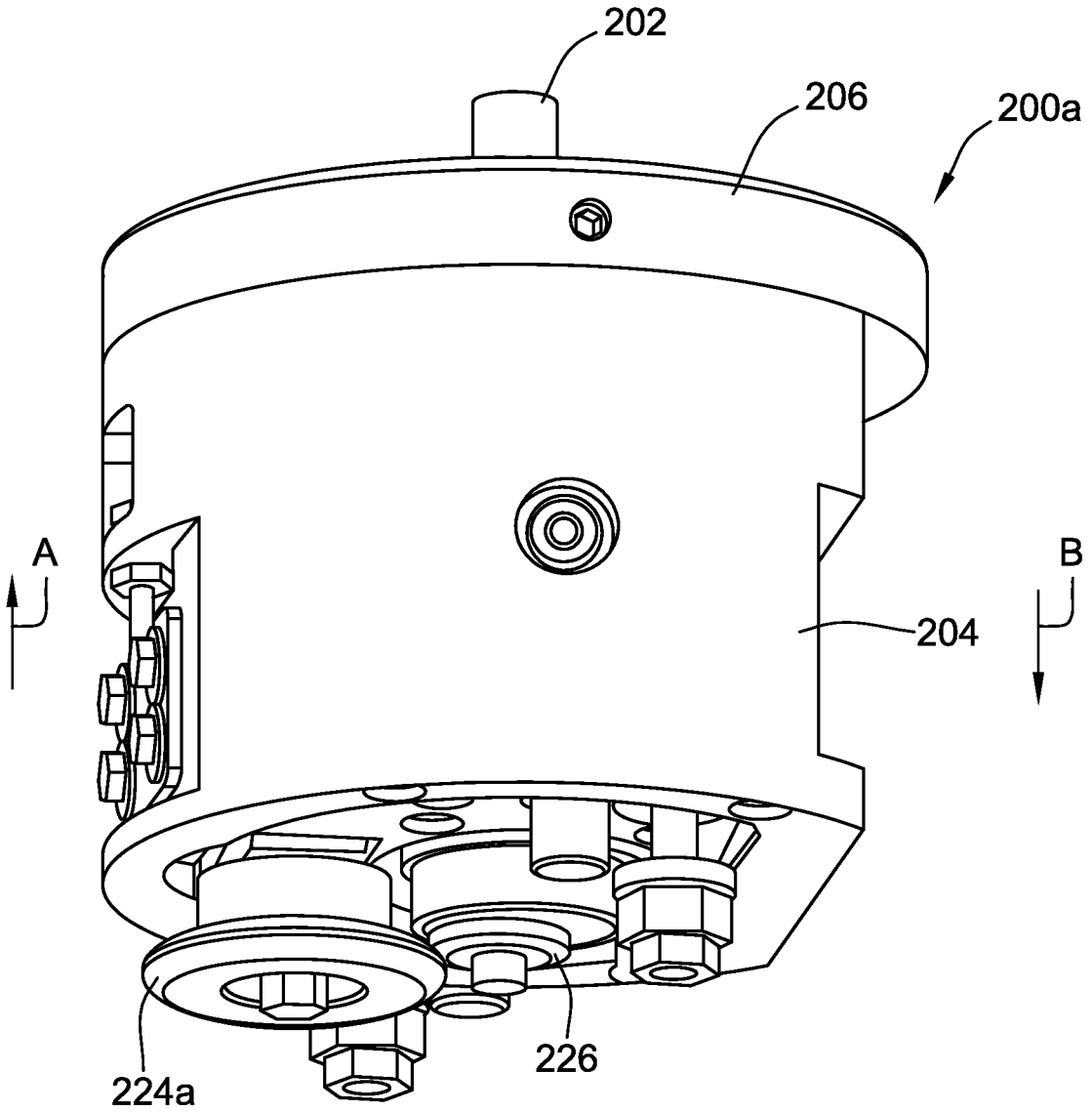
FIG. 3A illustrates a perspective bottom view of a turret-head assembly used in one stage of a carrier ring-forming process, according to one embodiment.
Figure 3B:
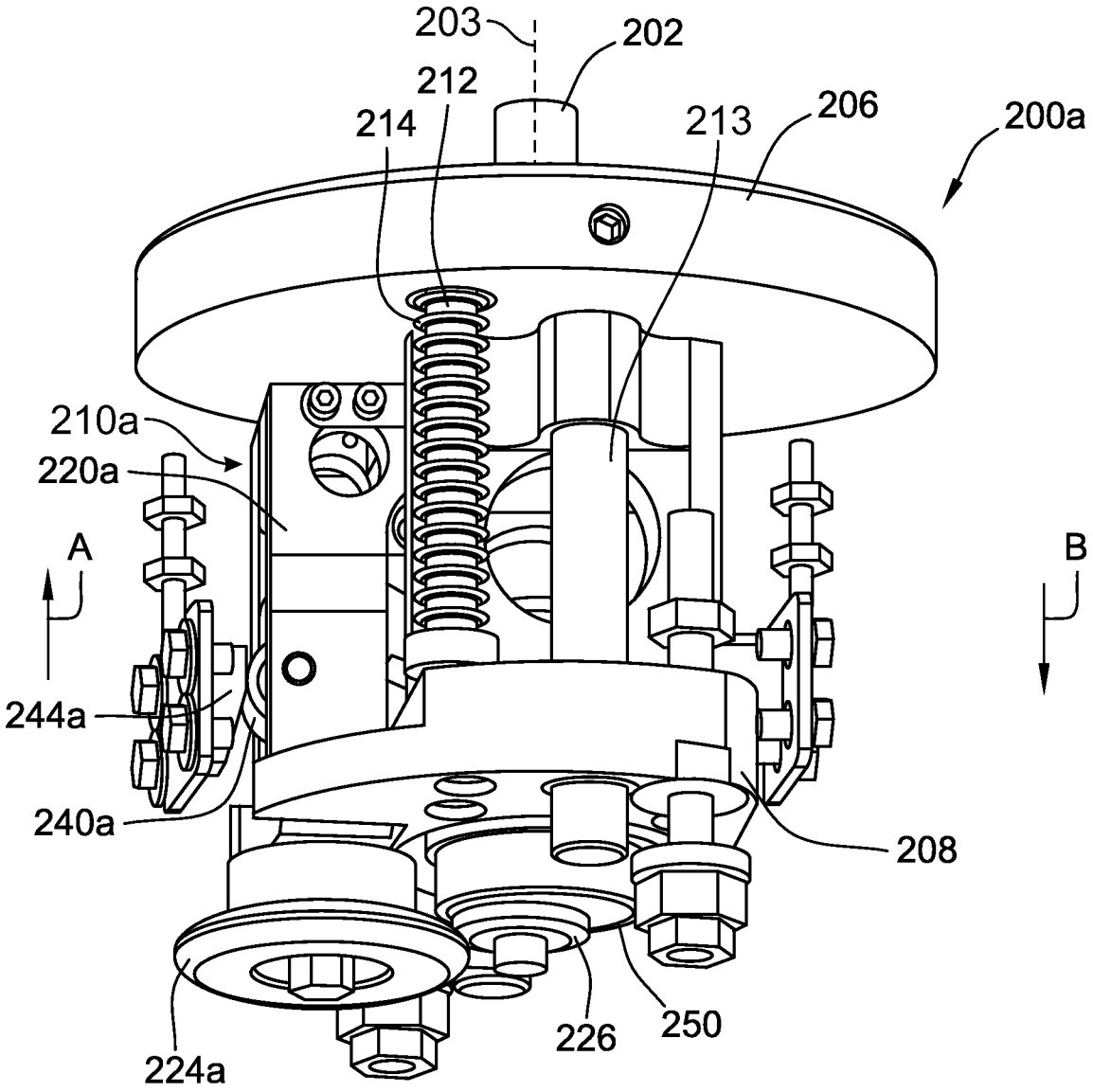
FIG. 3B illustrates the turret-head assembly of FIG. 3A with a housing removed.
Figure 3C:
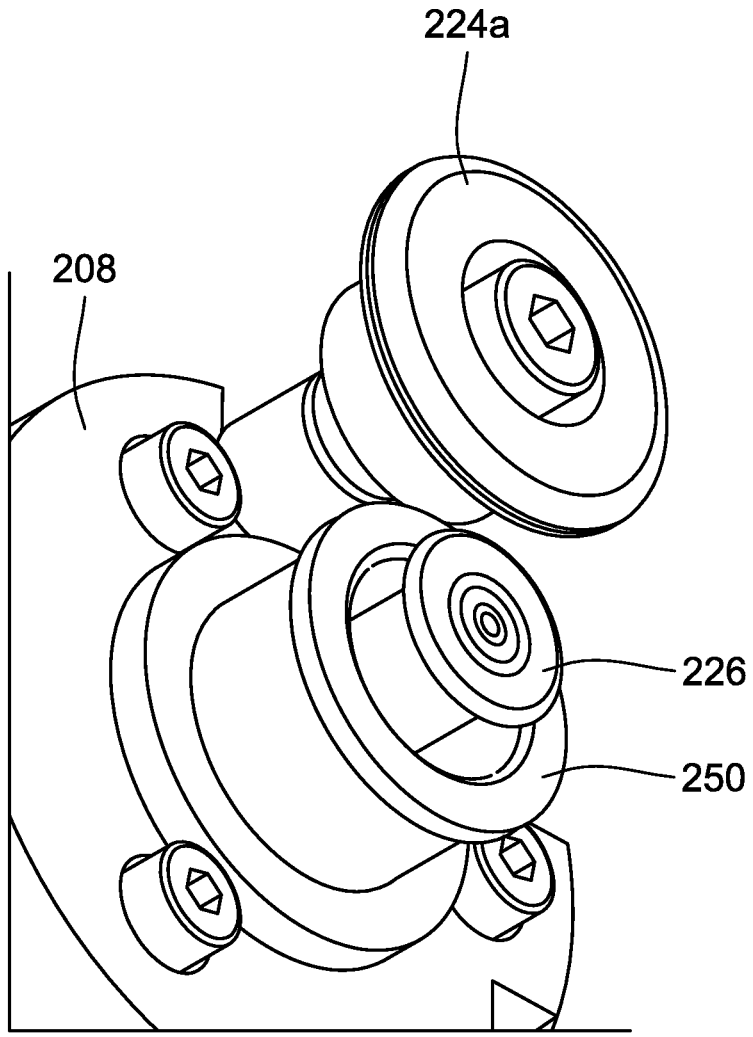
FIG. 3C illustrates a perspective bottom view of inner and outer rollers of the turret-head assembly of FIGS. 3A and 3B.
Figure 3D:
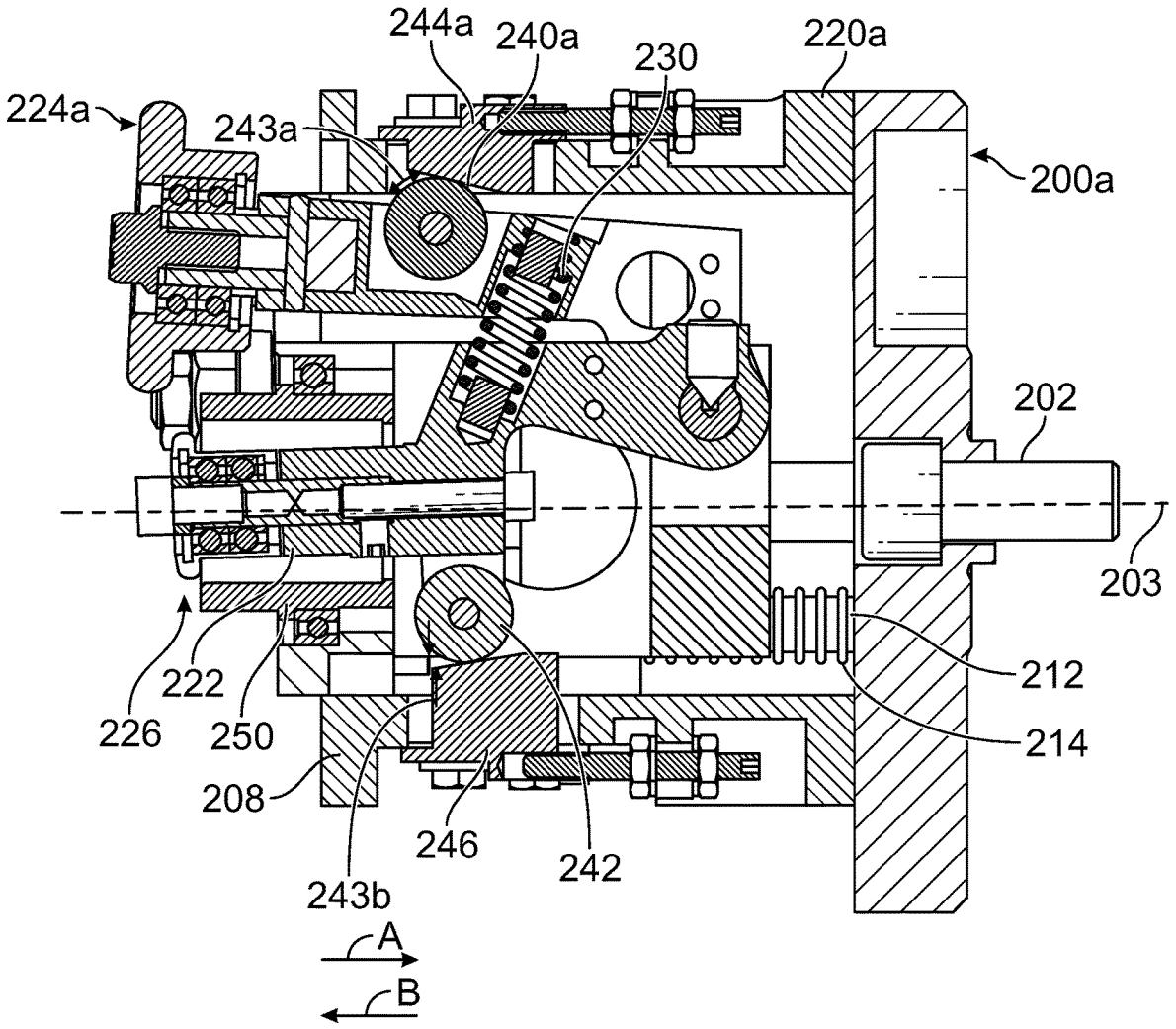
FIG. 3D illustrates a cross-sectional view of the turret-head assembly of FIGS. 3A-3C in an uncompressed position.
Figure 3E:
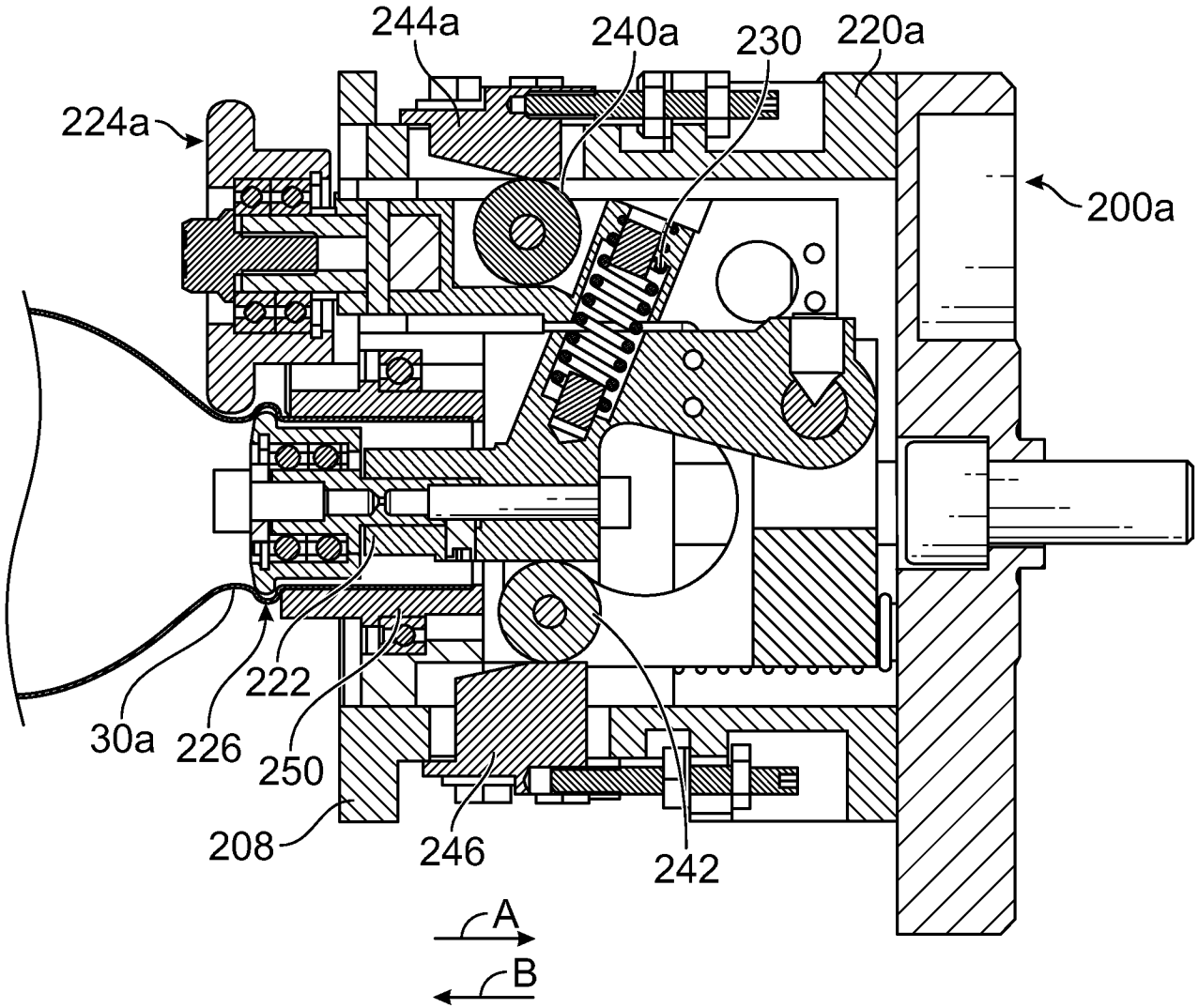
FIG. 3E illustrates a cross-sectional view of the turret-head assembly of FIGS. 3A-3D in a compressed position.
Figure 12:
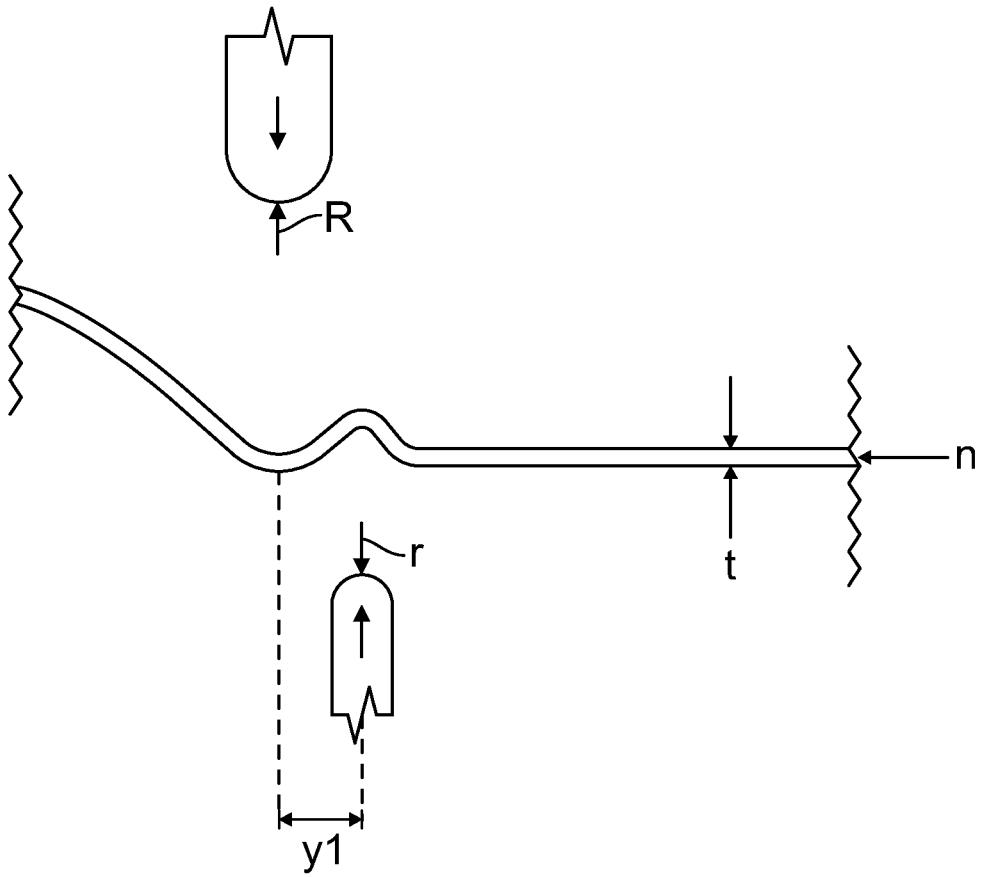
FIG. 12 illustrates a cross sectional view of an article formed in accordance with the embodiments discussed herein.

The rolling assembly 210*a* includes at least one outer roller arm 220*a* (see FIGS. 3B, 3D, and 3E-3G) and an inner roller arm 222 (see FIG. 3D), each of which has a respective outer roller 224*a* and inner roller 226 coupled to a lower end thereof. In one non-limiting embodiment, the inner roller 226 has a forming radius 227*a* (measured axially) (see forming radius r of FIG. 12) of about 0.63 to about 2 mm (about 0.025 to about 0.080 inch), and the outer roller 224*a* has a forming radius 227*b* (measured axially) of about 1 to about 5 mm (about 0.05 to about 0.20 inch) (see FIG. 3F-3G, see also (see forming radius R of FIG. 12). The outer roller arm 220*a* and the inner roller arm 222 may be coupled to one another via a resilient device (e.g., arm spring 230, as shown in FIGS. 3D-3E). It is contemplated that the outer roller arm 220*a* and/or the inner roller arm 222 may be coupled to other portions of the rolling assembly 210*a*, e.g., using a resilient device(s). An outwardly facing side of each of the outer roller arm 220*a* and the inner roller arm 222 includes a respective outer roller arm cam follower 240*a* and inner roller arm cam follower 242 coupled thereto. Each of the outer roller arm cam follower 240*a* (see FIGS. 3B, 3D, 3E, and 3I) and inner roller arm cam follower 242 (see FIGS. 3D, 3E, and 3I) is configured to contact a respective outer roller cam 244*a* (see FIGS. 3B, 3D, 3E, and 3I) and inner roller cam 246 (see FIGS. 3D, 3E, and 3I) coupled to an interior surface of the housing 204.

Although only a single outer roller arm 220*a* (and corresponding outer roller 224*a*) is shown in the embodiment of FIGS. 3A-3I, it is contemplated that any suitable number of outer roller arms and outer rollers may be used. However, in some embodiments, a single outer roller arm may be desirable so that more material from the neck 16 of the article 10 may be displaced during forming of the carrier ring.

The rolling assembly 210*a* is configured to be axially moved relative to the turret-head assembly axis 203. For example, in one embodiment, the lower end of the rolling assembly is configured to be activated by an article passing through a generally central aperture in the base plate 208 (as shown in FIGS. 3-6). In another embodiment (shown in FIGS. 8-11), the rolling assembly is configured to be activated by an external mechanism, e.g., a cam/cam follower assembly.

As shown in the embodiment of FIG. 3D-3H, the aperture in the base plate 208 includes a pilot 250 mounted thereto. The diameter of the pilot 250 is configured to allow the generally straight neck 16' of the article 10' therethrough. Bearings inside the pilot 250 allow the article 10' to remain generally stationary as the turret-head assembly 200*a* rotates. Additionally, a portion of the inner roller arm 222 having the inner roller 226 coupled thereto extends through an interior surface of the pilot 250 such that the inner roller 226 may be positioned within the neck 16' of the article. The pilot 250 of FIGS. 3D-3H may be used with or without axial compliance.

In one embodiment, the article 10' (see FIG. 2B) is driven into the turret-head assembly 200*a* by a ram and push plate that follow along a path. As such, the top edge 25 of the article 10' is guided into the turret-head assembly 200*a* and received by the pilot 250. The top edge 25 catches on a step 252 (see FIG. 3F) positioned on a distal end of the pilot 250. The step 252 has a diameter that is smaller than that of the top edge 25 of the article 10'. As such, the step 252 acts as a stop for the top edge 25 and, optionally, applies an axial load thereto. Continuing to advance the article 10' in the direction of Arrow A of FIG. 3F activates the upward movement of at least a portion of the rolling assembly 210*a* in the direction of Arrow A. In another embodiment, the turret-head assembly 200*a* of Stage 1 (see FIG. 3A and FIG. 8A, described in detail below) includes a front guide assembly (similar to a front guide 270 of FIGS. 4I-7 and described in more detail below) rigidly attached to and/or with axial compliance to the base plate 208 (see FIG. 3B).

As the rolling assembly 210*a* moves upward, the spring 230 between the outer and inner roller arms 220*a*, 222 causes the respective cam followers outer and inner cam followers 240*a*, 242 to engage with the respective outer and inner cams 244*a*, 246. The outer and inner roller cams 244*a*, 246 generally have an angled, sloped shape such that the top of the cam 244*a*, 246 has a greater width than the bottom. The angle 243*a* (see FIG. 3D) formed by the outer roller cam 244*a* may range from about 1° to about 30°. In another embodiment, the angle 243*a* formed by the outer roller cam 244*a* may range from about 4° to about 25°. In yet another embodiment, the angle 243*a* formed by the outer roller cam 244*a* may range from about 7° to about 15° (e.g., about 9°). The angle 243*b* formed by the inner roller cam 246 may range from about 1° to about 19°. In another embodiment, the angle 243*b* formed by the inner roller cam 246 may range from about 4° to about 16°. In yet another embodiment, the angle 243*b* formed by the inner roller cam 246 may range from about 7° to about 13° (e.g., about 10°). The angles 243*a*, 243*b* may be adjusted depending on, e.g., the amount of formation and material displacement desired.

It is contemplated that the outer and/or inner roller cams 244*a*, 246 may have a combination of more than one angle or a curve. As such, the rate at which the rollers 224*a*, 226 move radially inward/outward can be adjusted so that it is not constant. For example, two angled surfaces may be connected by a small radius so that the corresponding roller 224*a*, 226 begins by moving inward at a faster rate and ends by moving inward at a slower rate.

The engagement between the cams 244*a*, 246 and the respective cam followers 240*a*, 242 causes the outer roller arm 220*a* to move radially inward in a generally linear (slightly arced) fashion, thereby causing the outer roller 224*a* coupled thereto to likewise move radially inward toward the center (e.g., the turret-head assembly axis 203) of the turret-head assembly 200*a* to contact an exterior surface of the neck 16' of the article 10'. The upward movement of the rolling assembly 210*a* further causes the inner roller arm 222 and the inner roller 226 coupled thereto to move radially outward in a generally linear fashion to contact an interior surface of the neck 16' of the article 10'. The distance that the outer and inner rollers 224*a*, 226 are moved radially inward can be varied, e.g., by varying the shape of the outer and inner roller cams 244*a*, 246 and/or the angles 243*a*, 243*b* associated therewith. The outer and inner rollers 224*a*, 226 moving toward one another in generally opposite directions results in lower loads on the center pilot. However, it is contemplated that the outer and inner rollers 224*a*, 226 may also move in different directions.

Movement of the inner and outer roller arms 222, 220*a* in a generally linear manner (e.g., generally perpendicular to the article rather than in a fully arcing motion) may be desirable to avoid any interference between the respective rollers 224*a*, 226 and the carrier ring 18*a* formed during Stage 1 (see FIG. 2B) and/or adjacent grooves/recesses. In one non-limiting embodiment, the rollers 224*a*, 226 arc inward on an about 89 mm radius (about 3.50-inch radius).

When the rolling assembly 210*a* is moved in the direction of Arrow A, an outward force from the springs 214 may cause an axial load to be applied from the pilot 250 to the top edge 25 of the article 10', thereby assisting the rollers 224*a*, 226 with a controlled forming of the carrier ring 18 and groove 30*a* by compressing the neck 16' of the article 10'.

Figure 3F:
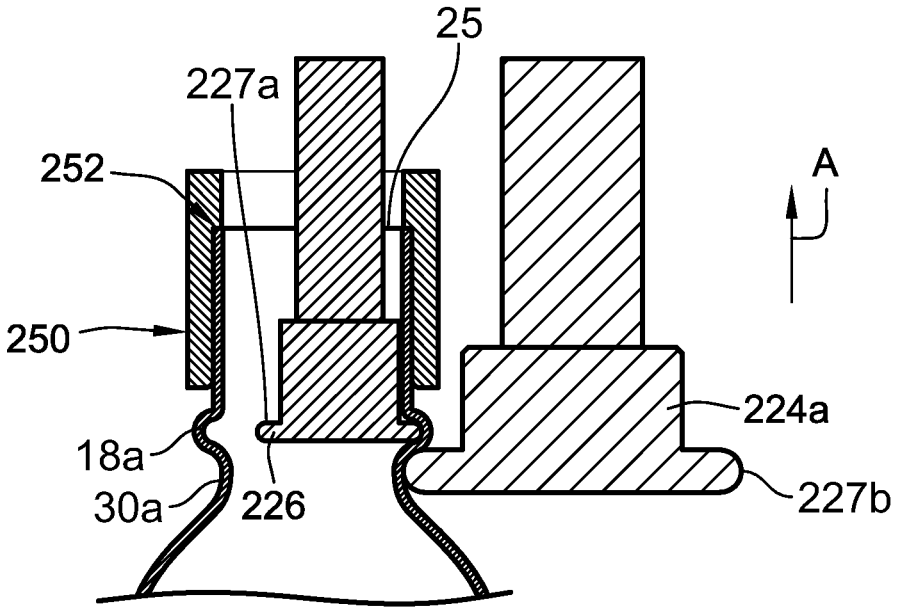
FIG. 3F illustrates a close-up schematic side view of inner and outer rollers of the turret-head assembly of FIGS. 3A-3E contacting a neck of an article.
Figure 3G:
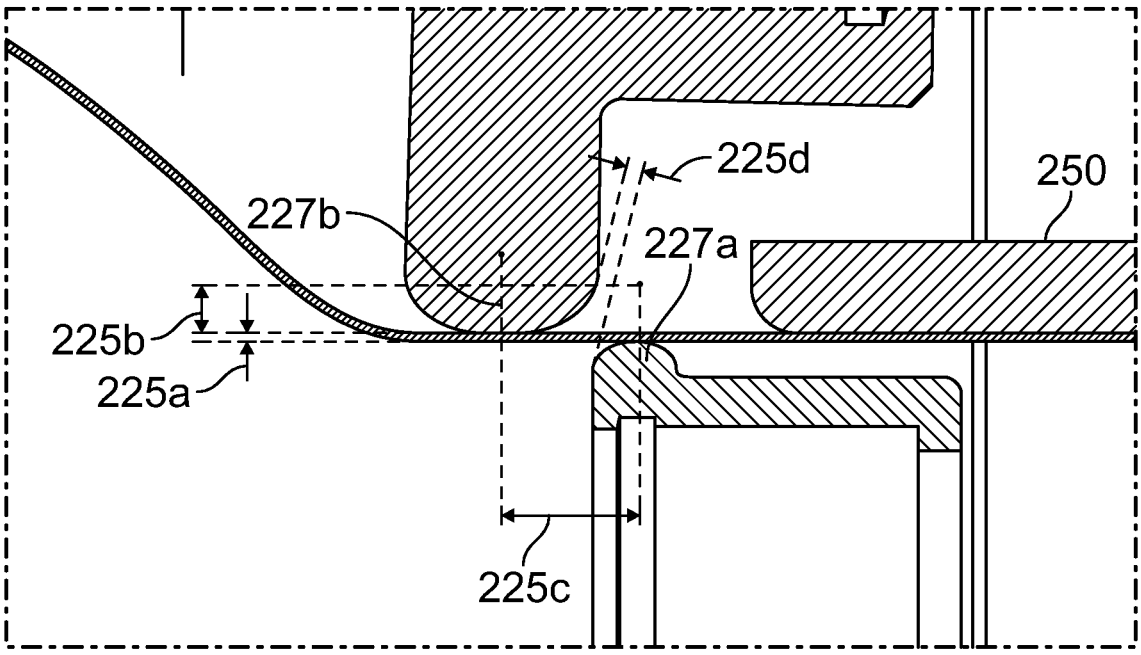
FIG. 3G illustrates a close-up schematic view of the positions of the inner and outer rollers of FIGS. 3A-3F relative to an unformed neck of the article and to one another, according to one embodiment.

As best seen in FIGS. 3F-3G, the axial position of the inner roller 226 is further inward (closer to the center of the turret-head assembly 200*a*/turret-head assembly axis 203) and closer to the open top end 11 of the article 10 than that of the outer roller 224*a* such that a small gap 225*d* (see FIG. 3G) corresponding generally to the thickness of the neck 16' of the article 10' is formed therebetween. In one embodiment, the gap 225*d* at the end of the forming stroke/in the compressed position is about 0.5 mm to about 3 mm (about 0.02 to about 0.11 inch).

In some embodiments, the inner roller 226 contacts the inner surface of the neck 16' of the article 10' before the outer roller 224*a* contacts the outer surface of the neck 16' of the article 10'. For example, in one embodiment, when the inner roller 226 contacts the inner surface of the neck 16', the outer roller 224*a* may be about 2.5 mm (about 0.1 inch) away from the outer surface of the neck 16'. As the forming process begins, the outer roller 224*a* moves radially inward while the inner roller 226 moves radially outward such that both the outer and inner rollers 224*a*, 226 contact the neck 16'.

When the turret-head assembly 200*a* of Stage 1 is in the compressed position of FIG. 3E-3F, the radial positions of the outer and inner rollers 224*a*, 226 slightly overlap. In one embodiment, the amount of overlap is about 1 mm to about 4 mm. Thus, when the turret-head assembly 200*a* is in the compressed position of FIGS. 3E-3F, the outer and inner rollers 224*a*, 226 sandwich the neck 16' therebetween so that a partial carrier ring 18*a* may be formed thereon. Contact between the inner roller 226 and the inner surface of the neck 16' while causing relative rotation between the article and the rolling assembly about an axis generally perpendicular to the open top end 11 causes the neck 16' to deform outward, under pressure caused by radially outward displacement of the inner roller 226, to a maximum displacement position to form an initial protrusion, or partial carrier ring 18*a*. Likewise, contact between the outer roller 224*a* and the outer surface of the neck 16' causes the neck 16' of the preform article 10' to deform inward, under pressure from the outer roller 224*a*, while the inner roller 226 bears against the inner surface at the partial carrier ring 18*a*.

In one non-limiting embodiment, the outer roller 224*a* pushes the neck 16' inward a distance 225*a* of about 0.5 mm to about 2 mm (about 0.02 inch to about 0.8 inch) beyond its initial position, and the inner roller 226 pushes the neck 16' outward a distance 225*b* about 3 mm (about 0.04 inch to about 0.12 inch) beyond its initial position (see FIG. 3G). In one non-limiting embodiment, the axial distance 225*c* (y1 of FIG. 12) between the centers of the inner and outer rollers 226, 224*a* is about 2 mm to about 8 mm (about 0.08 inch to about 0.31 inch).

In one embodiment, the turret-head assembly 200*a* generally spins rapidly about the turret-head assembly axis 203 relative to the article (which remains generally stationary within the pilot 250 via friction) such that the outer and inner rollers 224*a*, 226 travel along the neck 16' circumferentially. As such, the outer and inner rollers 224*a*, 226 roll against the neck 16' of the article 10'. As a result, the inner roller 226 urges a portion of the neck 16' outward to form a partial carrier ring 18*a* having an increased diameter, and the outer roller 224*a* urges a portion of neck 16' directly below the partial carrier ring 18*a* inward to form a partial groove 30*a* (see FIGS. 2B, 3E-3F). In some embodiments, the turret-head assembly 200*a* may spin at a speed of 2000 rpm or more. It is contemplated that, the article may spin rapidly relative to the turret-head assembly 200*a*, which may remain generally stationary.

After the partial carrier ring 18*a* has been formed and Stage 1 of the process has been completed, the inner roller 226 is retracted away from the inner surface of the neck 16*a*, such that the inner roller 226 disengages from the inner surface of the neck 16*a* returning to the original starting position of the process. The resulting article 10*a* is then retracted away from the turret-head assembly 200*a*.

Accordingly, the spring 230 decompresses, and engagement of the outer and inner cam followers 240*a*, 242 with the respective outer and inner cams 244*a*, 246 causes the outer roller arm 220*a* to move radially outward and the inner roller arm 222 to move radially inward into the uncompressed position of FIG. 3D. The compression springs 214 positioned on the spring guides 212 (or other suitable mechanism) further urge the rolling assembly downward in the direction of Arrow B. As a result, the outer roller 224*a* and inner roller 226 break contact with the neck 16*a* of the article 10*a* and provide a clearance for removing the article 10*a* from the turret-head assembly 200*a*.

Figure 3H:
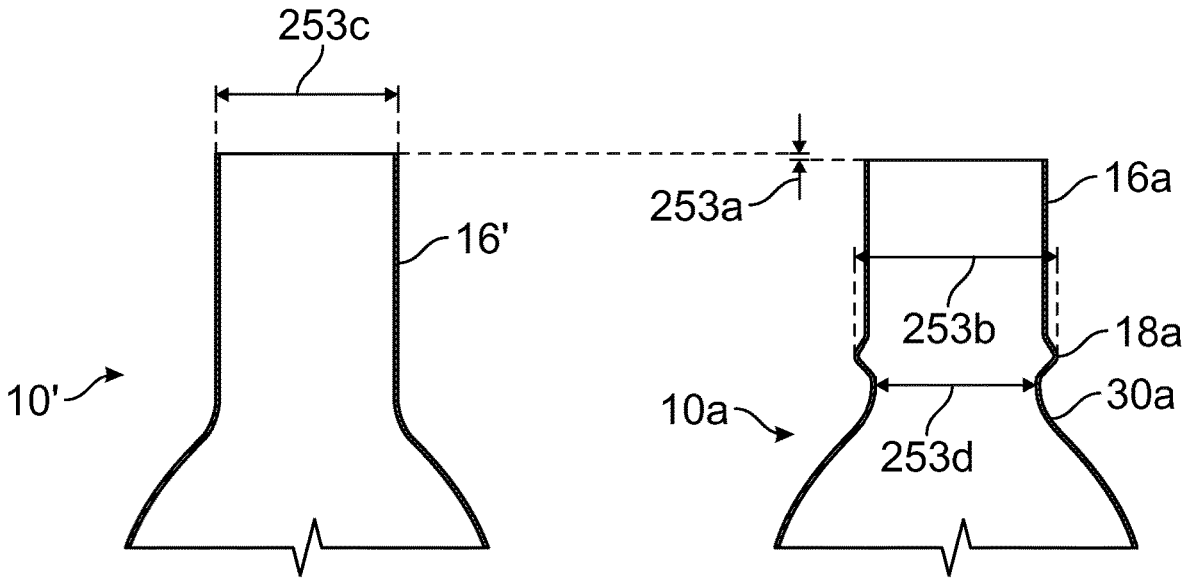
FIG. 3H illustrates a comparison of the neck of the article of FIGS. 3A-3G prior to and subsequent to the forming stage of FIGS. 3A-3G, according to one embodiment.
Figure 3I:
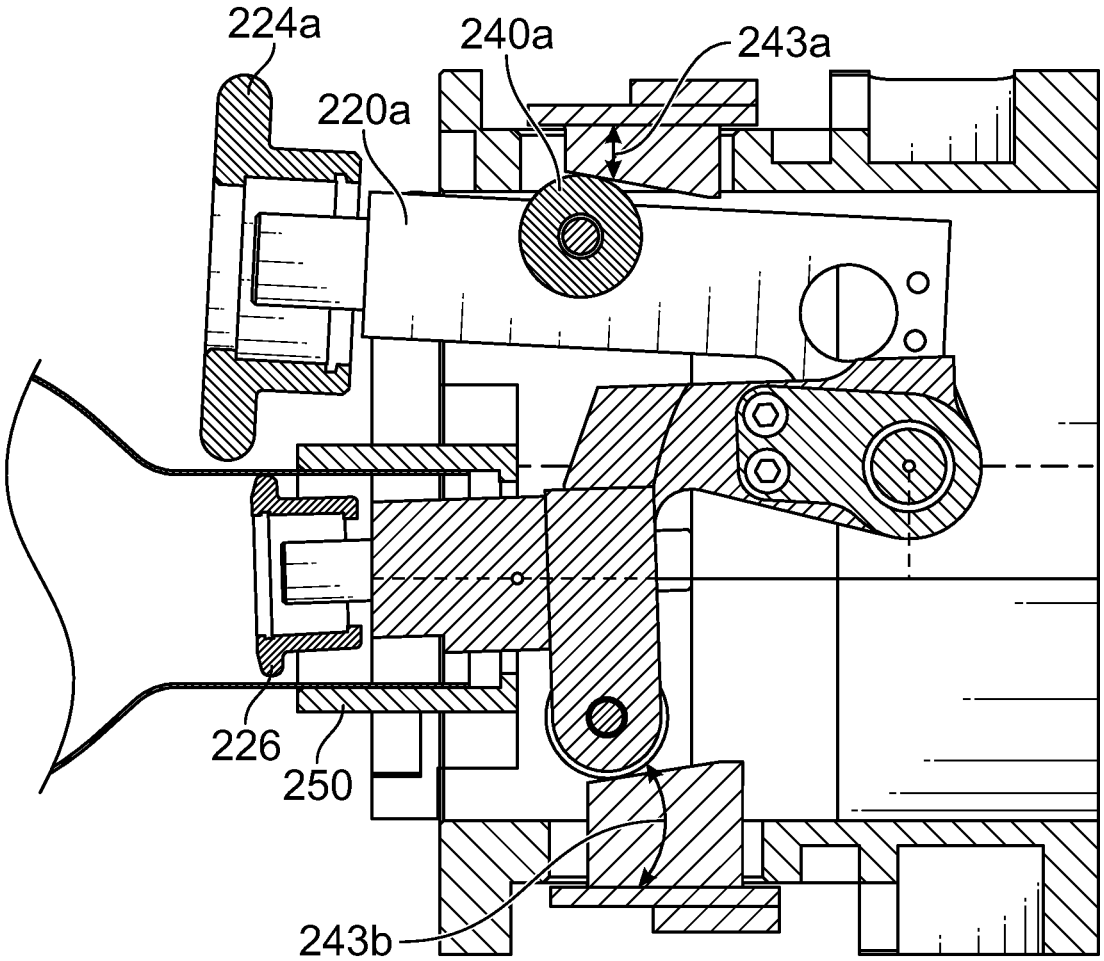
FIG. 3I illustrates a cross-sectional side view detailing the rolling assembly of FIGS. 3A-3H.

FIG. 3H compares dimensions of the article 10' prior to Stage 1 with the article 10*a* subsequent to Stage 1 of the forming process described herein, according to one embodiment. As shown in FIG. 3H, the reduction in height 253*a* of the neck 16 is about 0.5 mm to about 3.0 mm (about 0.05 inch to about 0.06 inch) due to the displacement of material while the axial top load is applied. The diameter 253*b* of the partial carrier ring 18*a* formed during Stage 1 may be about 10% to about 15% larger than the initial neck diameter 253*c*. The reduced neck diameter 253*d* of the partial groove 30*a* may be about 3% to about 10% smaller than the original neck diameter 253*c* (e.g., about 28.19 mm (about 1.1 inches), decreased to about 26.41 mm (about 1.04 inches)).

According to one embodiment, the axial/process load for the forming and rolling assembly resistance of Stage 1 is about 100 pounds to about 200 pounds, or 130 pounds to about 160 pounds. According to one embodiment, the load required to activate the rolling assembly (rotating) without forming is about 25-75 pounds. Since there is no guide on the front of the illustrated turret-head assembly 200*a*, the article receives most of the axial load that is applied. Resistance of the material movement (both inward and outward) creates higher process loads. This load may vary as material properties, material thickness, diameters, and the like change in other applications.

Figure 3J:
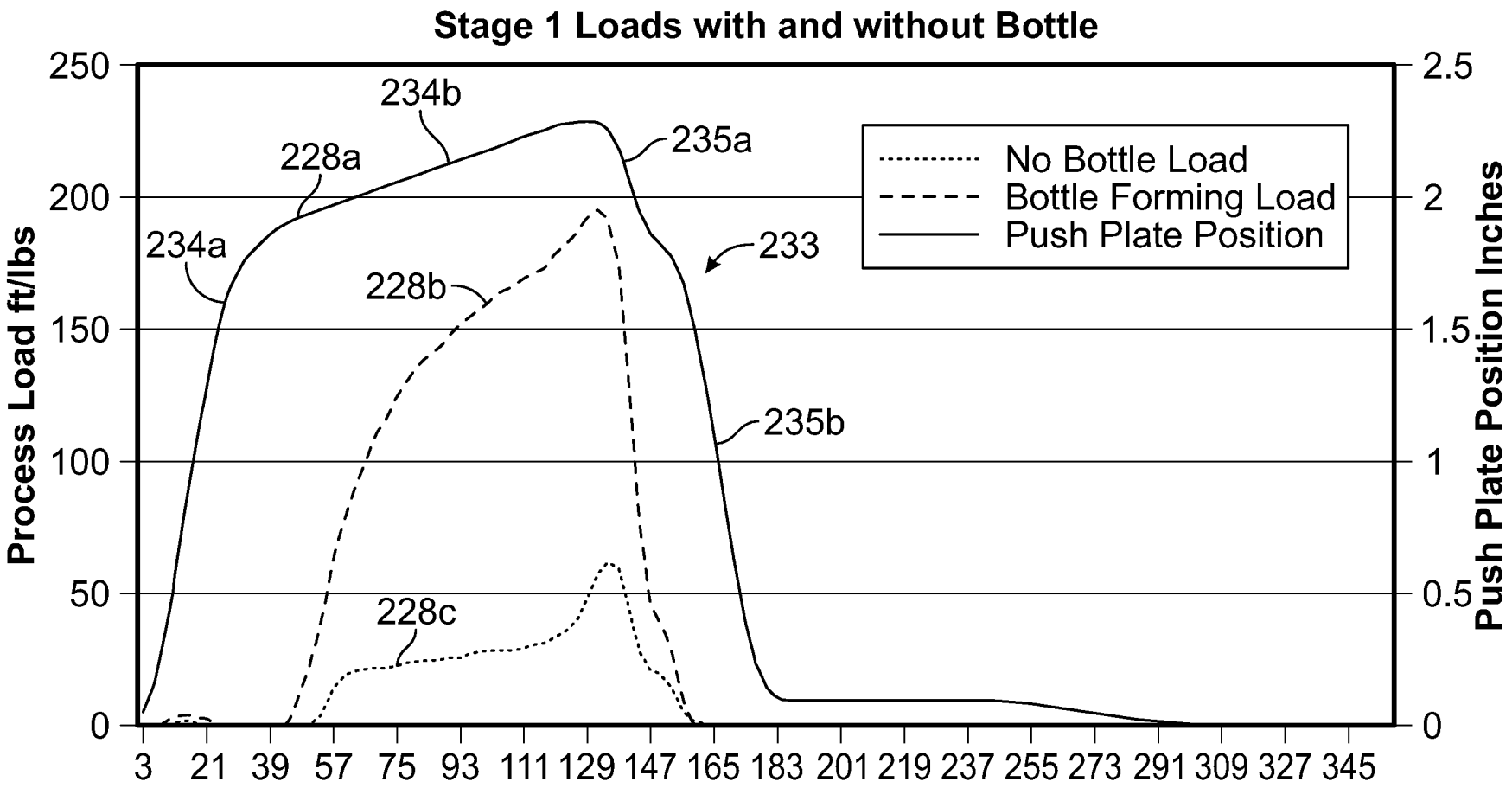
FIG. 3J illustrates a graph comparing the position of a push plate (cam profile) activating an article and the loads applied to the article according to one embodiment.

Referring now to FIG. 3J, a graph comparing the position of the push activating the article toward the turret-head assembly 200*a* and the loads applied to the article during Stage 1 are shown, according to one embodiment. The line 228*a* represents the position of the push plate, which corresponds with the cam profile along which the cam follower of the push plate travels. The line 228*b* represents the bottle forming load at each push plate position. The line 228*c* illustrates the static load measurements (no bottle present), where the rolling assembly is generally stationary/does not rotate. The loads associated with the line 228*c* generally result from, e.g., the spring compression and resistance of the turret-head assembly 200*a*.

In accordance with the embodiment shown in FIG. 3J (and, likewise, FIGS. 4L and 5G), a working portion 233 of the cam profile 228*a* generally does not include any dwells, or "flat" portions. Put another way, the working portion 228*a* of the cam profile of the illustrated embodiments is sloped along the entire profile to foster continuous axial movement of the article (either toward or away from the forming tool) and to keep the material in motion during forming, which may assist in minimizing splitting and fracturing. Accordingly, by eliminating any dwell in the cam profile-especially in article-activated embodiments, such as those illustrated in FIGS. 3-6, in which the load applied to the article is generally higher-upon the desired forming being achieved, such as when the rollers reach the desired maximum radial displacement, contact with the rollers ceases and the article is retracted/removed from the forming tool. For example, it is contemplated that the rollers disengage from the article within about 20 degrees of revolution, or even 10 degrees of revolution, or even 1 degree of revolution of the rollers relative to the article, or even immediately, once the desired maximum radial displacement of the rollers is achieved to avoid there being a dwell. It is contemplated, however, that a dwell may be included in the cam profiles of the embodiments described herein. In cither embodiment, e.g., either with a dwell or without a dwell, it is contemplated that the desired maximum radial displacement of the rollers can be achieved within about 2 to 5 revolutions of the rollers relative to the article.

As shown in FIG. 3J, the exemplary cam profile 228*a* includes a first rising portion 234*a*, a second rising portion 234*b*, a first retracting portion 235*a*, and a second retracting portion 235*b*. During the first rising portion 234*a*, the article and the rolling assembly are brought together, i.e., the distance between them is reduced. The forming of the carrier ring takes place during the second rising portion 234*b*. The forming is generally completed at the end of the second rising portion 234*b*. During the first retracting portion 235*a*, the velocity and acceleration of the motion are matched to the capabilities and limits of the turret-head assembly 200*a* as the article is retracted from but remains in contact with the turret-head assembly 200*a*. During the second retracting portion 235*b*, the push pad is retracted such that the article may be safely transferred to another starwheel. Although the cam profile has been described with respect to the push plate cam of Stage 1, it is contemplated that a similar cam profile may be used for any of the cams being used to actuate the rolling assemblies described herein.

Figure 4A:
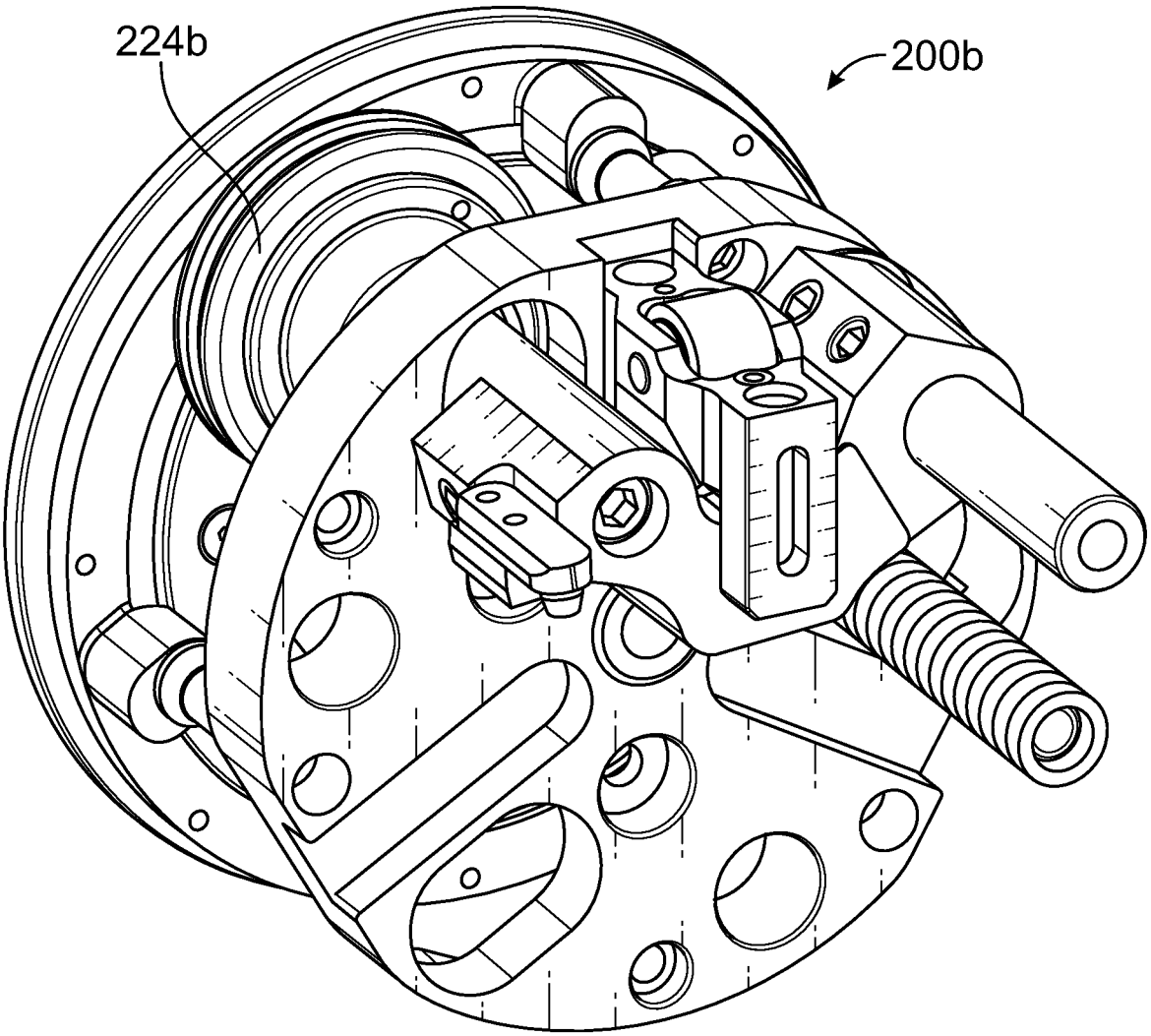
FIG. 4A illustrates a perspective top view of a portion of a turret-head assembly used in another stage of a carrier ring-forming process described herein, according to one embodiment.
Figure 4B:
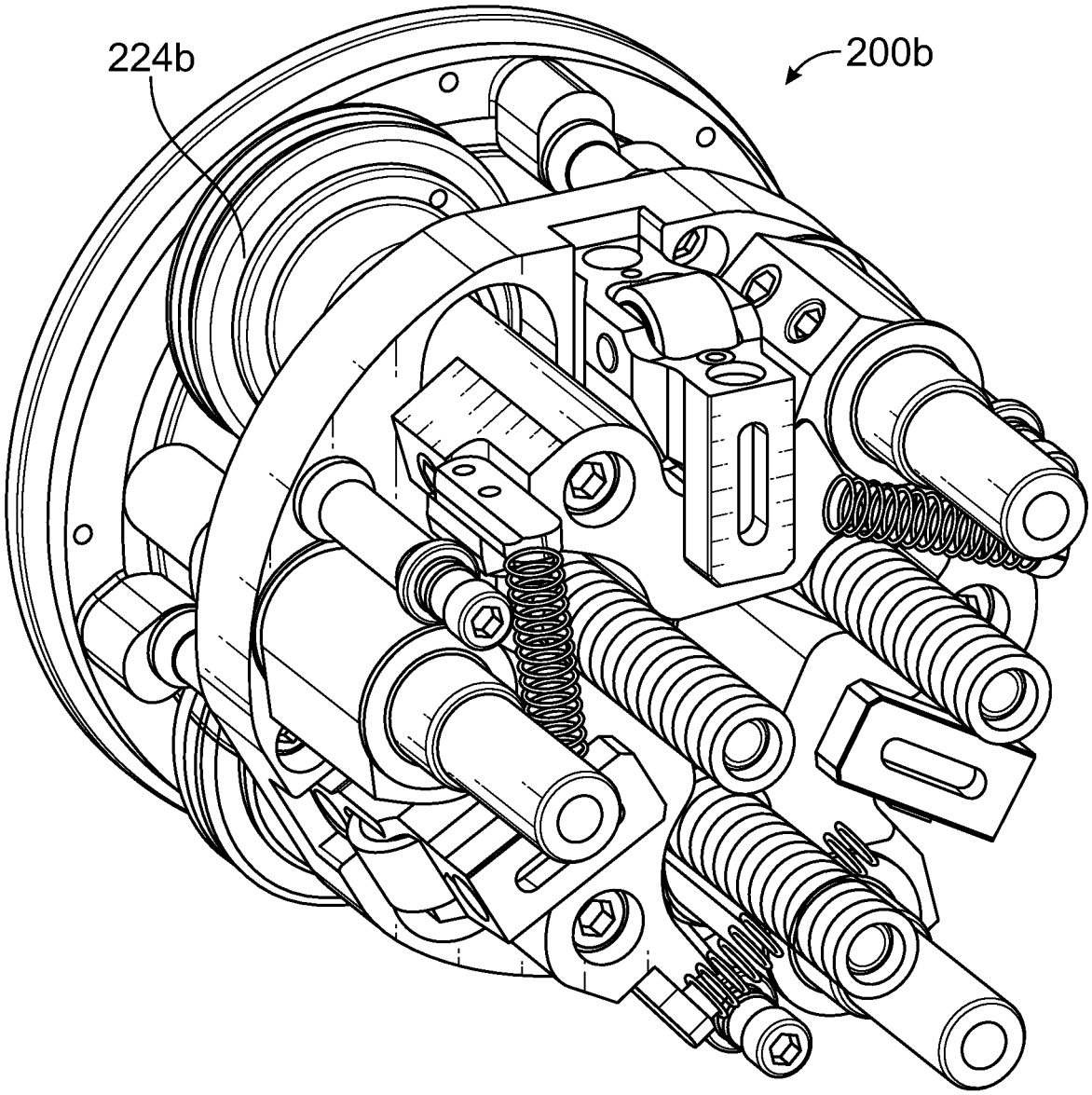
FIG. 4B illustrates a perspective top view of the turret-head assembly of FIG. 4A showing additional components coupled thereto.
Figure 4C:
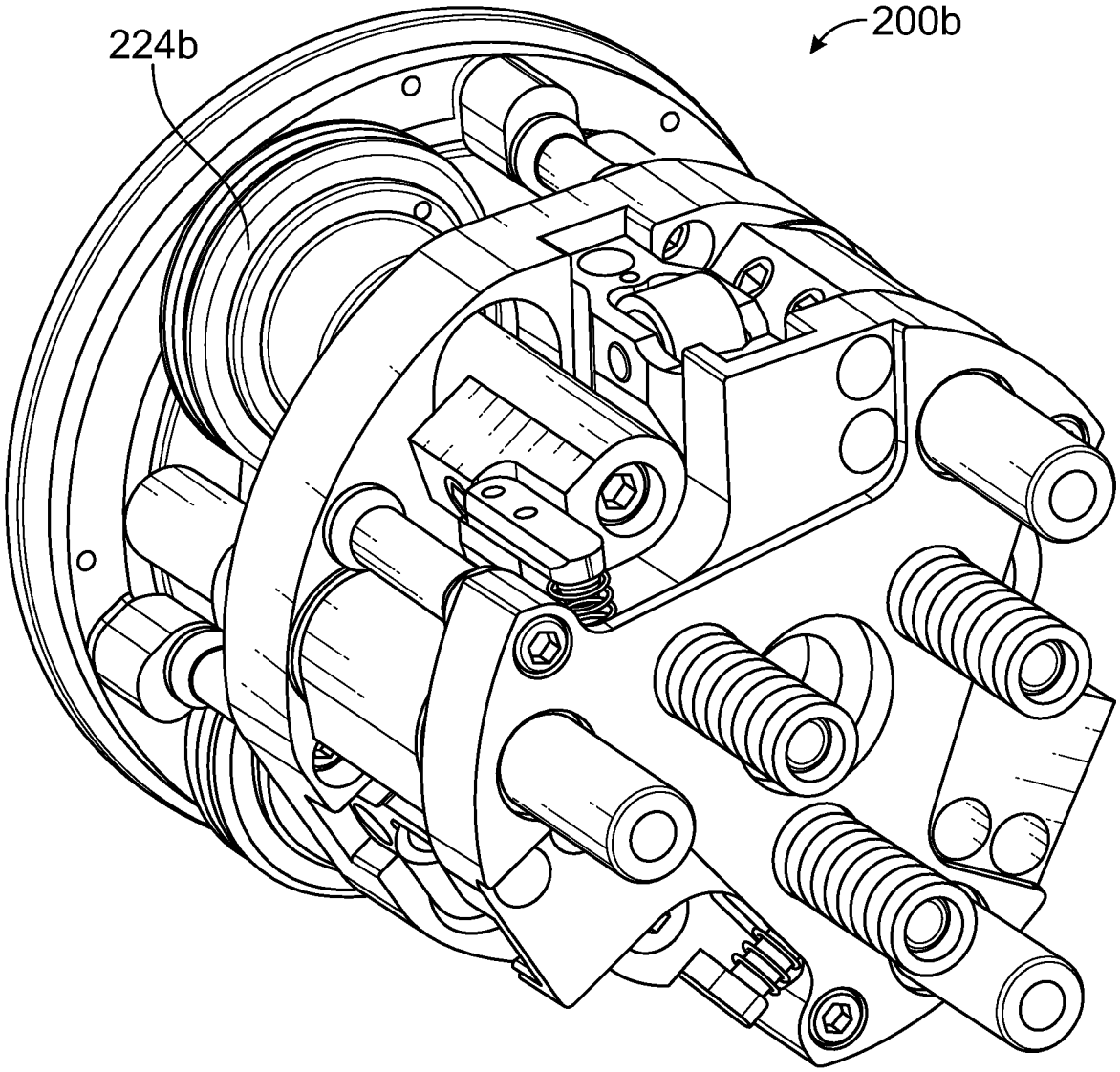
FIG. 4C illustrates a perspective top view of the turret-head assembly of FIGS. 4A-4B showing additional components coupled thereto.
Figure 4D:
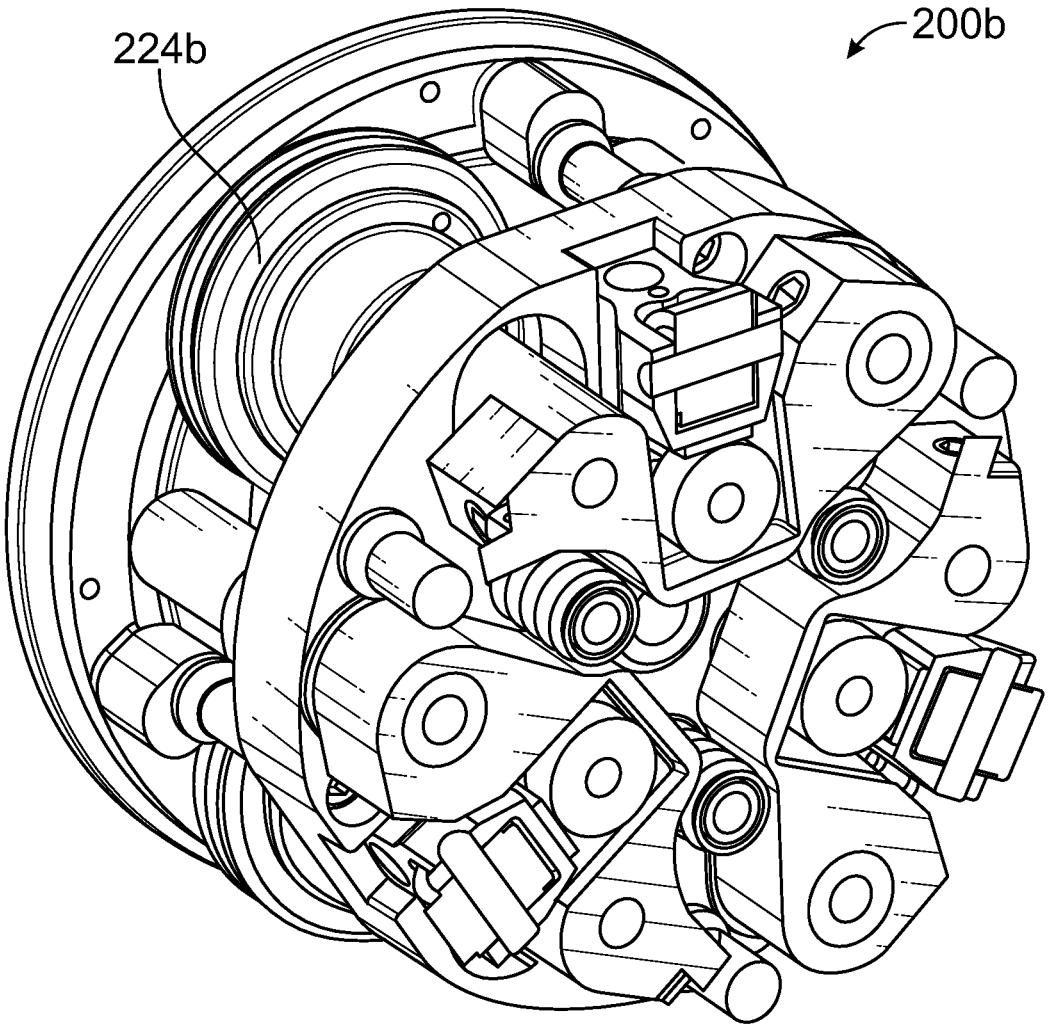
FIG. 4D illustrates a top perspective view of the turret-head assembly of FIGS. 4A-4C showing additional components coupled thereto.
Figure 4E:
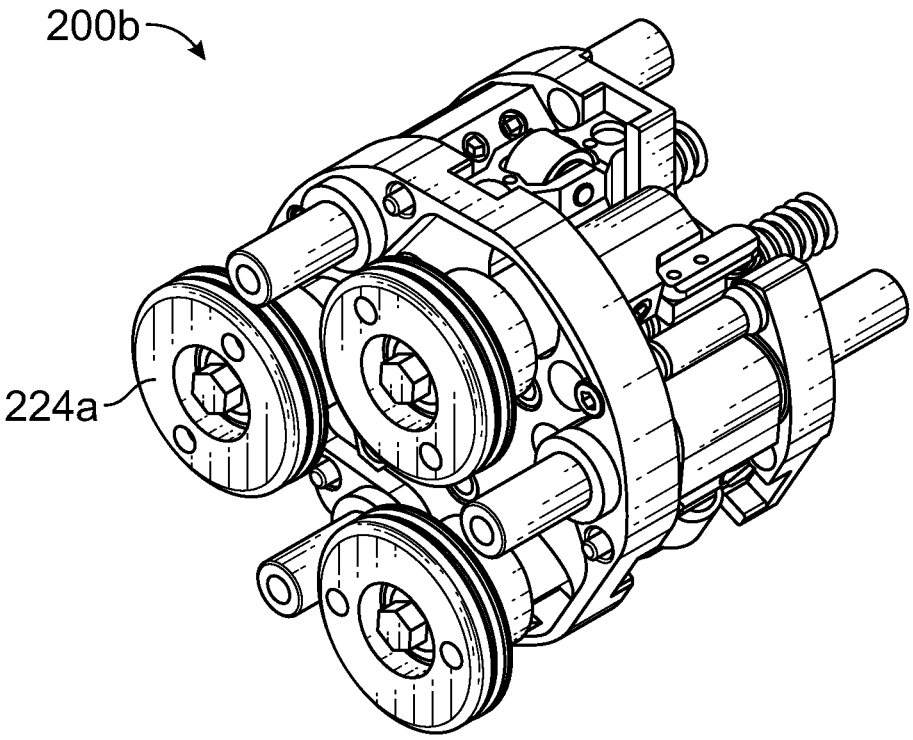
FIG. 4E illustrates a perspective bottom view of the turret-head assembly shown in FIGS. 4A-4D.
Figure 4F:
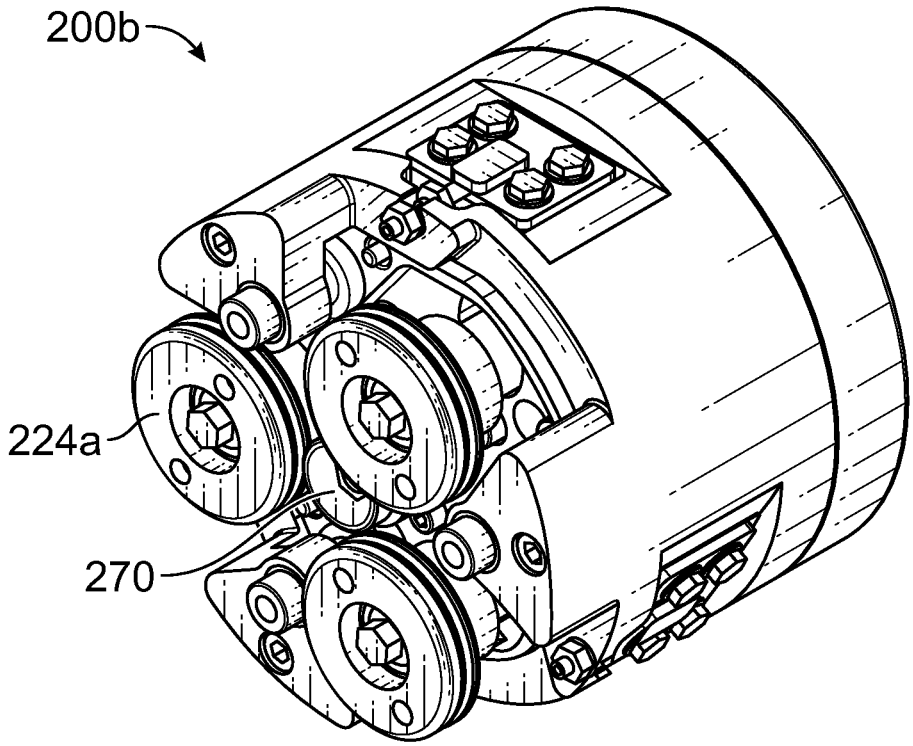
FIG. 4F illustrates a perspective bottom view of the turret-head assembly of FIG. 4E having a housing mounted thereto.
Figure 4G:
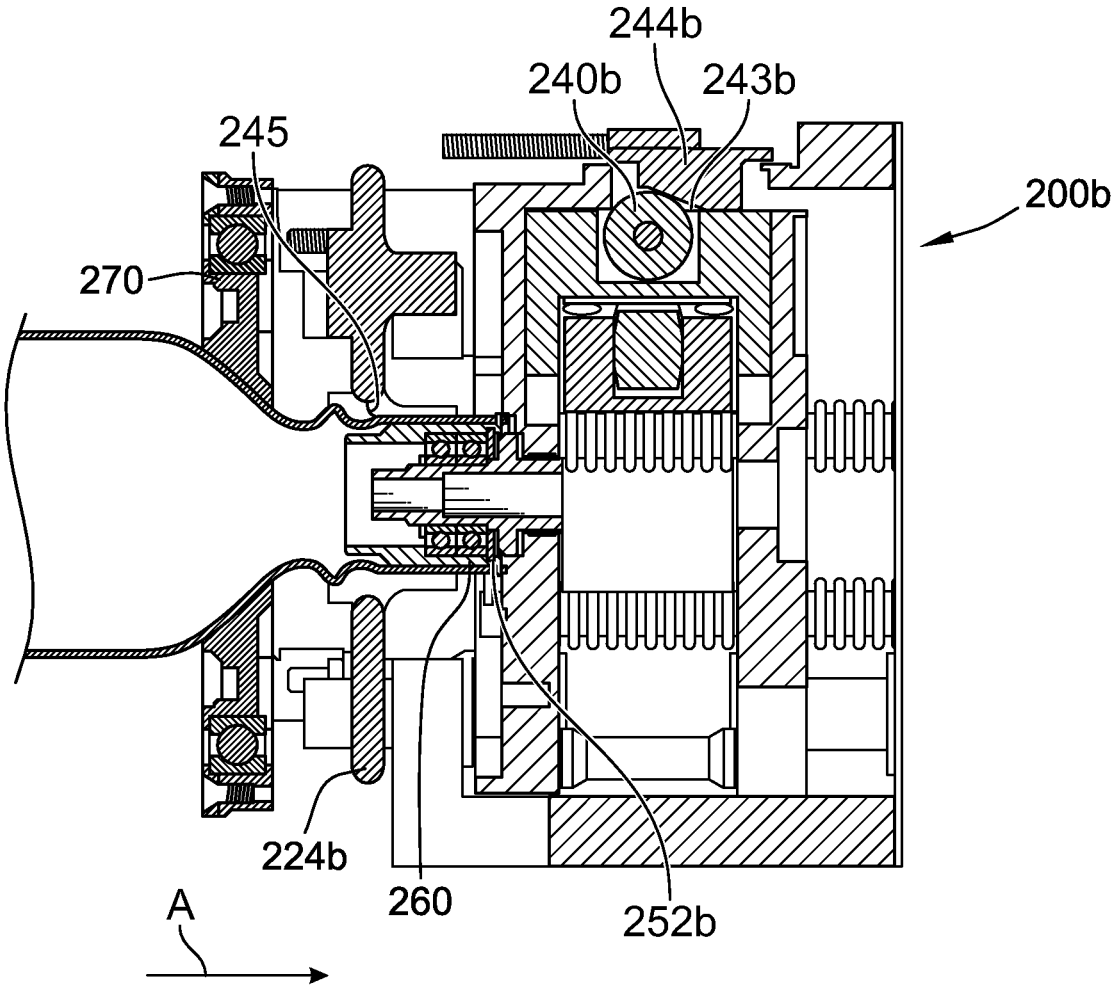
FIG. 4G illustrates a cross-sectional view of the turret-head assembly of FIGS. 4A-4F in an uncompressed position.

Once Stage 1 is completed, the resulting article 10*a* (see FIG. 2B) may be passed onto subsequent stages of the carrier ring-forming process. For example, FIGS. 4A-4J illustrate Stage 2 of the carrier ring-forming process, FIGS. 5A-5E illustrate Stage 3 of the carrier ring-forming process, and FIGS. 6A-6C illustrate Stage 4 of the carrier ring-forming process, according to one embodiment. It is contemplated, however, that more or less stages or steps may be used to form the desired carrier ring.

In the illustrated embodiments, the turret-head assemblies 200*b*-200*d* of the subsequent carrier ring-forming steps operate in a manner similar to that described above with respect to Stage 1. Differences include, e.g., the number of inner and/or outer rollers (and, accordingly, the number of respective inner and outer roller arms), the manner in which the turret-head assembly is actuated, combinations thereof, or the like.

For example, in the illustrated embodiments shown in FIGS. 4A-7 and 9A-9B, the turret-head assemblies 200*b*-200*d*, 1200' of Stages 2-4 of the carrier ring-forming process include three outer rollers 224*b*, 224*c*, 224*d* spaced approximately 120-degrees apart. It is contemplated, however, that any suitable number of outer rollers 224 may be included in the turret-head assemblies 200*b*-200*d*, 1200'. Moreover, in the illustrated embodiments of FIGS. 4A-7 and 9A-9B, Stages 2-4 eliminate the inner roller of Stage 1. It is contemplated, however, that an inner roller may be included in any or all of Stages 2-4. The differences between the turret-head assemblies 200*b*-200*d*, 1200' of Stages 2-4 relative to that of Stage 1 are detailed further below.

Furthermore, in the illustrated embodiments, each of the turret-head assemblies 200*b-d*, 1200' of the subsequent Stages 2-4 includes an optional front guide 270 (see FIG. 4I) mounted concentrically with the turret-head assembly and including a generally central opening 272 through which a pilot 260 may be accessed. The front guide 270 may include a profile having a generally receding diameter and having a shape that generally corresponds with that of the shoulder 15 of the article 10. Thus, the front guide 270 is configured to receive the shoulder 15 of the article 10 formed during the preceding step when the article 10 is inserted into the turret-head assembly 200.

The front guide 270 may be formed of a non-marring material that is generally soft and smooth enough to generally protect against scratching the article 10 or decorations/designs thereon. Non-limiting examples of suitable materials include, but are not limited to, plastic resins (e.g., DELRIN® (DuPont Polymers, Inc., Wilmington, Delaware)) or any other suitable material or combinations thereof.

Figure 4H:
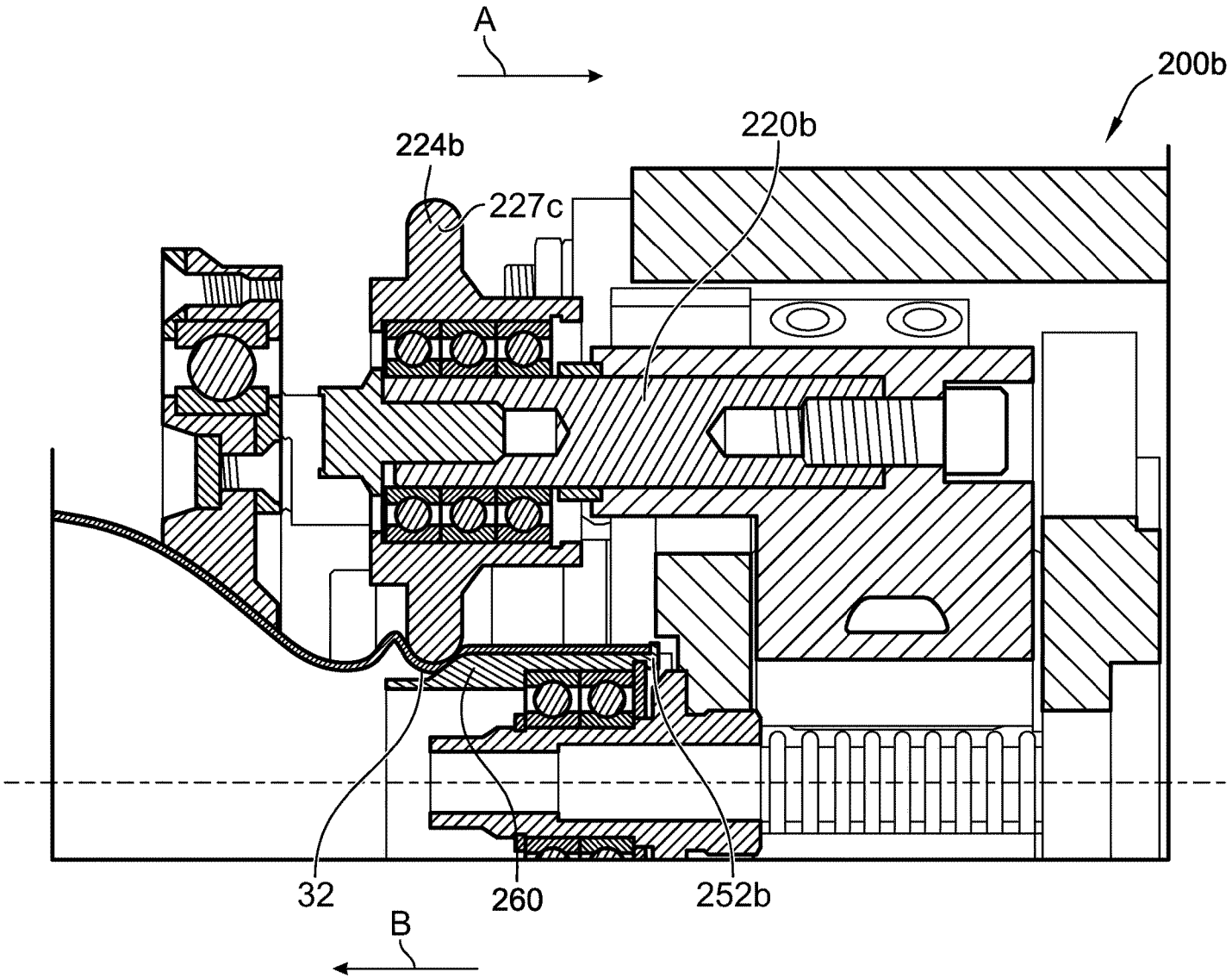
FIG. 4H illustrates a cross-sectional view of the turret-head assembly of FIGS. 4A-4G in a compressed position.
Figure 4I:
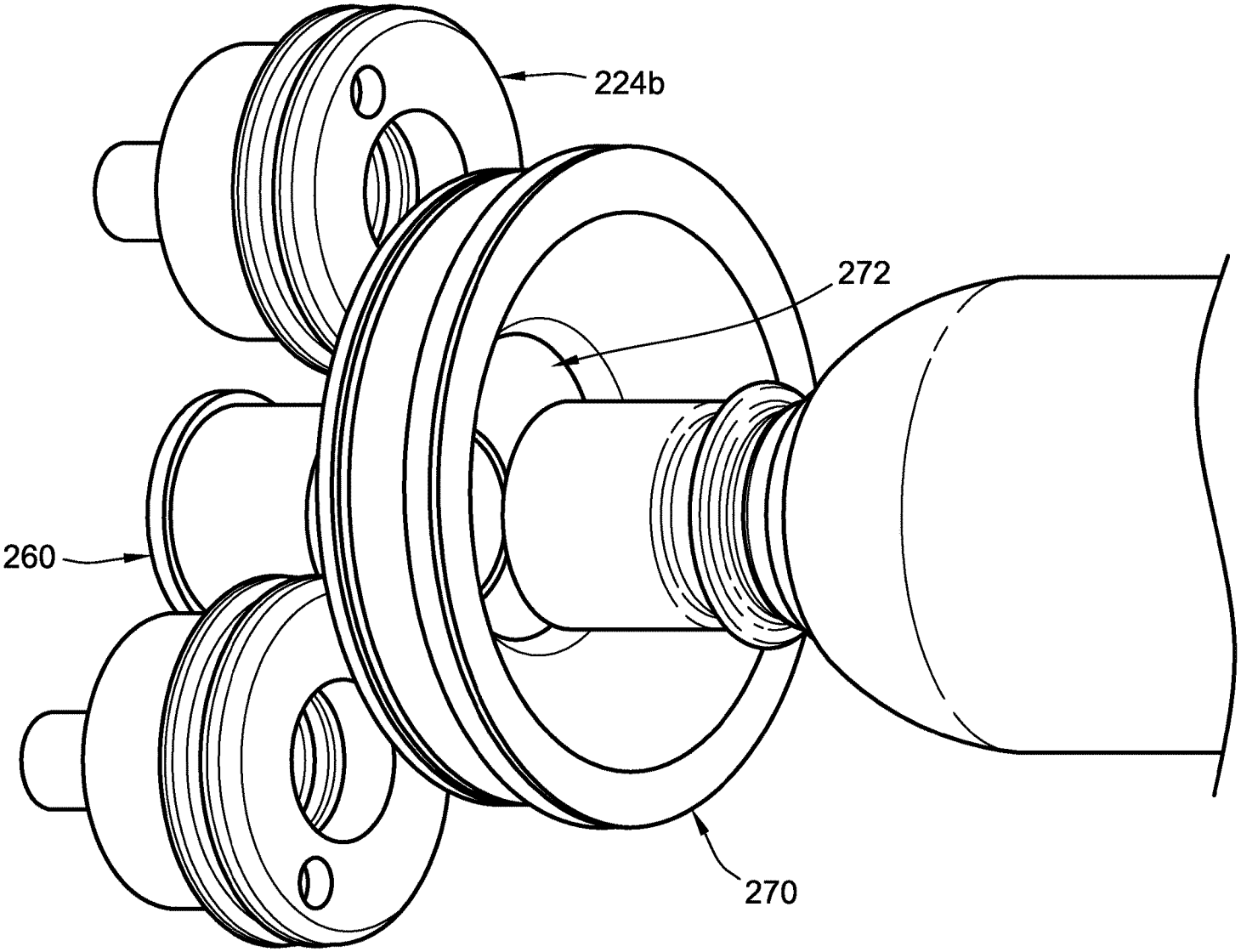
FIG. 4I illustrates a perspective bottom view of outer rollers of the turret-head assembly of FIGS. 4A-4H, according to one embodiment.
Figure 4J:
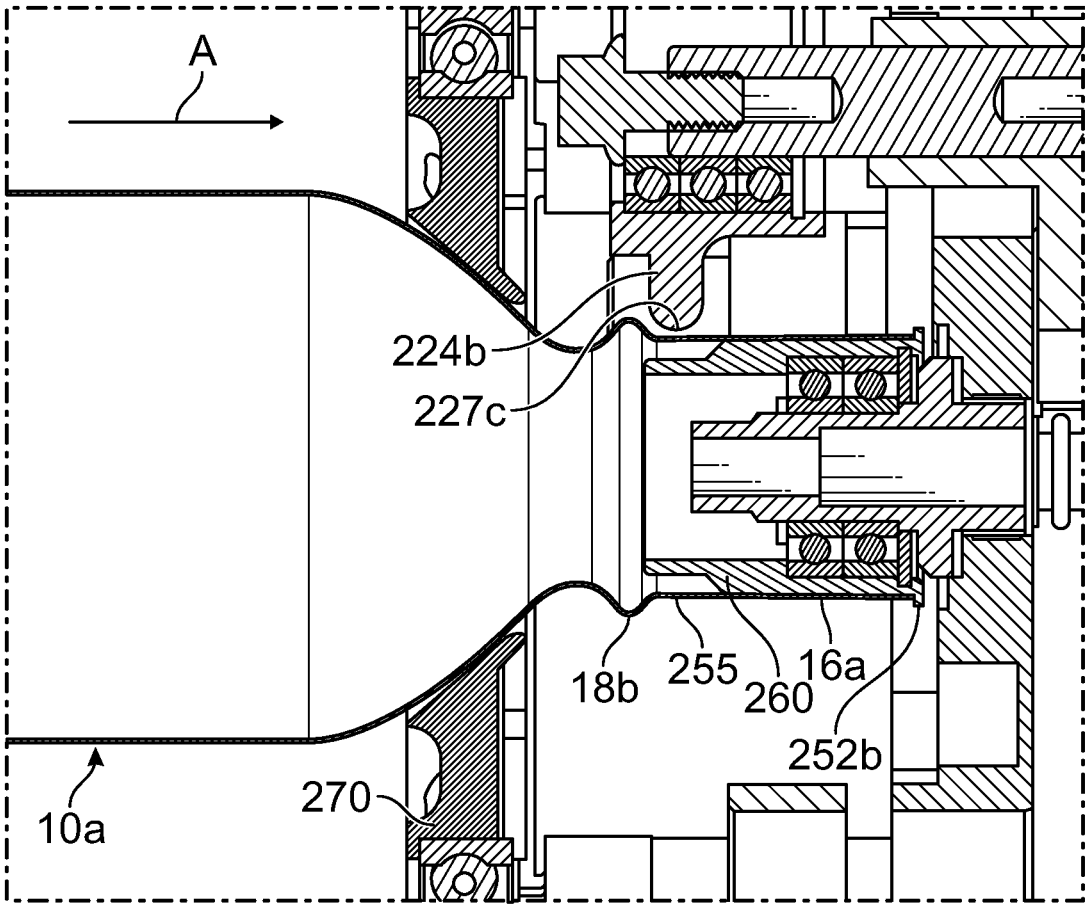
FIG. 4J illustrates a close-up schematic side view of the outer rollers of the turret-head assembly of FIGS. 4A-4I in an uncompressed position, prior to contacting a neck of an article.
Figure 5A:
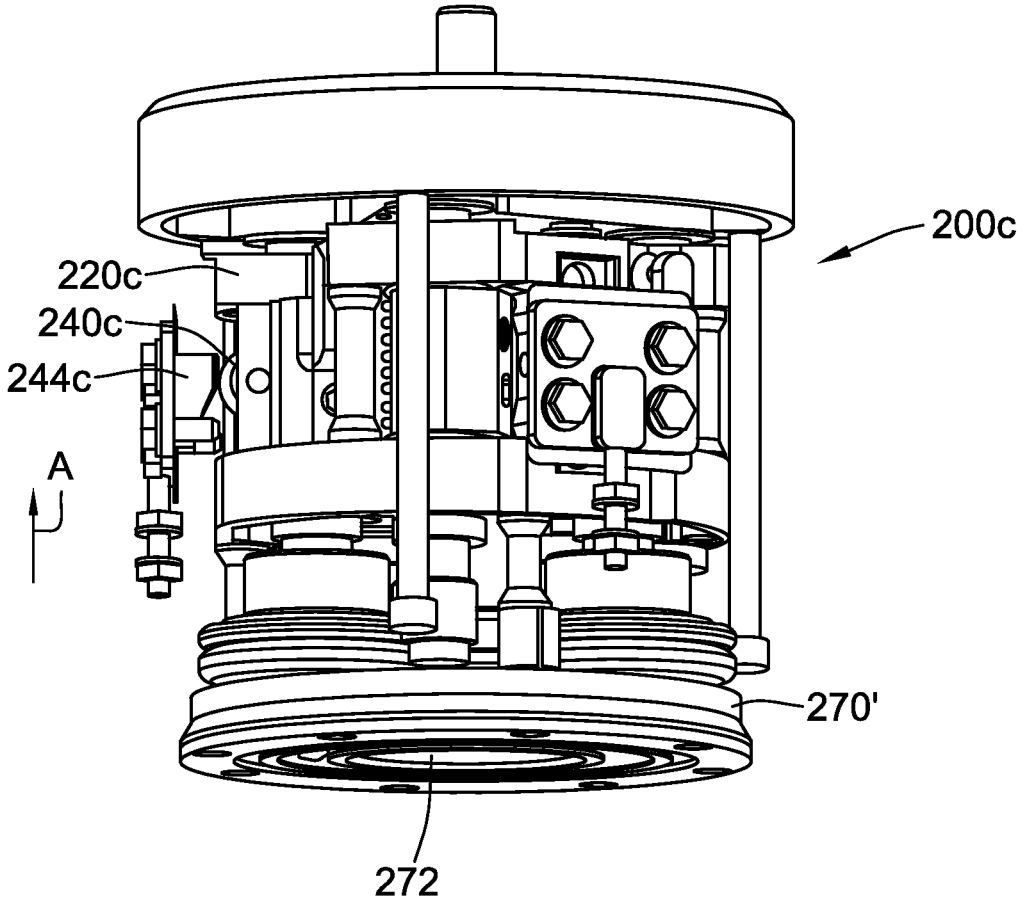
FIG. 5A illustrates a perspective bottom view of a turret-head assembly used in another stage of a carrier ring-forming process described herein, according to one embodiment.
Figure 5B:
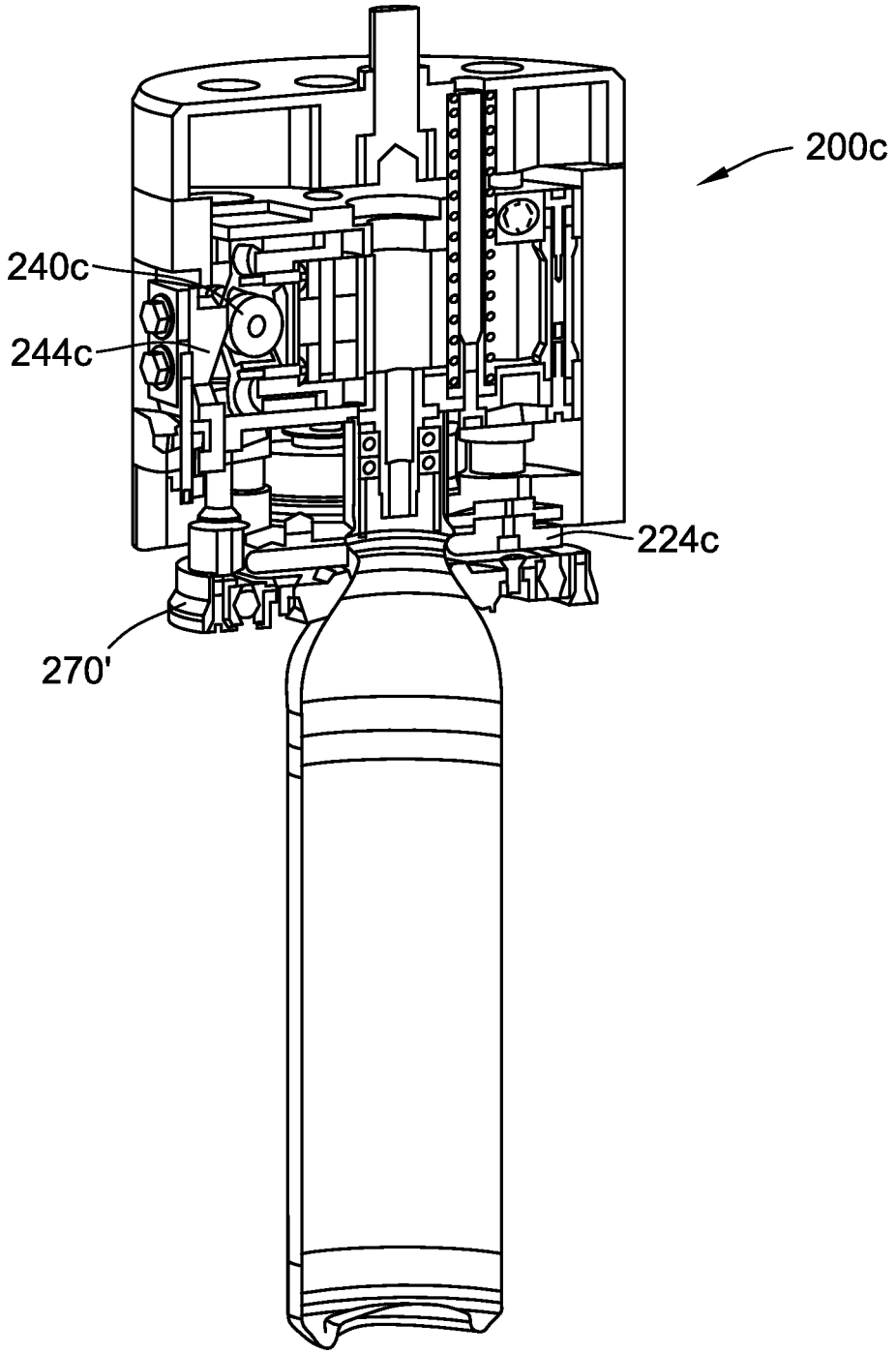
FIG. 5B illustrates a cross-sectional side view of the turret-head assembly of FIG. 5A engaged with an article.
Figure 5C:
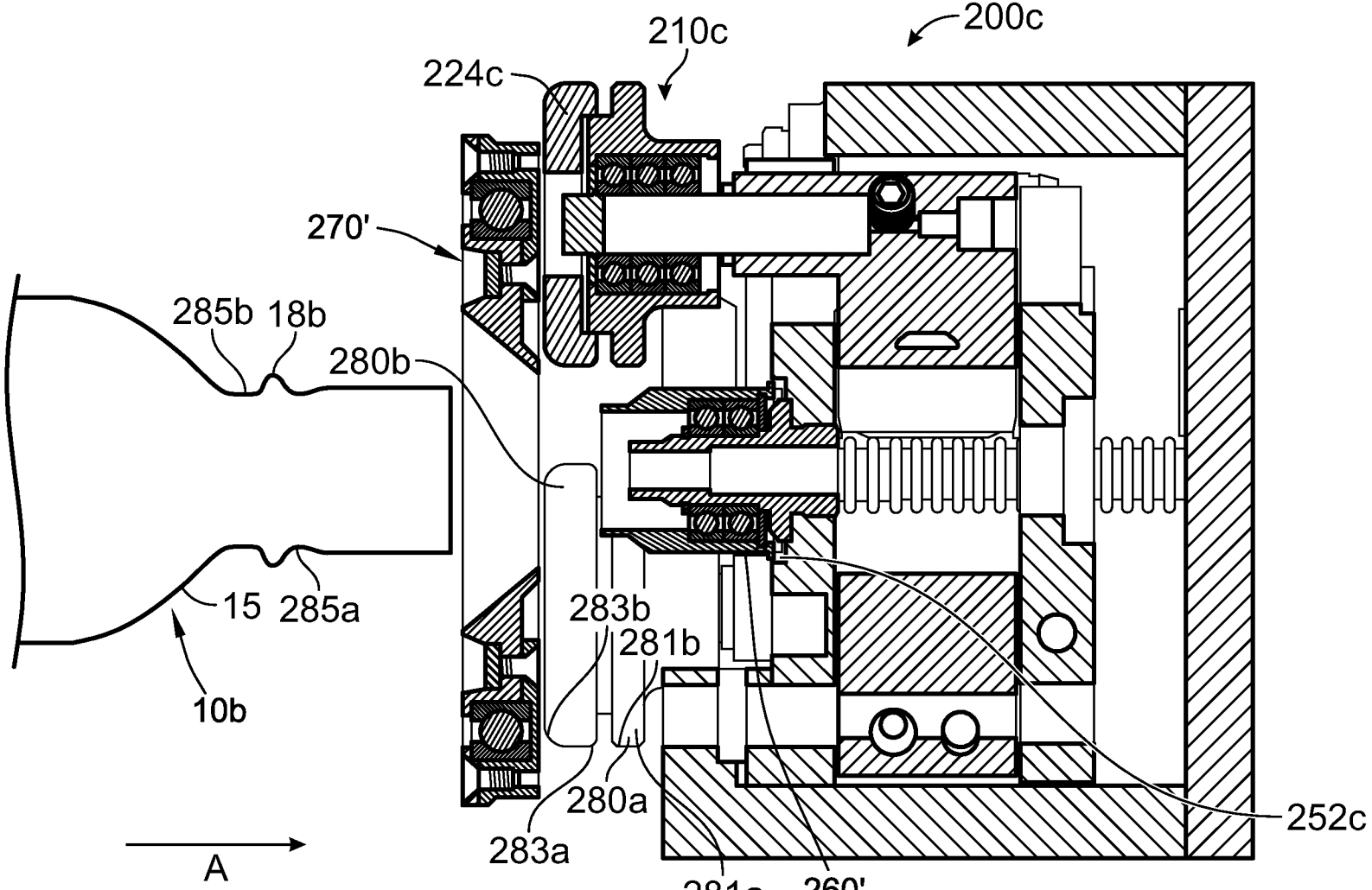
FIG. 5C illustrates a cross-sectional side view of the turret-head assembly of FIGS. 5A and 5B in an uncompressed position, prior to contacting a neck of an article.
Figure 5D:
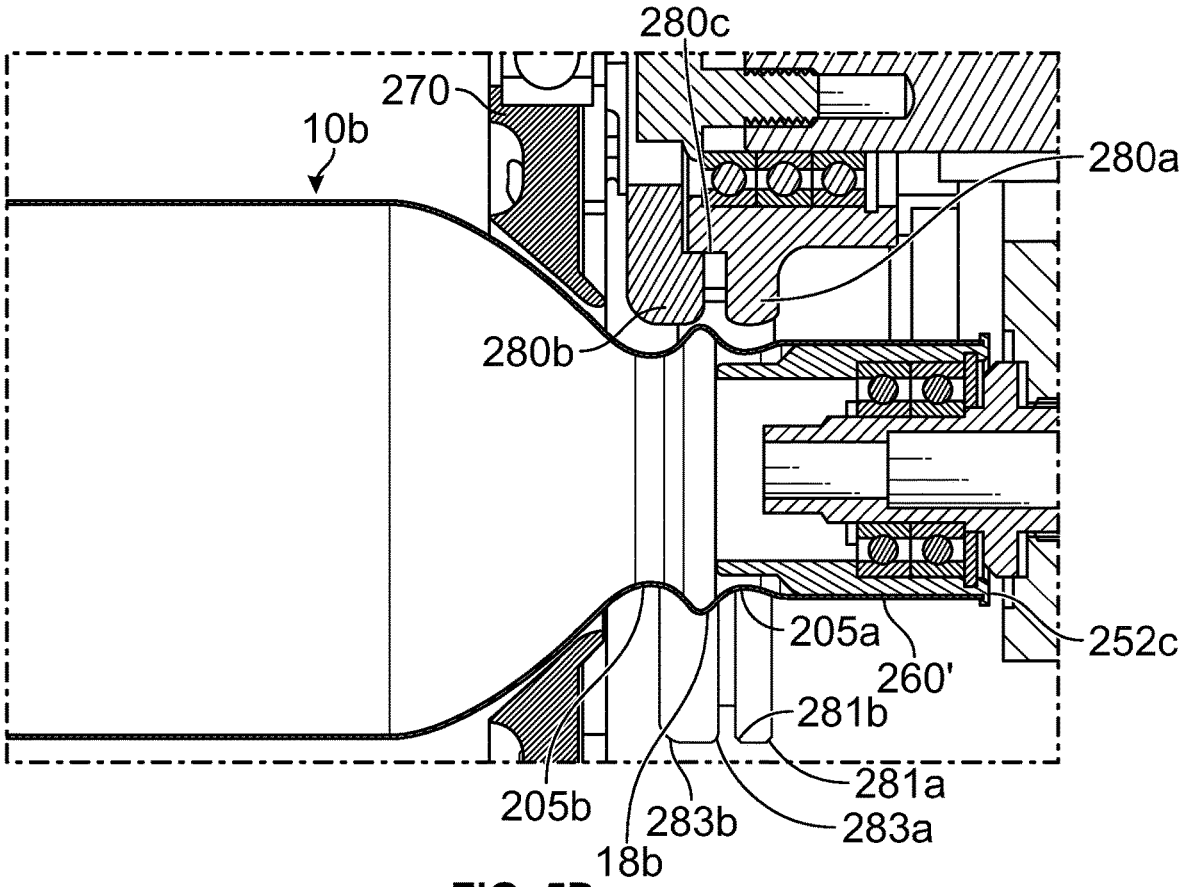
FIG. 5D illustrates a close-up cross-sectional side view of outer rollers of the turret-head assembly of FIGS. 5A-5C in an uncompressed position, prior to contacting a neck of an article.
Figure 5E:
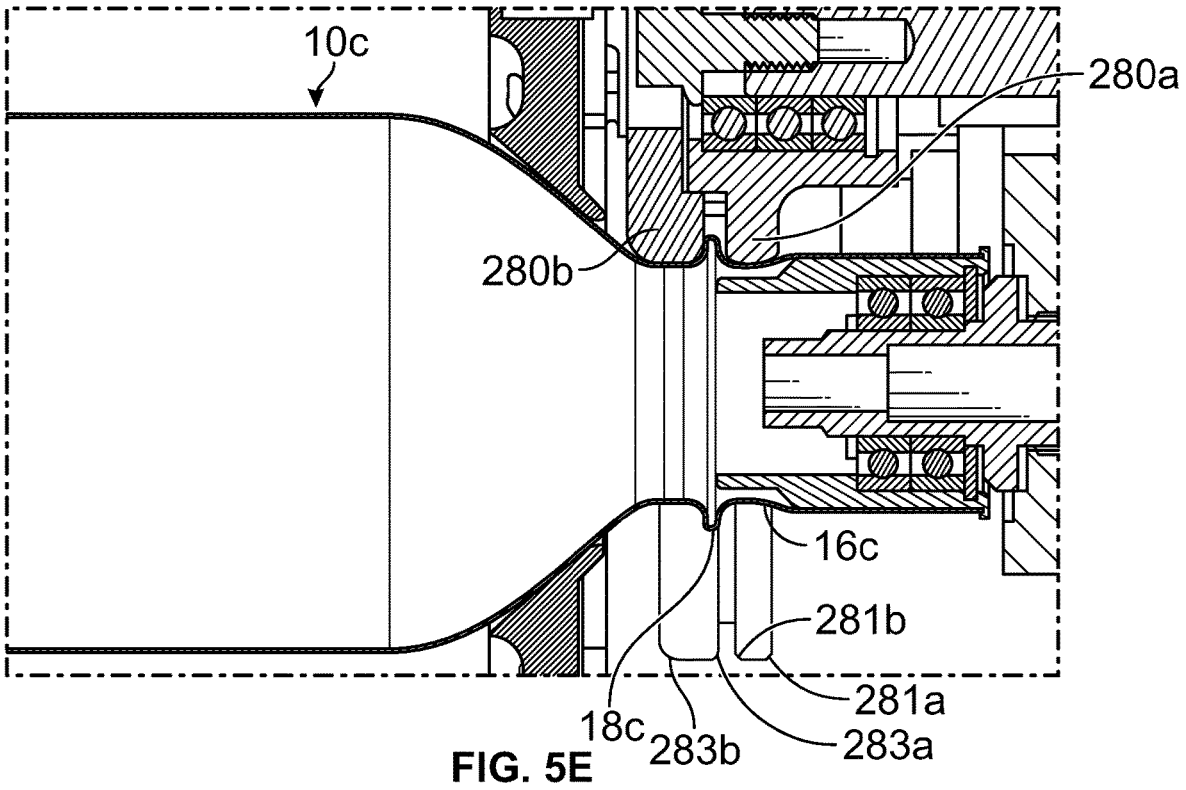
FIG. 5E illustrates a close-up cross-sectional side view of outer rollers of the turret-head assembly of FIGS. 5A-5D in a compressed position, while contacting the neck of the article.
Figure 6A:
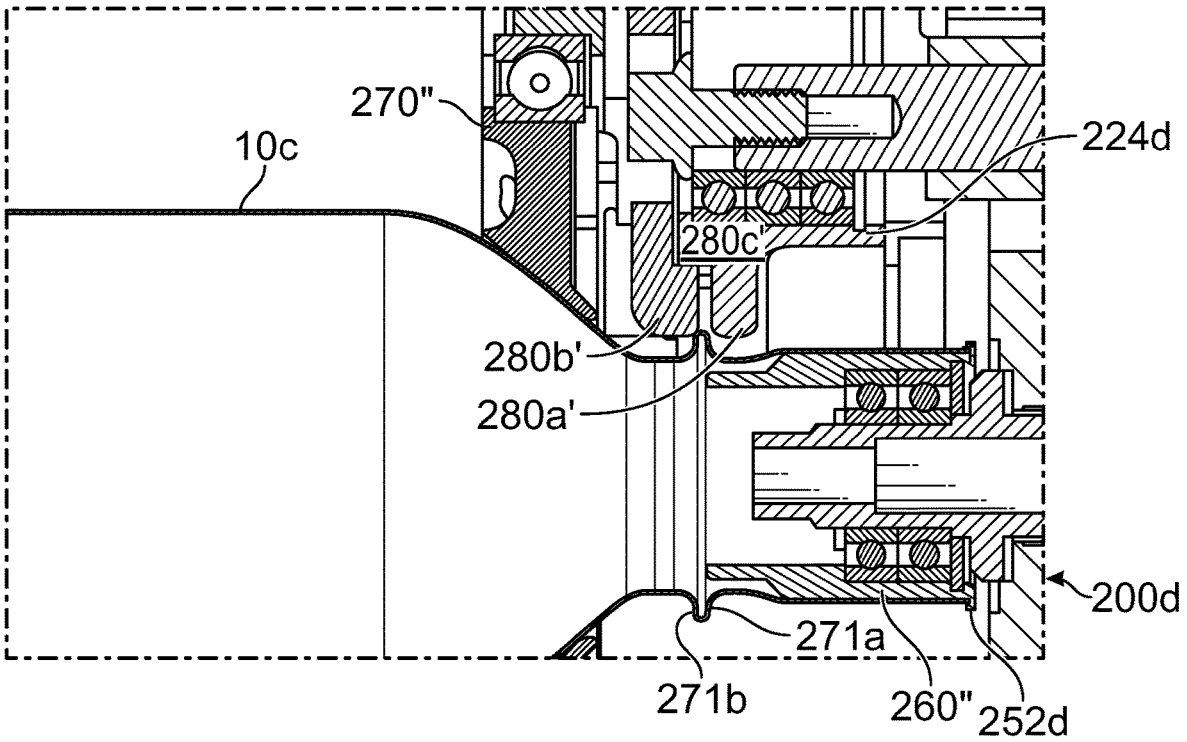
FIG. 6A illustrates a close-up cross-sectional side view of rollers of a turret-head assembly used in another step of a carrier ring-forming process described herein, according to one embodiment, prior to contacting a neck of an article.
Figure 6B:
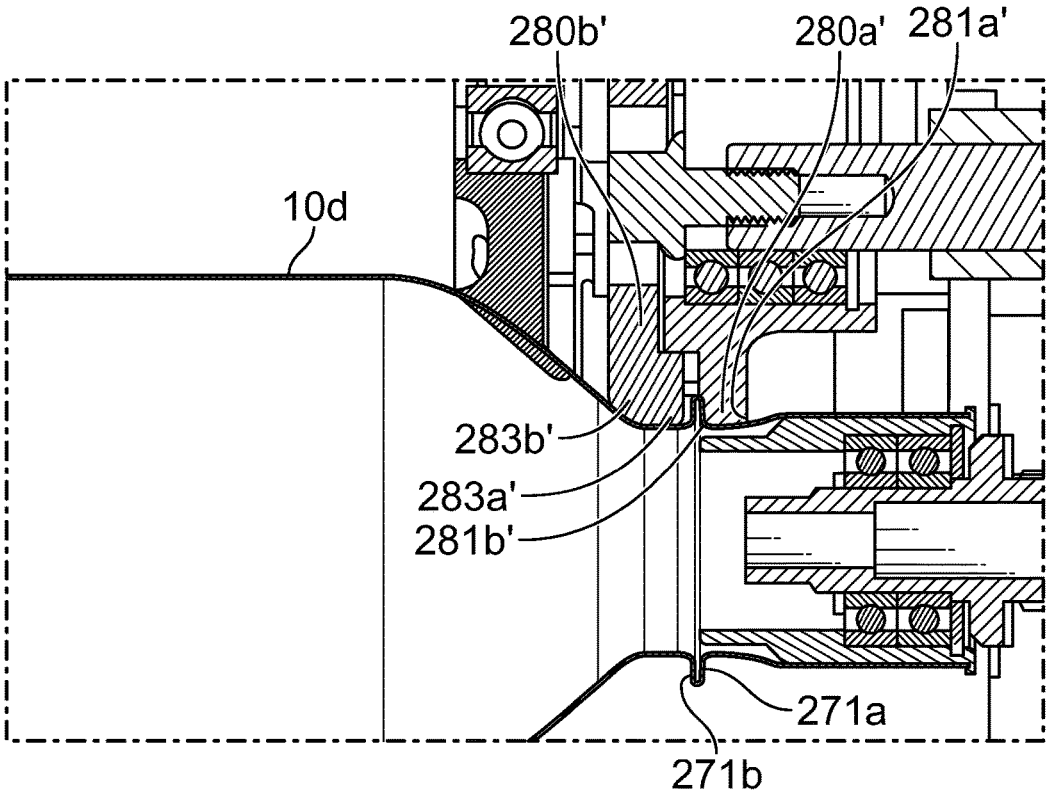
FIG. 6B illustrates a close-up cross-sectional side view of rollers of the turret-head assembly of FIG. 6A in a compressed position, while contacting a neck of an article.
Figure 6C:
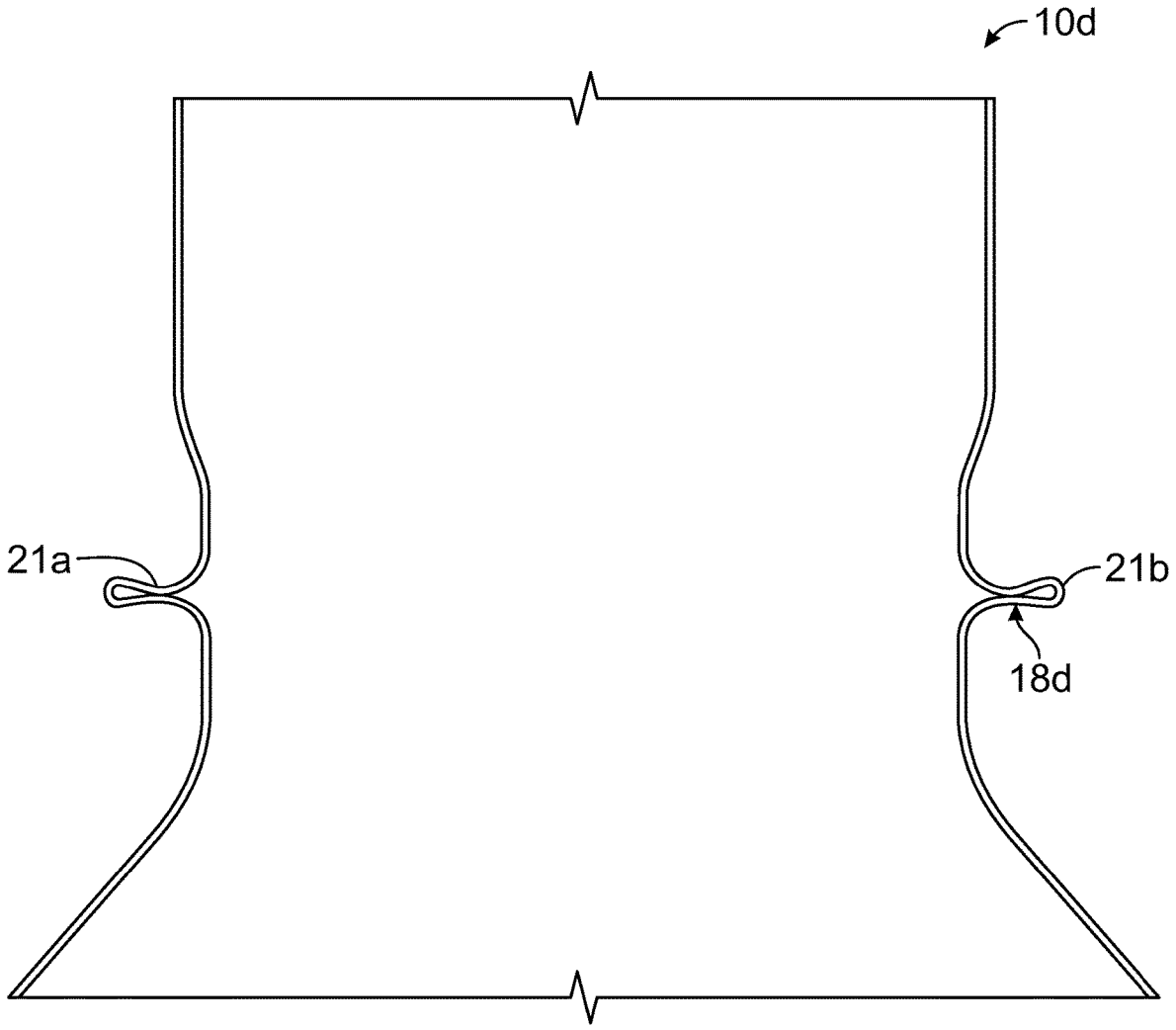
FIG. 6C illustrates a close-up cross-sectional view of a formed carrier ring, according to one embodiment.

In one embodiment, when inserted into the turret-head assembly 200 in the direction of Arrow A through a central opening 272, the shoulder 15 of the article 10 presses against the front guide 270, imparting a force that assists in causing the rolling assembly 210 to move in the direction of Arrow A into the compressed position, as shown in FIGS. 4H and 4J for Stage 2, FIGS. 5D-5E for Stage 3, and FIG. 6B for Stage 4. It is also contemplated that other (e.g., external) mechanisms may be used to cause the rolling assembly 210 to be in the compressed position.

The turret-head assembly 200*b* of Stage 2 of the carrier ring-forming process according to one embodiment is shown in FIGS. 4A-4J. In the illustrated embodiment, the outer roller 224*b* of Stage 2 has a forming radius 227*c* (measured axially) of about 0.7 to about 5 mm (about 0.03 to about 0.20 inch) (see FIG. 4H, 4J). In Stage 2 of the process, a groove 32 is rolled above the partial carrier ring 18 (see FIG. 2B). Similar to that of Stage 1, the Stage 2 turret-head assembly 200*b* described herein includes an inner pilot 260 mounted in a generally central opening 272 of the turret-head assembly 200*b* to assist in guiding the neck 16*a* of the article 10*a* into and through the turret-head assembly 200*b* and into position. As shown in FIGS. 4H and 4J, the open top end 11 of the article receives the pilot 260 therein such that the pilot 260 supports the interior surface of the neck 16*a* of the article 10*a* as the article 10*a* is moved into the turret-head assembly 200*b*, thereby assisting with precisely forming the next stage of the carrier ring 18 and adjacent grooves.

In some embodiments, there is an about 0.127 mm to about 0.254 mm (about 0.005 inch to about 0.010 inch) diametrical clearance from the interior sidewall of the neck 16*a* of the article 10*a* to the outer diameter of the pilot 260. In some embodiments, the pilot 260 includes a spring-loaded feature to assist with process control. The pilot 260 may be used with or without axial compliance. For example, in some embodiments, as shown in FIG. 4J, the pilot 260 includes a step 252*b* having a larger diameter than the body of the pilot 260 and the open top edge 25 of the neck 16*a* of the article 10*a* to catch the top edge 25 of the article 10*a*. Bearings inside the pilot 260 may assist in holding the article 10*a* generally stationary as the turret-head assembly 200*b* rotates. In some embodiments, the pilot 260 may be inserted about 12.7 mm to about 31.75 mm (about 0.50 inch to about 1.25 inches) deep into the open end of the article 10*a*. In other embodiments, the pilot 260 may be inserted about 19.05 mm to about 25.4 (about 0.75 inch to about 1 inch) deep into the open end of the article 10*a*. In some embodiments, the pilot 260 is free-spinning via a rotatable mount (not shown) such as, but not limited to, ball bearings, taper bearings, bushings, etc.

When in an uncompressed position of FIGS. 4G, 4J, the distance 245 between the neck 16*a* of the article 10*a* and the outer rollers 224*b* may be about 0.254 mm to about 1.27 mm (about 0.01 inch to about 0.05 inch) (see FIG. 4G). As discussed in detail with respect to Stage 1, movement of the article 10 in the direction of Arrow A by a ram and push plate along a path causes the open top end 11 of the article 10 to push against the step 252*b* of the pilot 260, which applies an axial load to the open top end 11 and activates the rolling assembly 210*b*. As such, the outer roller cams 244*b* engage with respective outer roller cam followers 240*b* positioned on outer roller arms 220*b*. Such engagement causes the outer roller arms 220*b* to move radially inward, thereby causing the outer rollers 224*b* coupled to the outer roller arms 220*b* to likewise move radially inward in unison in a generally linear fashion toward the center of the turret-head assembly 200*b* to the maximum inward point to contact the neck 16*a* of the article 10*a*. In one non-limiting embodiment, from the point of contact with the article 10*a*, the outer rollers 224*b* displace about 1 to about 2 mm (0.06 to about 0.08) inches (radial) to a final rolling position.

Like the outer roller cams 244*a* of Stage 1, the outer roller cams 244*b* of Stage 2 generally have an angled, sloped shape such that the top of each outer roller cam 244*b* has a greater width than the bottom. The angle 243*b* (see FIG. 4G) formed by the outer roller cam 244*b* may range from about 1° to about 19°. In another embodiment, the angle 243*b* may range from about 4° to about 16°. In yet another embodiment, the angle 243*b* may range from about 7° to about 13°. The angle 243*b* may be adjusted depending on, e.g., the amount of formation and material displacement desired.

FIG. 4J shows the engagement of the outer rollers 224*b* with the neck 16*a* of the article during Stage 2 of the carrier ring-forming process, according to one embodiment. In Stage 2, the outer rollers 224*b* are positioned to contact a portion 255 of the neck 16*a* adjacent to and above the partial carrier ring 18*a* formed during Stage 1, thereby forming a first reduced diameter portion or groove 32 (see also article 10*b* of FIG. 2B). When the resulting article 10*b* is removed from the turret-head assembly 200*b* in the direction of Arrow B, the turret-head assembly 200*b* returns to a decompressed position, as shown in FIG. 4G.

Notably, at the beginning of Stage 2, the shoulder 15 of the article 10*a* generally does not contact the front guide 270. As the neck 16*a* is rolled by the rolling assembly 210*b* and the axial load is applied to the top edge 25 of the article 10*a* to assist with forming, a slight reduction in the height of the neck 16*a*/article 10*a* occurs due to the displacement of material while the axial top load is applied. As a result, the shoulder 15 of the article 10*b* resulting from the Stage 2 process contacts the front guide 270, which causes at least some of the load to be transferred to the shoulder 15 via the front guide 270 and which further assists with driving the rolling assembly 210*b* in the direction of Arrow A.

As discussed above with respect to Stage 1, in some embodiments, the length of the article (e.g., the neck portion thereof) may change slightly during the rolling process of Stage 2. During the forming of Stage 2, the outer rollers 224*b* displace material inward, which results in some material thinning. As such, in some embodiments, after the forming of Stage 2 is completed, the height of the article 10*b* is greater than the height of the article 10*a* after Stage 1 (e.g., by about 0.127 to about 0.254 mm, or about 0.005 to about 0.010 inch).

In one non-limiting embodiment, the outer rollers 224*b* of Stage 2 initially move inward a distance of about 1.52 mm (about 0.06 inch) from contact with the article, thereby pushing the neck 16*a* inward the same distance. Spring back of the neck material may cause the neck to expand back outward by, e.g., about 30% to about 45% of the distance it was initially displaced. Thus, the resulting groove 32 formed in Stage 2 may radially displace the sidewall of the article inwardly, thereby decreasing the diameter of the portion 255 of the neck adjacent to and above the partial carrier ring 18*a* by about 2 to about 1.3 mm (about 0.01 to about 0.05 inches). In some non-limiting embodiments, after Stage 2, the outer diameter of the portion 255 of the neck adjacent to and above the partial carrier ring 18*a* is displaced inwardly by about 1% to about 6%, or by about 2% to about 5%, or by about 3% to about 4% of its initial diameter. In some embodiments, after the forming of Stage 2 is complete, the diameter of the resulting partial carrier ring 18*b* is expanded by up to about 0.2 mm (about 0.005 inches).

Figure 4K:
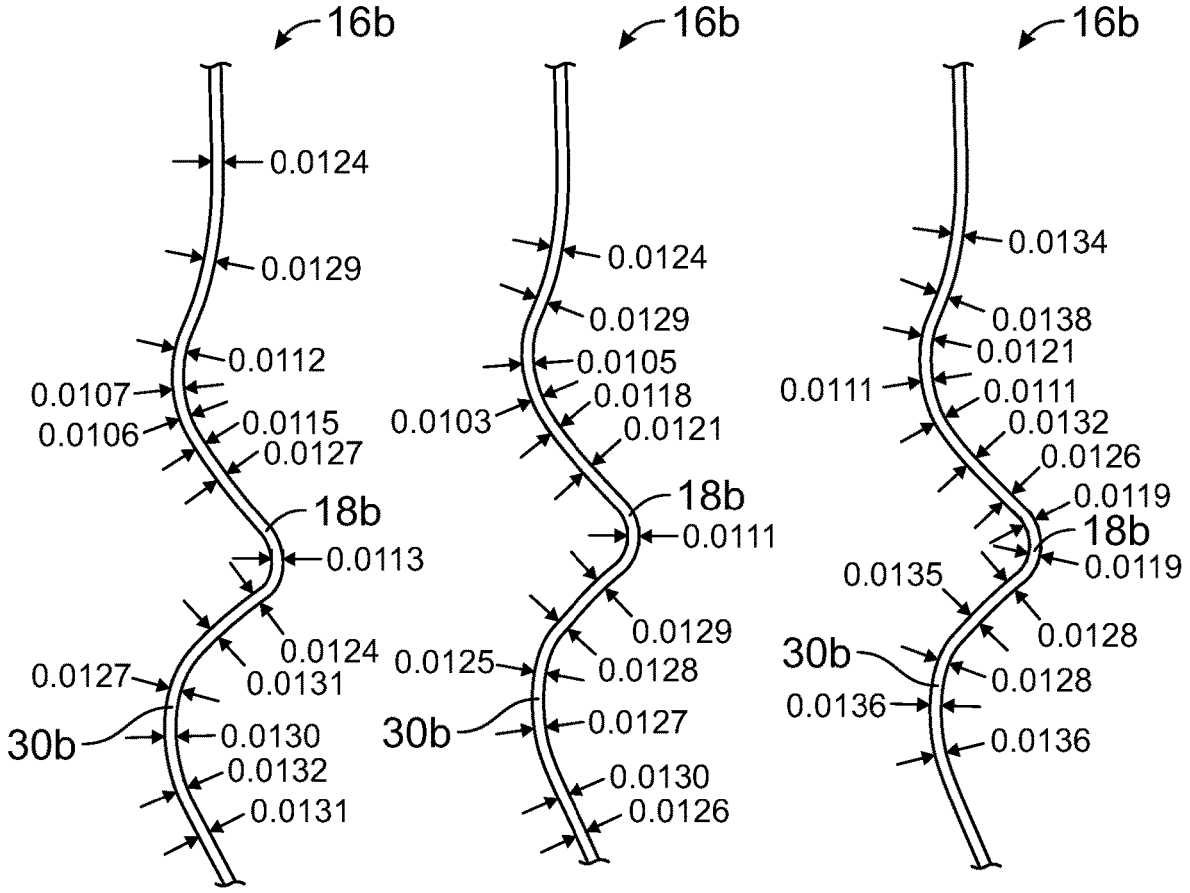
FIG. 4K illustrates a cross-sectional side view of a partially formed neck of an article formed according to an embodiment disclosed herein.

FIG. 4K illustrates a cross-sectional side view of a partially formed neck 16*b* of article subsequent to Stage 2, according to one embodiment. Various wall thicknesses are shown (in inches) along various portions of the formed neck 16*b*. The three cross-sectional views of FIG. 4K are intended to show the same article; multiple views are shown due to space constraints.

Figure 4L:
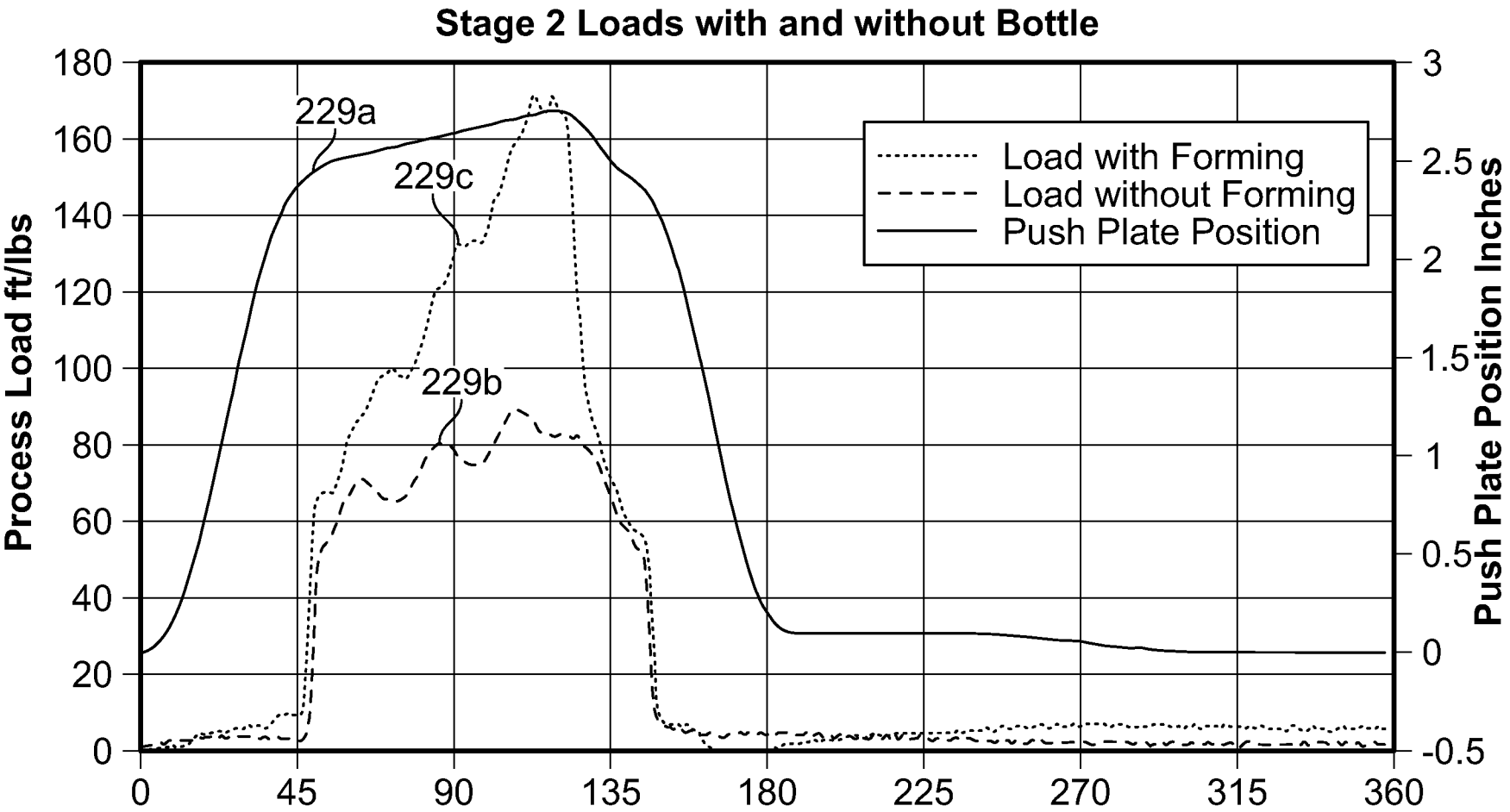
FIG. 4L illustrates a graph comparing the position of a push plate (cam profile) activating an article and the loads applied to the article according to one embodiment.

Referring now to FIG. 4L, a graph comparing the position of the push plate activating the article toward the turret-head assembly 200*b* and the loads applied to the article during Stage 2 is shown, according to one embodiment. The line 229*a* represents the position of the push plate, which corresponds with the cam profile along which the cam follower of the push plate travels. The line 229*b* represents the bottle forming load at each push plate position. The line 229*c* represents the bottle forming load at each push plate position. The loads associated with the line 229*c* generally result, e.g., from the spring compression and resistance of the turret-head assembly 200*b*.

FIGS. 5A-5E illustrate a turret-head assembly 200*c* of a subsequent Stage 3 of the carrier ring-forming process, according to one embodiment. In Stage 3, the shape of the carrier ring is further defined. As in the previous stage, the open top end 11 of the article 10*b* formed in Stage 2 is guided into the assembly via a pilot 260'. At the distal end of the pilot 260' is a step 252*c* having a larger diameter than the body of the pilot 260' and the open top end 11 of the neck 16*b* of the article 10*b* to catch a top edge 25 of the article 10*b*.

The turret-head assembly 200*c*, the motion of outer rollers 224*c*, and the process associated with Stage 3 is generally similar to that of Stage 2, except that the position and shape of the outer rollers 224*c* is different. Specifically, in Stage 3, the outer rollers 224*c* are "double outer rollers," e.g., they contact two different portions of the neck 16*b* of the article 10*b* (see FIG. 7B). Put another way, as shown in FIGS. 5A-5E and 7A-7B, the double outer rollers 224*c* have a first contacting area 280*a* configured to contact and shape a portion 285*a* of the neck 16*b* adjacent to and above the partially formed carrier ring 18*b*, a second contact area 280*b* configured to contact and shape a portion 285*b* of the neck 16*b* adjacent to and below the partially formed carrier ring 18*b*, and a recessed portion 280*c* bridging the first and second contact areas 280*a*, 280*b*. In one non-limiting embodiment, the first contact area 280*a* has an upper forming radius 281*a* (measured axially) of about 1.52 mm to about 3.05 mm (about 0.06 to about 0.12 inch) and a lower forming radius 281*b* (configured to contact the partially formed carrier ring 18*b*) of about 0.76 mm to about 2.29 mm (about 0.03 to about 0.09 inch) (see FIG. 5C). The second contact area 280*b* has an upper forming radius 283*a* (measured axially) (configured to contact the partially formed carrier ring 18*b*) of about 1.27 mm to about 3.05 mm (about 0.05 to about 0.12 inch) and a lower forming radius 283*b* (configured to abut the shoulder 15) of about 2.03 mm to about 6.35 mm (about 0.08 to about 0.25 inch) (see FIG. 5C). In one non-limiting embodiment, the distance between the first and second contact areas 280*a*, 280*b* (i.e., the height of the recessed portion 280*c*) is about 0.13 mm to about 3.05 mm (about 0.005 to about 0.120 inch).

Figure 7A:
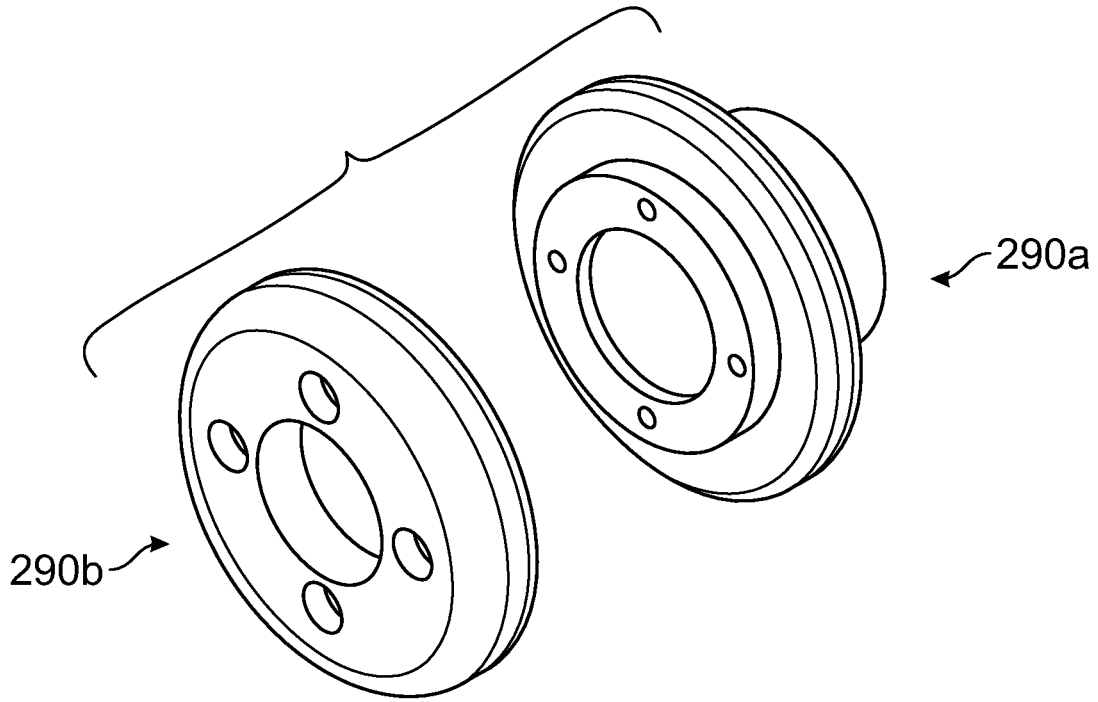
FIG. 7A illustrates an exploded view of double rollers according to one embodiment.
Figure 7B:
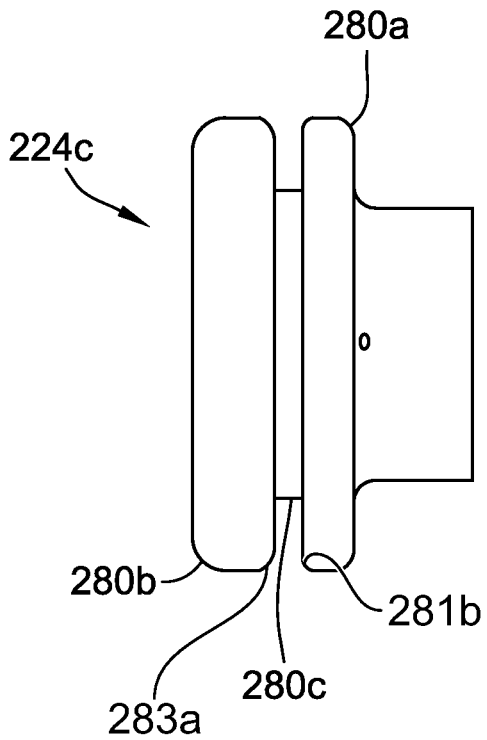
FIG. 7B illustrates double rollers according to one embodiment.

As shown in FIG. 7A, the double rollers used in Stages 3-4 may be formed by coupling two independently rotating roller elements 290*a*, 290*b* on a single axis. In other embodiments, the double roller is generally unitary such that the first and second contacting areas are continuous and integrated.

Notably, as in Stage 2, at the start of Stage 3, the shoulder 15 of the article 10*b* generally does not contact the front guide 270. As the neck 16*b* is rolled by the rolling assembly 210*c* and an axial load is applied to the top edge 25 of the article 10*b* to assist with forming, a slight reduction (e.g., about 0.13 mm to about 2 mm (about 0.005 to about 0.08 inch) in the height 253*a* of the neck 16*b*/article 10*b* occurs due to the displacement of material while the axial top load is applied. In other embodiments, the reduction in height 253*a* of the neck 16*b* during Stage 3 is about 1 to about 1.2 mm (about 0.03 to 0.05 inch). As a result, the shoulder 15 of the article 10*c* resulting from the Stage 3 process contacts the front guide 270, which causes at least some of the load to be transferred to the shoulder 15 via the front guide 270 and which further assists with driving the rolling assembly 210*c* in the direction of Arrow A.

As described above with respect to previous stages, in Stage 3, the article 10*b* may be driven into the turret-head assembly 200*c* by a ram and push plate that follow along a path, causing the open top end 11 of the article 10*b* to push against the step 252*c* of the pilot 260', which applies an axial load to the open top end 11 of the article 10*b* and activates the rolling assembly 210*c*. In one non-limiting embodiment, from the point of contact with the article 10*b*, the second contact area 280*b* of the outer rollers 224*c* displaces about 2 to about 5 mm (0.08 to about 0.2 inch) (radial) to a final rolling position, shown in FIG. 5E. In one non-limiting embodiment, the process of Stage 3 increases the diameter of the resulting partial carrier ring 18*c* about 1% to about 5%, or from about 2% to about 3% from the diameter of the partial carrier ring 18*b* resulting from the Stage 2 process. In some embodiments, after the forming of Stage 3 is complete, the diameter of the resulting partial carrier ring 18*c* is expanded by about 0.2 to about 1.3 mm (about 0.01 to about 0.05 inches). As a result of the forming of Stage 3, the partial carrier ring 18*c* of the resulting article 10*c* is further defined, as shown in FIGS. 2B and 5F.

Figure 5F:
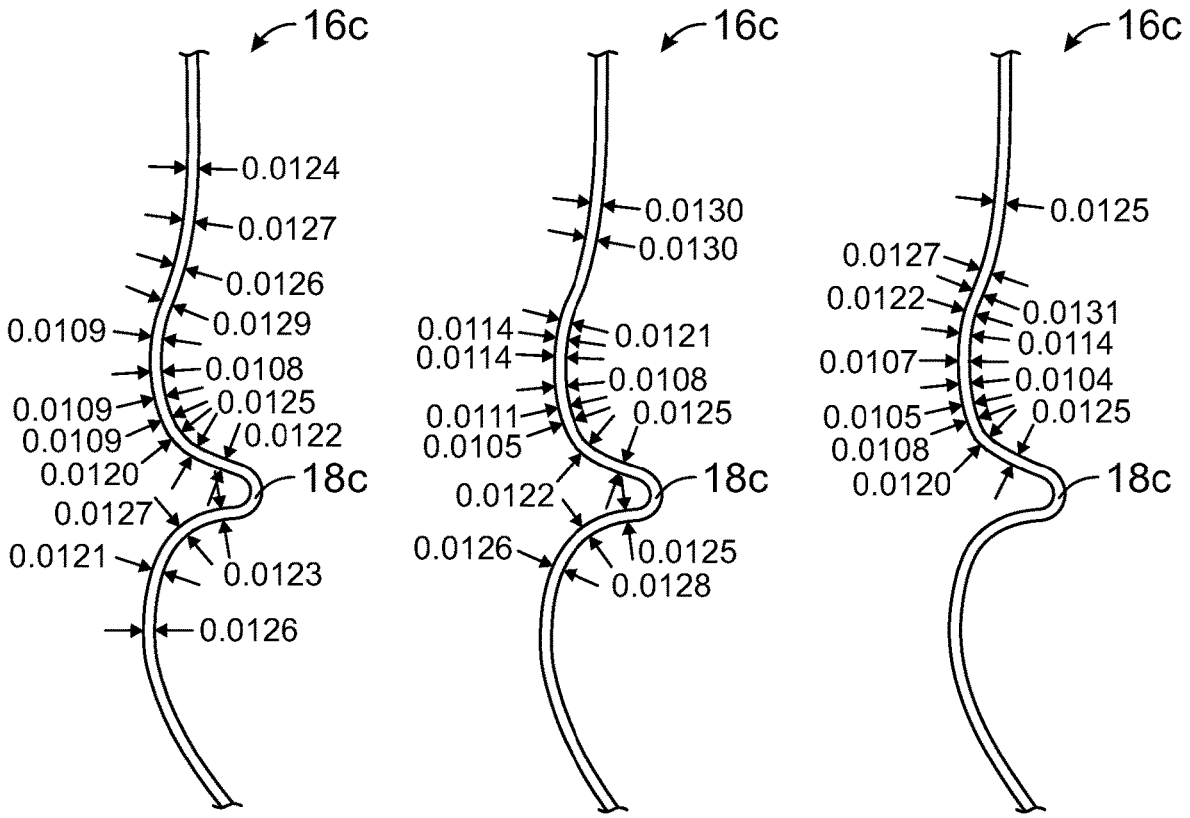
FIG. 5F illustrates a cross-sectional side view of a partially formed neck of an article formed according to an embodiment disclosed herein.

FIG. 5F illustrates a cross-sectional side view of a partially formed neck of an article 10*c* subsequent to Stage 3, according to one embodiment. Various wall thicknesses are shown (in inches) along various portions of the formed neck. The three cross-sectional views of FIG. 5F are intended to show the same article; multiple views are shown due to space constraints.

Figure 5G:
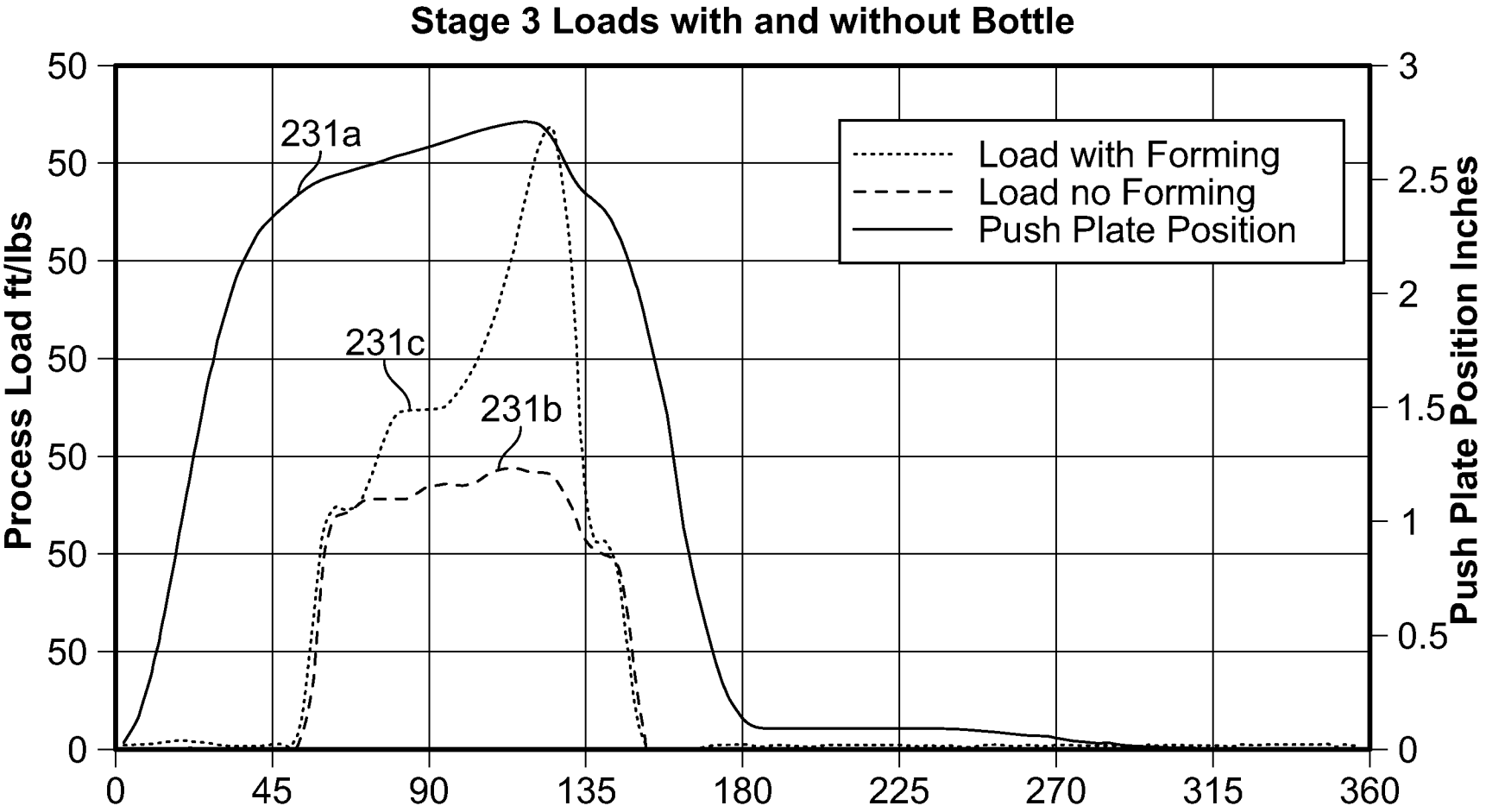
FIG. 5G illustrates a graph comparing the position of a push plate (cam profile) activating an article and the loads applied to the article according to another embodiment.

Referring now to FIG. 5G, a graph comparing the position of the push plate activating the article toward the turret-head assembly 200*c* and the loads applied to the article during Stage 3 is shown, according to one embodiment. The line 231*a* represents the position of the push plate, which corresponds with the cam profile along which the cam follower of the push plate travels. The line 231*b* represents the bottle forming load at each push plate position. The line 231*c* illustrates the static loads measurements (no bottle present), where the rolling assembly is generally stationary/does not rotate. The loads associated with the line 231*c* generally result from the spring compression and resistance of the turret-head assembly 200*c*.

Figure 7C:
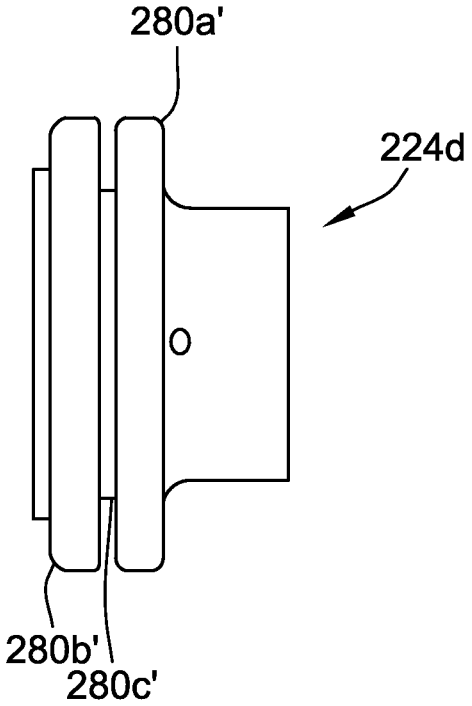
FIG. 7C illustrates double rollers according to another embodiment.

FIGS. 6A-6B illustrate a turret-head assembly 200*d* of a subsequent Stage 4 of the process, according to one embodiment. In Stage 4, the shape of the carrier ring 18 is further defined (narrowed, or "pinched"). The turret-head assembly 200*d* and process associated with Stage 4 is generally similar to that of Stage 3, except that the position and shape of outer rollers 224*c* used with the turret-head assembly 200*d* is different. Specifically, as in Stage 3, the turret-head assembly 200*d* of Stage 4 includes double outer rollers 224*c* that are shaped to further define the shape of the carrier ring 18 (see FIG. 7C). More specifically, as shown in FIGS. 6A, 6B, and 7C, the double outer rollers 224*d* include a recessed portion 280*c'* positioned between first and second contact areas 280*a'*, 280*b'*. The recessed portion 280*c'* has a smaller height than that of Stage 3 such that the distance between first and second contact areas 280*a'*, 280*b'* is smaller.

In one non-limiting embodiment, the first contact area 280*a'* has an upper forming radius 281*a'* (measured axially) of about 1.02 mm to about 1.52 mm (about 0.04 to about 0.06 inch) and a lower forming radius 281*b'* (configured to contact the partially formed carrier ring 18*c*) of about 1 to about 2 mm (about 0.03 to about 0.08 inch) (see FIGS. 5C-5E). The second contact area 280*b'* has an upper forming radius 283*a'* (measured axially) (configured to contact the partially formed carrier ring 18*c*) of about 1 to about 2 mm (about 0.03 to about 0.08 inch) and a lower forming radius 283*b'* (configured to abut the shoulder 15) of about 4 to about 5 mm (about 0.1 to about 0.2 inch) (see FIGS. 6A-6B). In one non-limiting embodiment, the distance between the first and second contact area 280*a'*, 280*b'* (i.e., the height of the recessed portion 280*c'*) is about 0.89 to about 1.78 mm (about 0.035 to about 0.07 inch). As such, the double outer rollers 224*d* of Stage 4 assist in "pinching" the carrier ring into a desired shape/form. Thus, as a result of the forming of Stage 4 (especially in combination with the forming axial top load compressing the carrier ring), the shape of the resulting carrier ring 18*d* (see FIG. 2B) is even further defined. In addition, the process of Stage 4 is such that a circumferential gap between upper and lower portions 271*a*, 271*b* of the resulting carrier ring 18*d* (see FIGS. 6B-6C) is generally eliminated. Put another way, the inner surfaces of the upper and lower portions 271*a*, 271*b* of the carrier ring 18*d* are generally flush, at least about a continuous circumference of the resulting carrier ring 18*d*. As such, the chance that the article material will buckle/fail during subsequent processing (e.g., necking, curling) operations where additional loads are applied is minimized. In some embodiments, the interior surface of the article includes a coating, e.g., to protect the metal from corrosion, etc. The coating on the interior surfaces of the upper and lower portions 271*a*, 271*b* may come together to assist in sealing the gap.

Figure 6D:
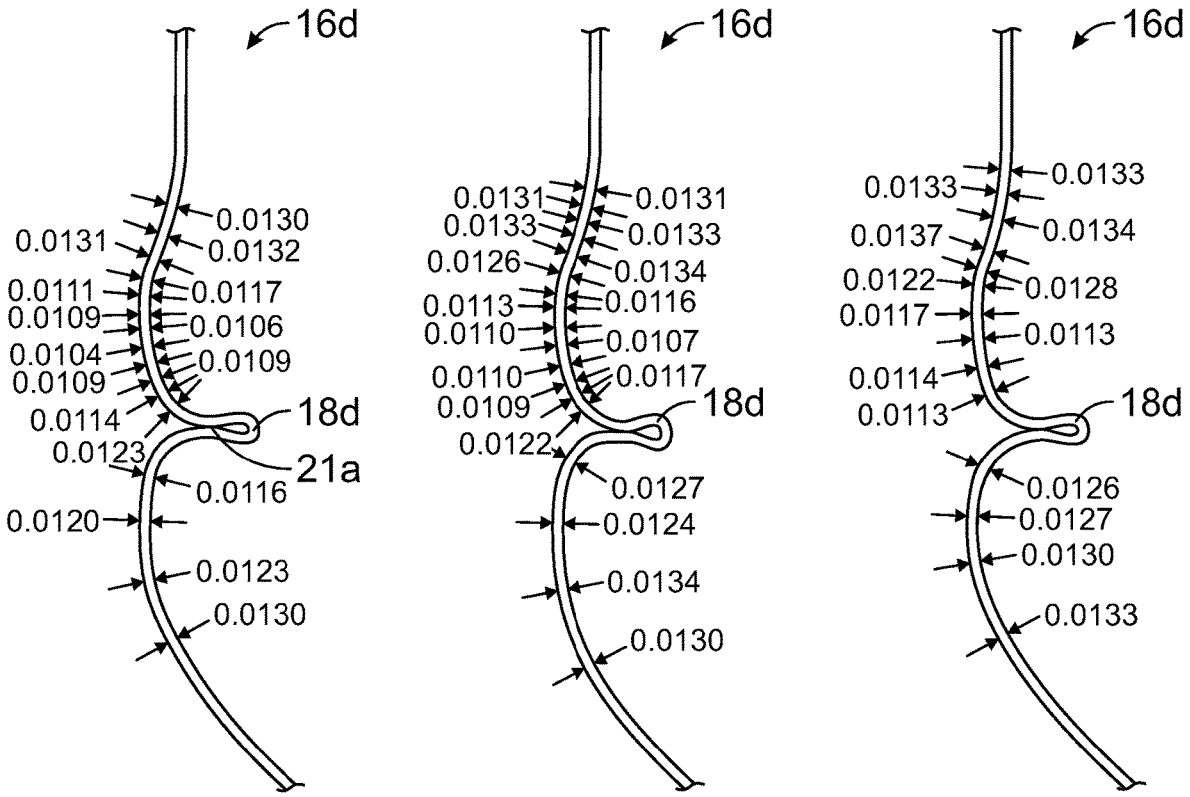
FIG. 6D illustrates a cross-sectional side view of a partially formed neck of an article formed according to another embodiment disclosed herein.

As shown in FIG. 6C-6D, the finished shape of the carrier ring 18*d* may include a middle portion 21*a* having a smaller thickness than an outer portion 21*b*. Put another way, a thickness of an outer portion 21*b* of the carrier ring 18*d* may be greater than a thickness of a mid/inner portion of the carrier ring. This shape may be a result of the rolling process of Stage 4 used to finalize the carrier ring.

It is contemplated, however, that the resulting metal carrier ring 18 may have substantially parallel upper and lower surfaces (see FIG. 6F) meeting at a distal edge of the carrier ring 18. In such an embodiment, the distal edge has an outer bend radius 19 approximately equal to a thickness of the sidewall of the article. Furthermore, in the illustrated embodiment of FIG. 6F, the gap between the substantially parallel upper and lower surfaces of the carrier ring 18*d* is eliminated or substantially eliminated such that the inner surfaces of the upper and lower surfaces contact each other along the entire the carrier ring 18*d*.

The Stage 4 forming process essentially creates a "controlled collapse" to produce a final, desired diameter and location of the carrier ring 18*d*. If the carrier ring is not collapsed (e.g., if a substantial gap exists between the upper and lower surface 271*a*, 271*b* of the resulting carrier ring 18*d*), uncontrolled loads may deform the shape and/or integrity of the formed carrier ring. In addition, the diameters of the grooves 32', 30*d* adjacent to (above and below) the carrier ring 18*d* are further reduced during Stage 4. In some embodiments, after the forming of Stage 4 is complete, the diameter of the resulting partial carrier ring 18*d* is expanded up to about 1 mm (0.04 inch).

Notably, as in Stages 2 and 3, at the start of Stage 4, the shoulder 15 of the article 10*c* generally does not contact the front guide 270. As the neck 16*c* is rolled by the rolling assembly 210*d* and an axial load is applied to the top edge 25 of the article 10*c* to assist with forming, a further slight reduction (e.g., about 0.5 to about 0.6 mm (about 0.01 to about 0.03 inch)) in the height of the neck 16*c*/article 10*c* occurs due to the displacement of material while the axial top load is applied. As a result, the shoulder 15 of the article 10*d* resulting from the Stage 4 process contacts the front guide 270, which causes at least some of the load to be transferred to the shoulder 15 via the front guide 270 and which further assists with driving the rolling assembly 210*d* in the direction of Arrow A.

As described above with respect to previous stages, in Stage 4, the article 10*c* may be driven into the turret-head assembly 200*d* by a ram and push plate that follow along a path, causing the open top end 11 of the article 10*c* to push against a step 252*d* of a pilot 260", which applies an axial load to the open top end 11 of the article 10*c* and activates the rolling assembly 210*d*. This process may cause the height of the neck 16*c*/article 10*c* to shorten. In some embodiments, the height of the article is shortened by about 1 to about 3 mm (about 0.04 to about 0.09 inches) during Stage 4. In some embodiments, the height of the article is shortened by about 1.4 to about 1.8 mm (about 0.05 to about 0.07 inch) during the entire carrier ring-forming process. In one non-limiting embodiment, from the point of contact with the article 10*c*, the second contact area 280*b*' of the outer rollers 224*d* displaces about 2 to about 3 mm (about 0.08 to about 0.12 inch) (radial) to a final rolling position, shown in FIG. 6B. In one embodiment, the process of Stage 4 increases the diameter of the resulting partial carrier ring 18*b*. As a result of the forming of Stage 4, the partial carrier ring 18*d* of the resulting article 10*d* is further defined, as shown in FIGS. 2B and 6C.

FIG. 6D illustrates a cross-sectional side view of a partially formed neck 16*d* of article subsequent to Stage 4, according to one embodiment. Various wall thicknesses arc shown (in inches) along various portions of the formed neck 16*d*. The three cross-sectional views of FIG. 6D are intended to show the same article; multiple views are shown due to space constraints.

Figure 6E:
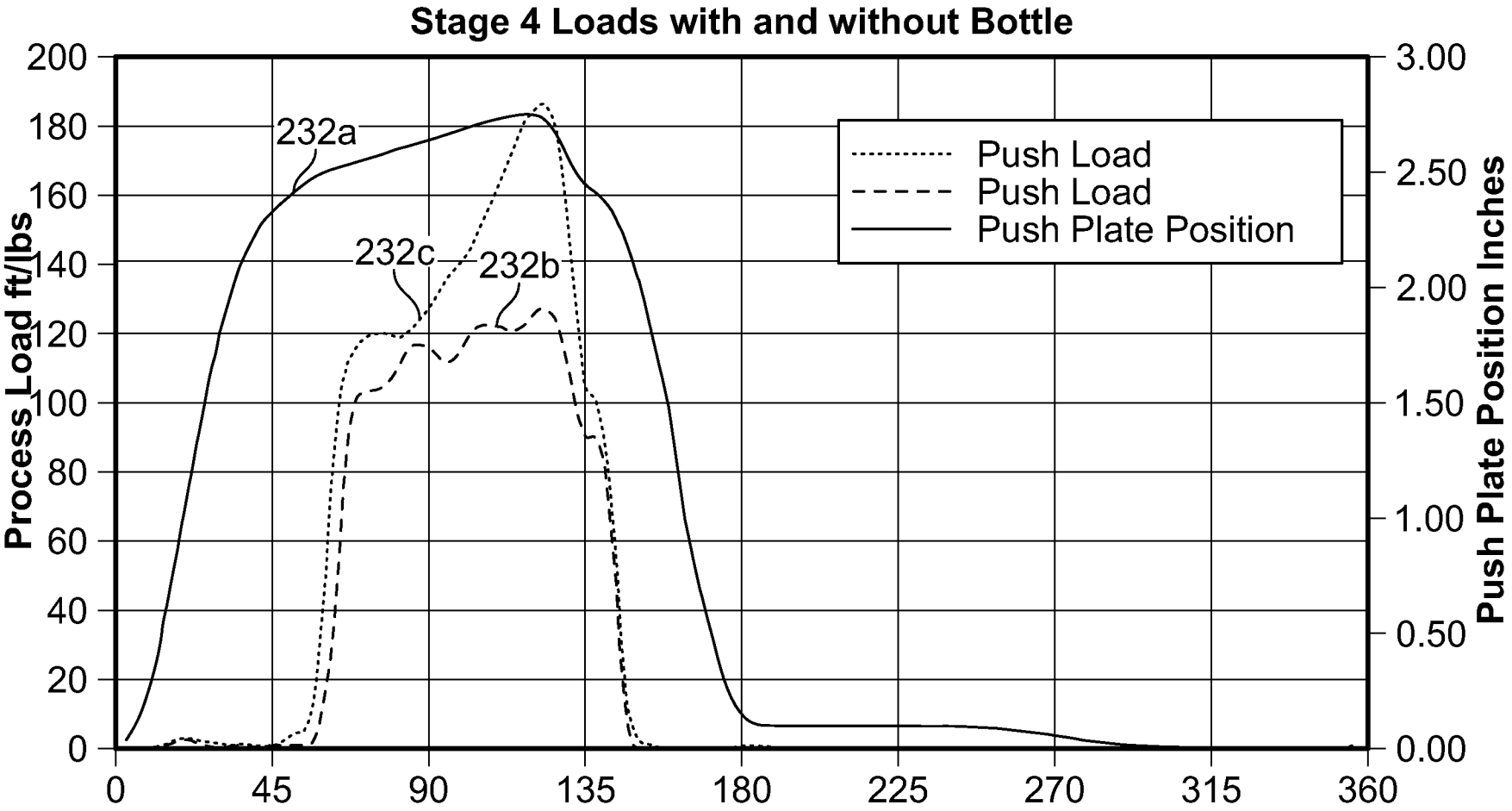
FIG. 6E illustrates a graph comparing the position of a push plate (cam profile) activating the article and the loads applied to the article according to one embodiment.
Figure 6F:
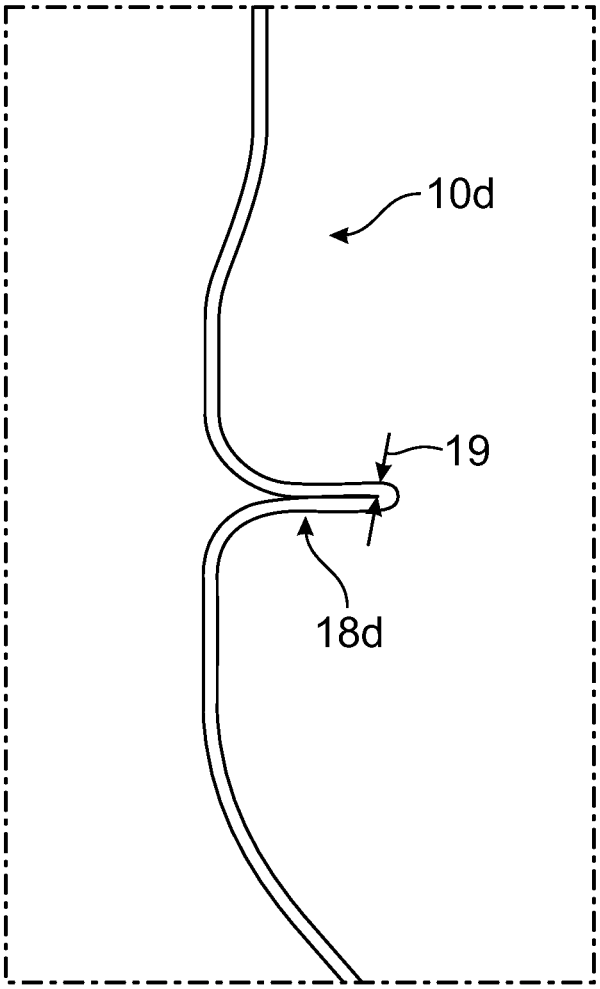
FIG. 6F illustrates a close-up cross-sectional view of a formed carrier ring, according to another embodiment.

Referring now to FIG. 6E, a graph comparing the position of the push plate activating the article toward the turret-head assembly 200*d* and the loads applied to the article during Stage 4 is shown, according to one embodiment. The line 232*a* represents the position of the push plate, which corresponds with the cam profile along which the cam follower of the push plate travels. The line 232*b* represents the bottle forming load at each push plate position. The line 232*c* illustrates the static loads measurements (no bottle present), where the rolling assembly is generally stationary/does not rotate. The loads associated with the line 232*c* generally result from the spring compression and resistance of the turret-head assembly 200*d*.

Like the outer roller cams 244*a*, 244*b* of Stages 1 and 2, the outer roller cams of Stages 3 and 4 generally have an angled, sloped shape such that the top of each outer roller cam has a greater width than the bottom. The angle formed by the outer roller cams of each of Stages 3 and 4 may be the same, or they may differ. The angle formed by the outer roller cam of Stages 3 and 4 may range from about 2° to about 30°. In another embodiment, the angle may range from about 10° to about 27°. In yet another embodiment, the angle may range from about 18° to about 24°. The angle formed by the outer roller cams of each of Stages 3 and 4 may be adjusted depending on, e.g., the amount of formation and material displacement desired.

As discussed above, during the rolling of one or more of Stages 1-4 described above, an axial load can be applied to the top edge 25 of the article 10 to assist with material displacement, controlling the material flow, preventing material thinning, and/or preventing material fracture. It is contemplated that any suitable amount of axial load may be applied. The axial load may be applied, e.g., via the contact between the step of the pilot and the top edge 25 of the article pushing against the step of the pilot, e.g., to slide the rolling assembly in the direction of Arrow A. In some embodiments, the pilot may include a spring-loaded feature to assist with providing an axial load on the open top edge 25 of the article 10. The type of springs and/or the preload set on the springs of the spring-loaded feature may be adjusted to achieve a desired axial load to be applied to the article 10.

In some embodiments, the amount of axial load applied to the top edge 25 of the article 10 may vary based on the stage of forming, e.g., the amount of the axial load may be different in each or some of Stages 1-4. For example, the axial load applied during Stage 1 and/or Stage 2 may be about 115 to about 175 lb. The axial load applied during Stage 3 may be about 140 to about 215 lb. The axial load applied during Stage 4 may be about 120 to about 185 lb.

Although four carrier ring-forming stages (e.g., Stages 1-4) are described herein, it is contemplated that any number of suitable steps/stages may be used to form the desired shape of the carrier ring 18. It is also contemplated that additional rolling or flattening processes may be used to reshape the carrier ring 18. For example, further processing operations may cause the carrier ring 18 to slightly deform, resulting in an undesirable ring shape. Therefore, an additional process step(s) may be implemented to correct for this.

It is contemplated that one or more forming operations may be applied to the article 10 before or after any of the carrier ring-forming stages described herein. For example, it may be desirable to perform a trimming operation on the article 10 before or after one of the stages. In one non-limiting example, a trimming operation is performed on the article 10*c* subsequent to Stage 3 to trim the open top end 11 of the article 10*c* formed in Stage 3 to a specified, generally uniform, overall height and/or to remove any variations caused by previous forming stages. Such a trimming operation may be desirable so that, e.g., the open top end 11 of the article is generally even/flat to ensure proper contact with the step on the pilot of the subsequent stage so that a generally even/constant axial load may be applied thereto in the subsequent stage(s). In addition, it may be beneficial to include a trimming step prior to the final stage (e.g., Stage 4) so that the heights of the resulting articles 10*d* are consistent.

Moreover, although the turret-head assemblies 200*a-d* of the exemplary embodiments are activated by the axial movement of the article 10 (e.g., via the open top end 11 of the article contacting the step on the pilot and/or via the shoulder 15 of the article contacting and pushing against the front guide 270), it is contemplated that the components of the turret-head assemblies of any of the stages discussed herein may be activated by any portion of the article or any other external mechanism causing axial movement of the rolling assemblies 210 of the turret-head assemblies 200 relative to the article 10. For example, in some embodiments, the turret-head assembly 200 used in any of the stages described herein is compressed independently of the article 10. For instance, the rolling assembly 210 of the turret-head assembly 200 may be axially moved, e.g., via a cam actuator actuating a cam positioned on the forming turret to which the turret-head assembly 200 is coupled, thereby compressing the turret-head assembly 200 and, accordingly, causing radial movement of the outer and/or inner rollers 224, 226 of the forming tool.

Figure 8A:
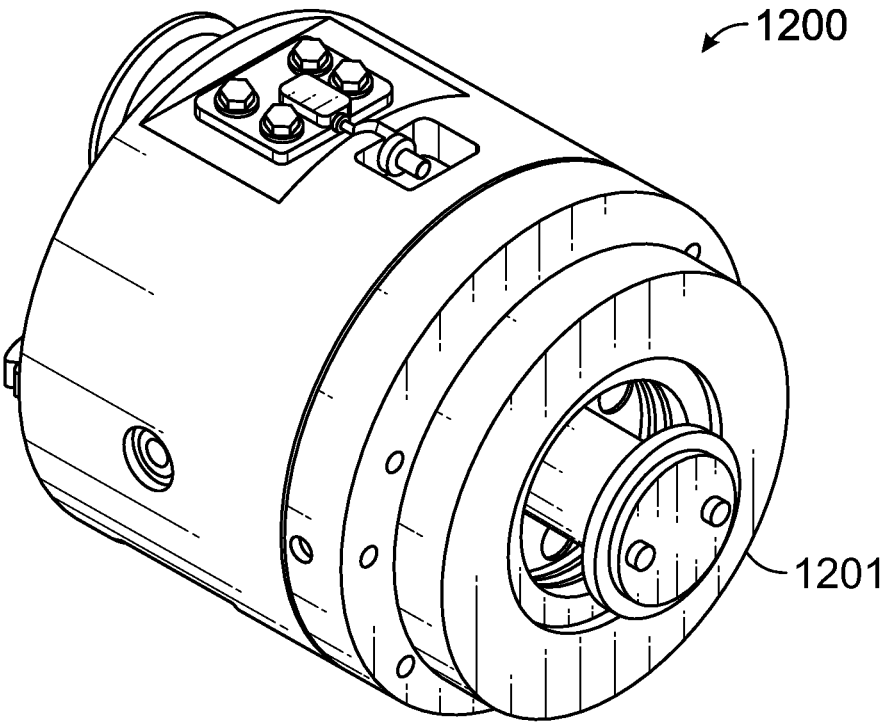
FIG. 8A illustrates a perspective top view of a turret-head assembly used in one stage of a carrier ring-forming process, according to another embodiment.
Figure 8B:
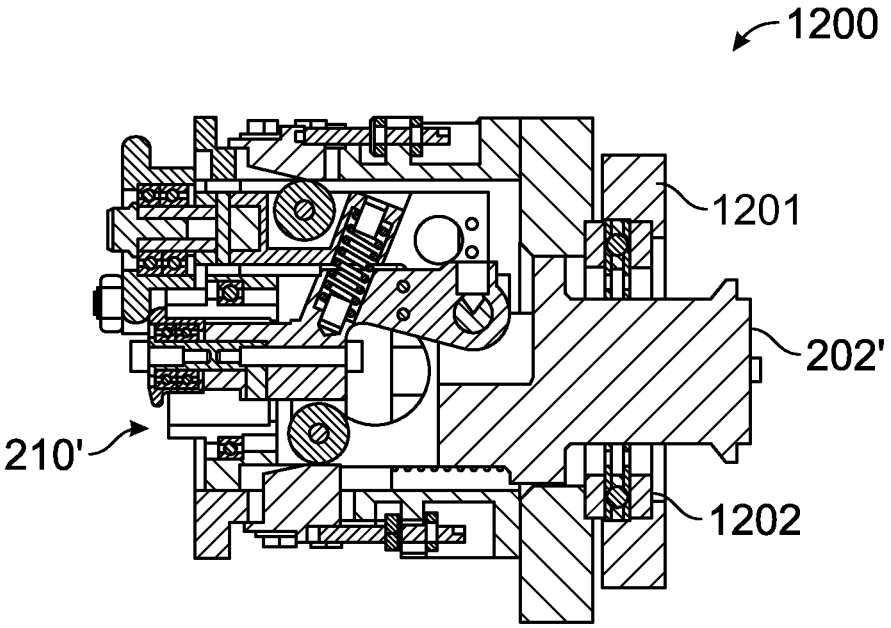
FIG. 8B illustrates a cross-sectional view of the turret-head assembly of FIG. 8A.

Referring, for example, to FIGS. 8A-8B and 9A-9B, turret-head assemblies 1200, 1200' are illustrated according to other embodiments wherein the rolling assemblies 210', 210" are actuated independently of the article 10. The turret-head assembly 1200 of FIGS. 8A-8B is similar to the turret-head assembly 200*a* of Stage 1 detailed above, and the turret-head assembly 1200' of FIGS. 9A-9D is similar to the turret-head assembly 200*b-d* of the subsequent Stages 2-4 detailed above. For example, the turret-head assembly of FIGS. 9A-9D includes a top plate 206', a base plate 208', a housing 204', outer rollers 224' (which are double rollers in the nonlimiting illustrated embodiment), outer roller cams 244', outer roller cam followers 240', a pilot 260' having a step 252', a guide 270', and the like. However, unlike the turret-head assemblies 200*a-d* detailed above, which are actuated via axial movement of the article 10, the rolling assemblies 210', 210" of the forming tools of FIGS. 8A-8B and 9A-9B arc actuated using an external mechanism.

A plurality of turret head-assemblies 200, 1200, 1200' described herein may be mounted to a forming turret 1300, e.g., via a spindle shaft. This is illustrated in FIGS. 10A-10D with respect to the turret-head assembly 1200 of FIGS. 8A-8B. As shown, the spindle shaft 1201 aligns the turret-head assembly 1200 with the article 10 to be processed. A similar arrangement may be used with respect to, e.g., the turret-head assembly 1200' of FIGS. 9A-9D. It is contemplated that a turret shaft, a motor shaft, or another suitable device may also be used with the turret-head assemblies 1200, 1200'. The housing and/or rolling assemblies of the turret-head assemblies 1200, 1200' of FIGS. 8A-8B and 9A-9B may be displaced axially using a cam mechanism (e.g., a cam actuator), a linkage mechanism, a servo-mechanism, a hydraulic or pneumatic cylinder, a linear motor, or any other suitable mechanism or combination thereof.

Figure 9A:
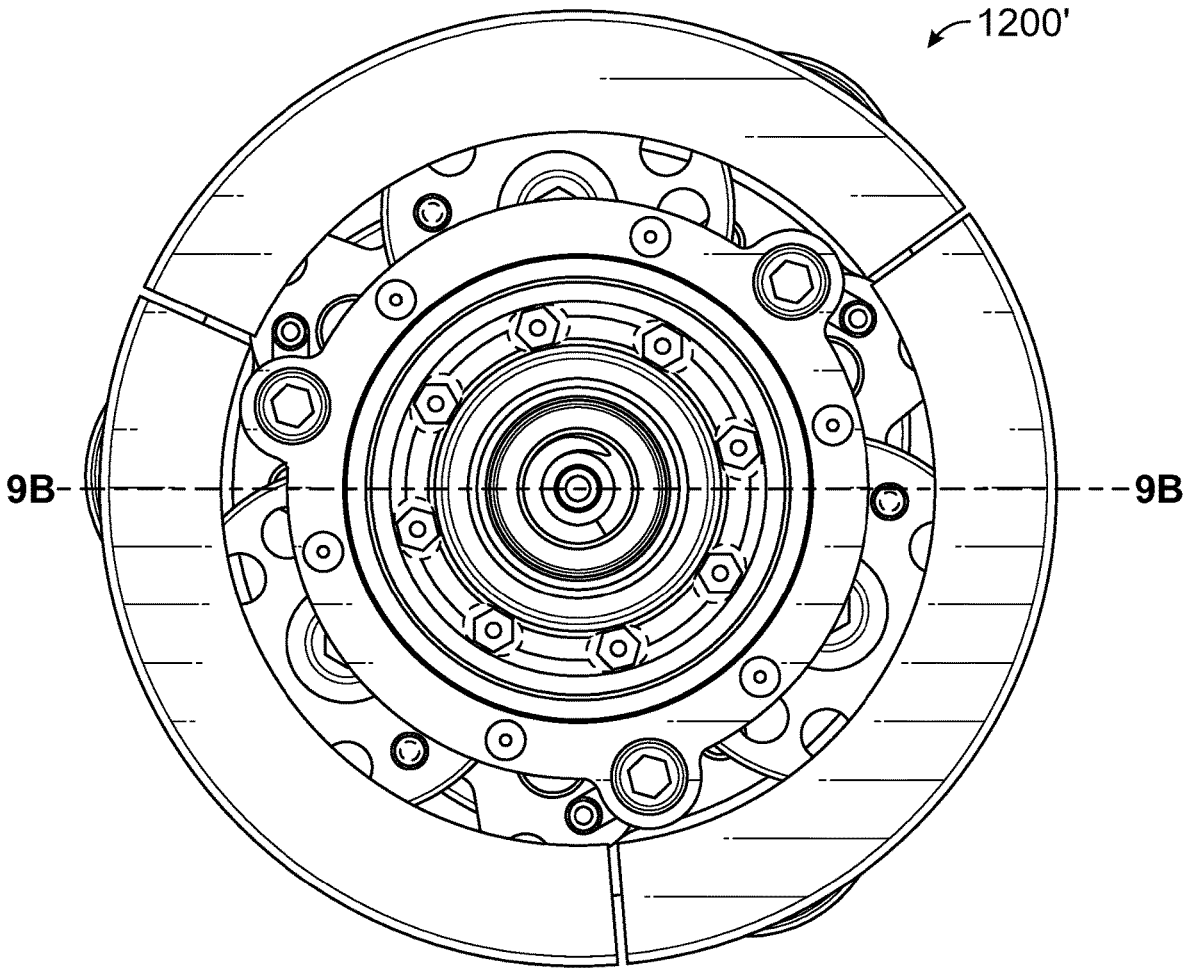
FIG. 9A illustrates a bottom view of a turret-head assembly used in one stage of a carrier ring-forming process, according to another embodiment.
Figure 9B:
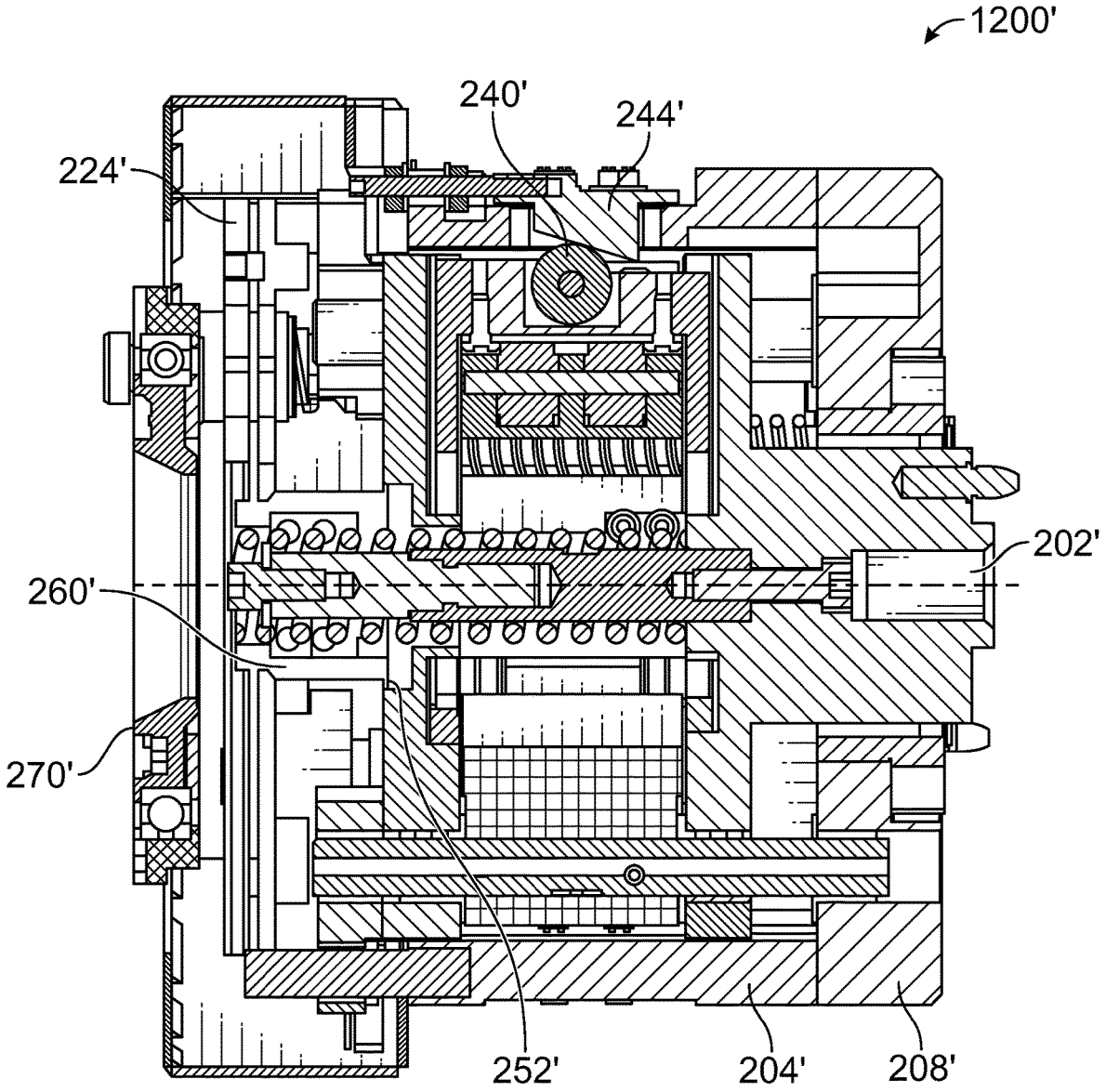
FIG. 9B illustrates a cross-sectional side view of the turret-head assembly of FIG. 9A along line 9B-9B.
Figure 9C:
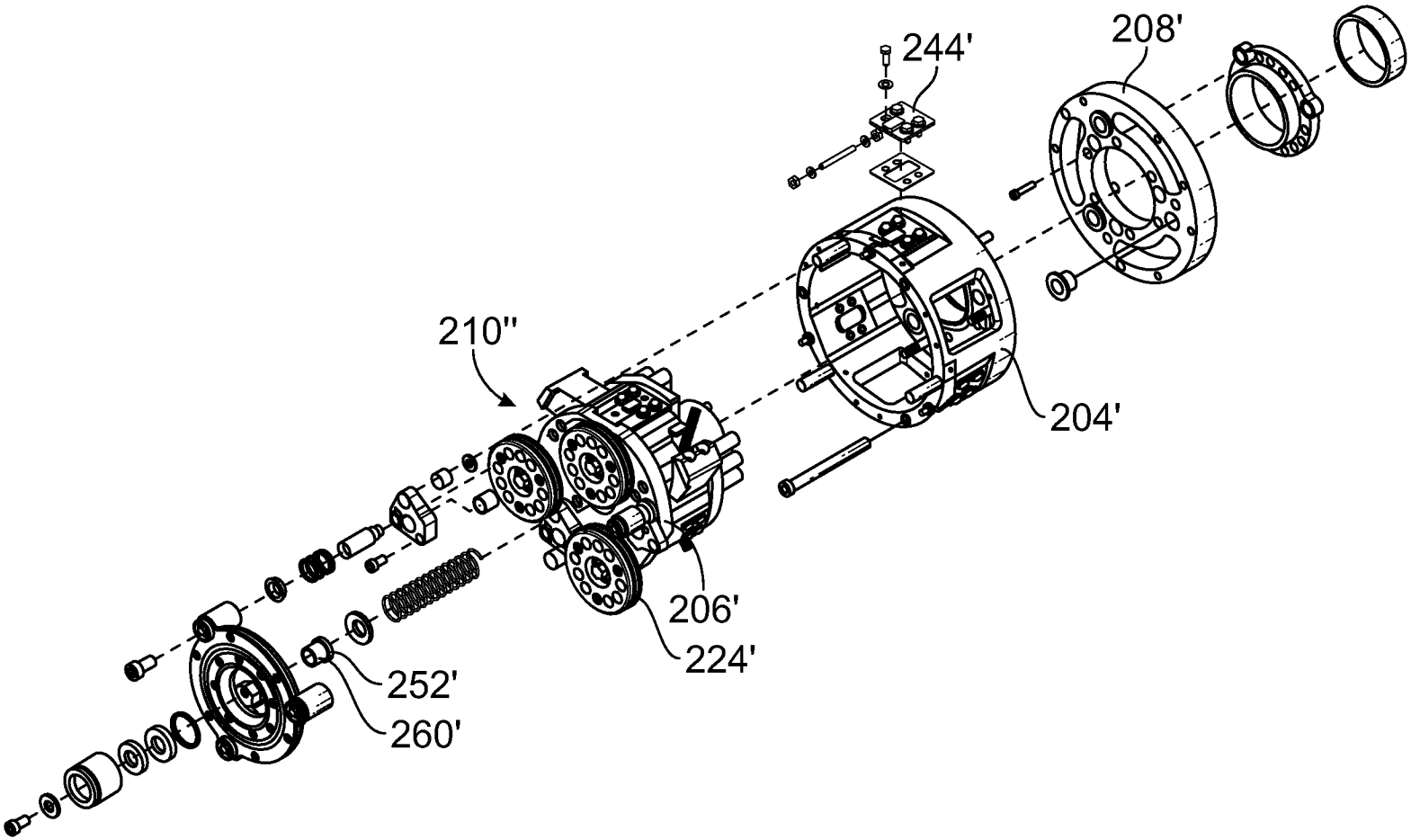
FIG. 9C illustrates an exploded view of the turret-head assembly of FIGS. 9A-9B.
Figure 9D:
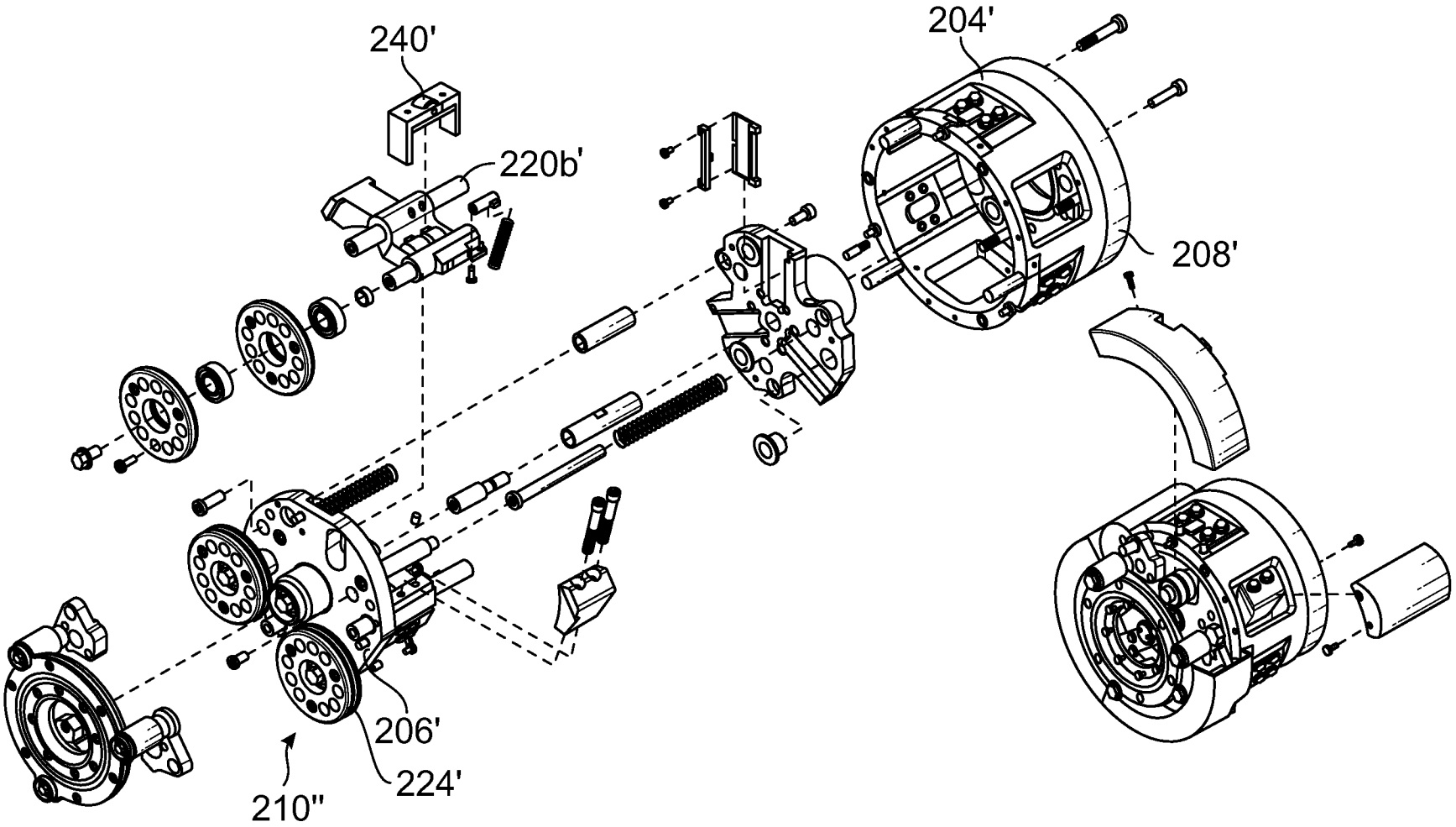
FIG. 9D illustrates another exploded view of the turret-head assembly of FIGS. 9A-9C.

Referring to FIGS. 10A-10D and 11A-11C, a non-limiting example of the turret-head assembly 1200 of FIGS. 9A-9B coupled to a forming turret 1300 via a tooling actuator 1205 is shown. The turret 1300 includes a cam 1211 for activating the rolling assembly of the turret-head assembly 1200. The cam 1211 is fixed to the base of the turret 1300.

The actuator 1205 includes a spindle housing 1204 mounted to a plate 1206 that rotates with the turret-head assembly 1200. The actuator 1205 further includes a drive spindle shaft 1208 extending generally through the center thereof. The actuator 1205 further includes a cam follower 1210 coupled to a push rod mounting plate 1212 and configured to slidably contact the cam 1211 on the forming turret 1300. The push rod mounting plate 1212 is coupled to the spindle housing 1204 by a plurality of push rods 1214 having a respective plurality of springs 1216 thereon. As the forming turret 1300 rotates around the axis of a shaft 1217 positioned generally through the center thereof, the cam followers 1210 roll around the surface of and are actuated by the cam 1211. As such, the push rod mounting plate 1212 is pushed toward the turret-head assembly 1200, thereby driving the rolling assembly therein to contact the article 10.

It is contemplated that Stages 1-4 may be performed at room temperature. In one non-limiting embodiment, the outer rollers comprise D-2 Rc 58-62, with a surface finish 16. The inner rollers may comprise 4140 HT, with a hardness of 26-32 Rc or D-2 Rc 58-62 and may have a surface finish 16.

As discussed above, in embodiments in which the turret-head assemblies are actuated using the article (see FIGS. 3-6), the ram and push plate activating the article includes a cam follower that follows along a cam profile on the forming turret. In some embodiments in which the turret-head assemblies are actuated by external mechanisms (see FIGS. 8-11), each turret-head assembly may include a cam follower that follows along a cam profile on the forming turret onto which the turret-head assembly is coupled. For example, a cam follower may be coupled to a portion of the rolling assembly or the housing at an end of the turret-head assembly opposite the base plate. Movement of the cam follower along the cam profile causes the rolling assembly and the housing to move axially relative to one another. In some embodiments, the cam actuation allows for the rolling assembly to be actuated and to remain actuated to contact the article until the stage is complete, at which point, the rolling assembly may be retracted away from the article.

Figure 13:
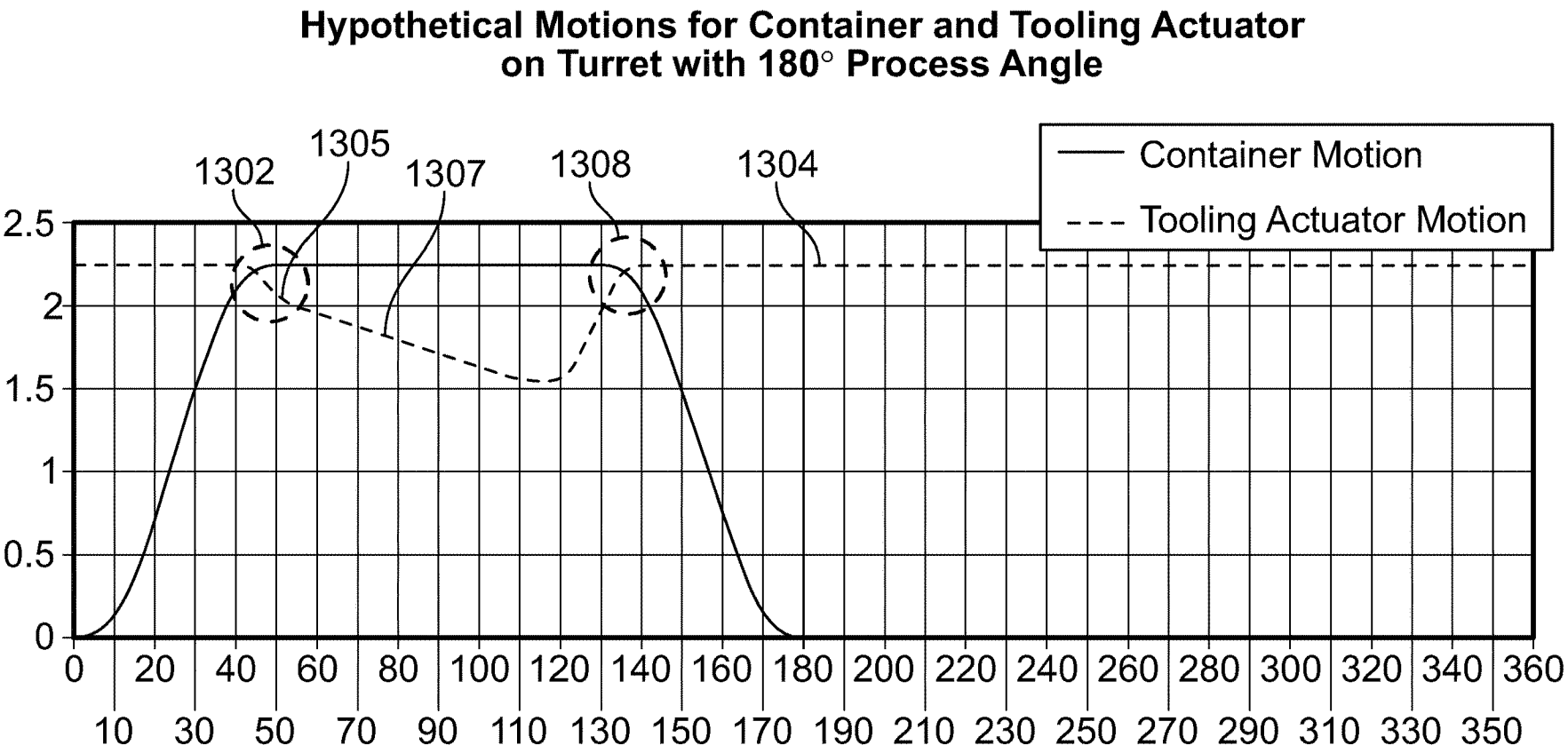
FIG. 13 illustrates hypothetical motions for an article and tooling actuator on a forming turret with an 180° process angle.

FIG. 13 shows a graph illustrating hypothetical motions of an article and a turret-head assembly (coupled to a tooling actuator) on a forming turret having an 180° process angle. The motion curves correspond to cam profiles used to actuate each of the article and the tooling actuator and are shown to clarify the relative motion of the article and tooling actuator coupled to the turret-head assembly. In the illustrated embodiment, the article approaches the turret-head assembly, followed by the tooling actuator moving toward the article (see period 1302). The magnitude and angles of the motions may vary, and other embodiments are practical and possible.

As shown in FIG. 13, in the area 1302, the motion of the tooling actuator begins before the article is fully in its processing position. This is because taking up some of the clearance needed for loading before the container motion is complete may assist in minimizing process problems. The rapid rise motion 1305 during the period 1303 before the constant velocity motion period 1307 serves to take up the clearance rapidly and allow more duration for the constant velocity motion that follows.

At or near the second intersection point 1308, the motion of the tooling actuator ends after the article begins to move away from its processing position because some clearance for unloading is made available before the tooling motion has returned to its rest position. This serves to take advantage of the clearance as early as possible to allow more duration for the constant velocity motion that precedes.

In the turret-head assemblies 1200, 1200' of FIGS. 8A-8B and 9A-9D, like the turret-head assemblies 200*a-d* detailed above, the rolling assemblies 210', 210" rotate relative to the articles being processed. It is contemplated that either or both of the article or the rolling assemblies (or component(s) thereof) 210, 210', 210" may rotate. In one embodiment in which the rolling assembly 210, 210', 210" rotates, the turret-head assembly 200, 1200, 1200' is mounted to a rotating shaft coupled to the forming turret (see, e.g., FIGS. 10A-10D), and a thrust bearing (e.g., thrust bearing 1202 with a thrust bearing plate 1203 of FIG. 8B) is included to support the axial load placed on the turret-head assembly 200, 1200, 1200'. In embodiments in which the article rotates and the tooling apparatus/rolling assembly 210, 210', 210" is generally stationary, the turret-head assemblies 200, 1200, 1200' can be attached via a simple fixed mount that is aligned with the article's axis, and the thrust bearing elements may be eliminated.

The axial load applied to the article provided by all of the turret-head assemblies 200*a-d*, 1200, 1200' described and contemplated herein assists in controlling the material flow, thereby assisting in preventing undesirable thinning of the material in the resulting carrier ring. The axial load applied to the articles by the article-activated turret-head assemblies 200*a-d* described herein may vary based on spindle speed. For example, when the turret-head assemblies described herein rotate at higher speeds, the resulting centrifugal force may drive the corresponding rolling assemblies outward and may create a higher axial process load. As such, at higher speeds, more force may be required to activate the rolling assembly than the article can withstand. Thus, it may be desirable to alleviate the extra load applied to the article and only apply the amount of load required to keep the article in contact with the push plate and ram assembly and prevent the article from spinning due to the friction of the rollers. For the turret-head assemblies 1200, 1200' of FIGS. 8-11 that are not actuated by the article itself, the spindle speed generally does not influence the axial load, resulting in a more consistent preload.

In some embodiments, the rollers contacting the article and forming the carrier ring have a complementary shape to a desired shape of the carrier ring 18 and adjacent portions to be formed on the neck 16 of the article. For example, the outer rollers 224 in the illustrated embodiments are radiused such that engagement of the outer rollers 224 with the exterior surface of the neck 16 of the article 10 reduces the diameter of the engaged neck 16 to form the desired groove(s)/recess(es) and pushes material out to assist in forming the carrier ring 18. Likewise, the inner roller 226 of the illustrated embodiments may be radiused such that engagement of the inner roller 226 with the interior surface of the neck 16 of the article increases the diameter of the engaged neck 16 to form the desired partial carrier ring 18*a*. The width of the carrier ring 18 and the depth of the adjacent grooves may be predetermined by, e.g., adjusting the setting of the turret-head assembly, e.g., the amount of force applied by the rollers 224, 226 onto the neck 16, the dimensions of the rollers 224, 226, the configuration of the cam/cam follower arrangements, any combination thereof, or the like. In addition, the plurality of rollers 224, 226 assists with preventing or minimizing undesirable deformation by providing a balanced load on the neck of the article.

As discussed above, the turret-head assemblies 200, 1200, 1200' described herein are configured to rotate about the turret-head assembly axis 203. It is contemplated that the turret-head assembly may rotate at various speeds. In some embodiments, the speed of rotation may be about 50-350 rpm. In other embodiments, the speed of rotation may be about 100-200 rpm. In still other embodiments, the speed of rotation may be about 120 rpm. In some embodiments, the turret-head assembly is rotatably mounted to the forming turret such that the turret-head assembly rotates about the turret-head assembly axis 203 independent from the rotation of the forming turret 1300. In some embodiments (e.g., where the article rotates), the turret-head assembly 200 is non-rotatably mounted on the forming turret 1300.

Any suitable ratio of rotations/speed of the forming turret to rotations of the turret-head assembly may be used. For example, the ratio used in Stage 1 may about 17:1 to about 21:1, the ratio in Stage 2 may be about 15:1 to about 17:1, and the ratio in Stages 3 and/or 4 may be about 18:1 to about 19:1. It is contemplated that the speed of the turret-head assemblies may be varied at different forming turret speeds.

Beneficially, the turret-head assemblies 200 described herein can include tooling to simultaneously perform operations on the article such as trimming, flanging, curling, threading, etc. In some embodiments, the tooling is attached to the turret head-retention device 202. In other embodiments, once the carrier ring 18 is completely formed on the articles, the articles are further processed (e.g., necked, threaded, further necked, and/or curled).

The turret-head assemblies 200, 1200, 1200' may be incorporated into one of the machines in the machine line 102. For example, an article 10 may be received by a pocket of the turret starwheel. While the turret starwheel continuously rotates about a turret starwheel axis, the distance between an open top end 11 of the article 10 and the turret-head assembly is decreased and the rolling assembly 210*a* is activated into a compressed position.

During engagement, the turret-head assembly 200, 1200, 1200' may rotate about the turret-head assembly axis 203. This rotational movement of the turret-head assembly 200, 1200, 1200' may cause the rollers 224, 226 to freely rotate. During rotation of the turret-head assembly 200, 1200, 1200', the rollers 224, 226 engage the neck 16 to form the carrier ring 18 and the adjacent grooves.

Figure 10A:
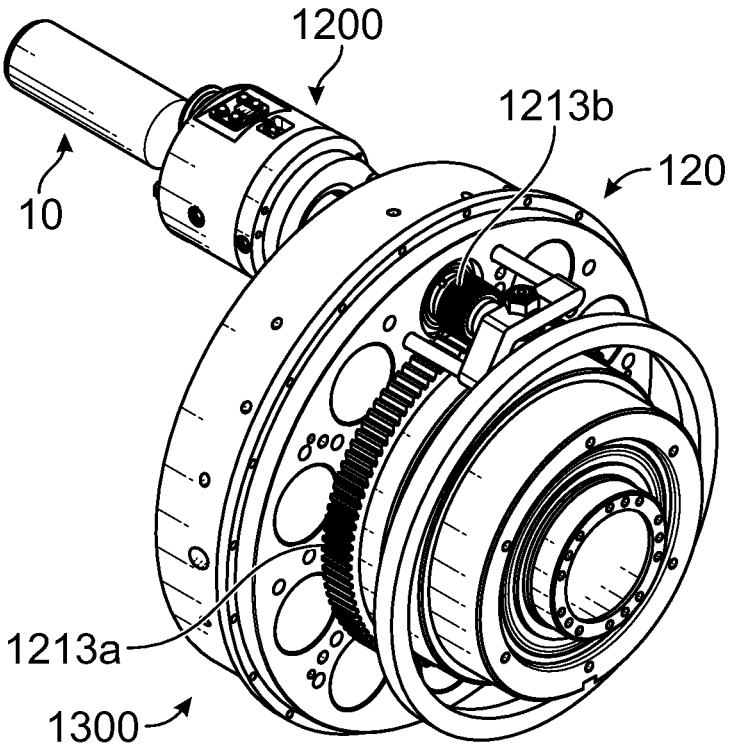
FIG. 10A illustrates a perspective view of a turret-head assembly mounted to a rotating forming turret according to one embodiment.
Figure 10B:
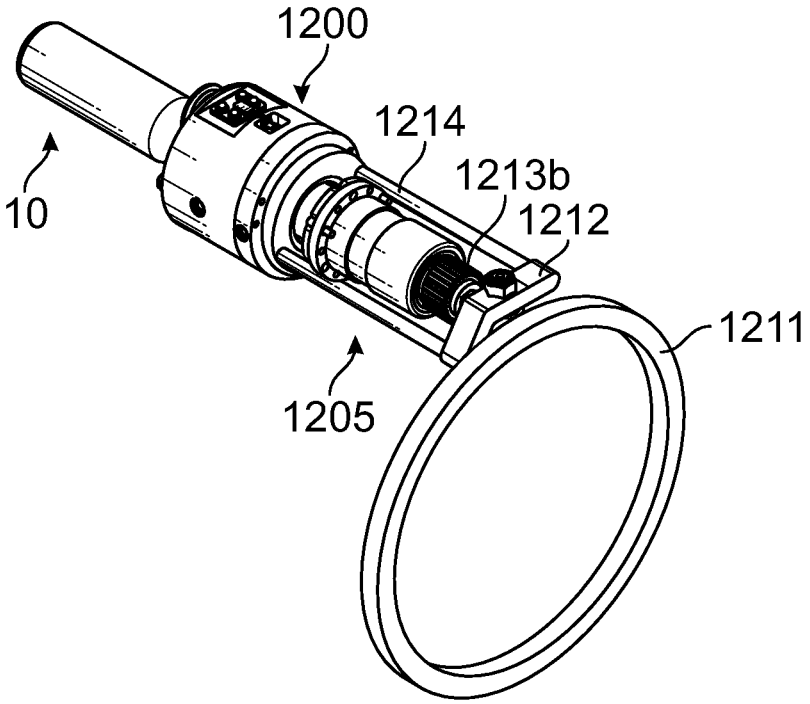
FIG. 10B illustrates the turret-head assembly and forming turret of FIG. 10A with certain components removed.
Figure 10C:
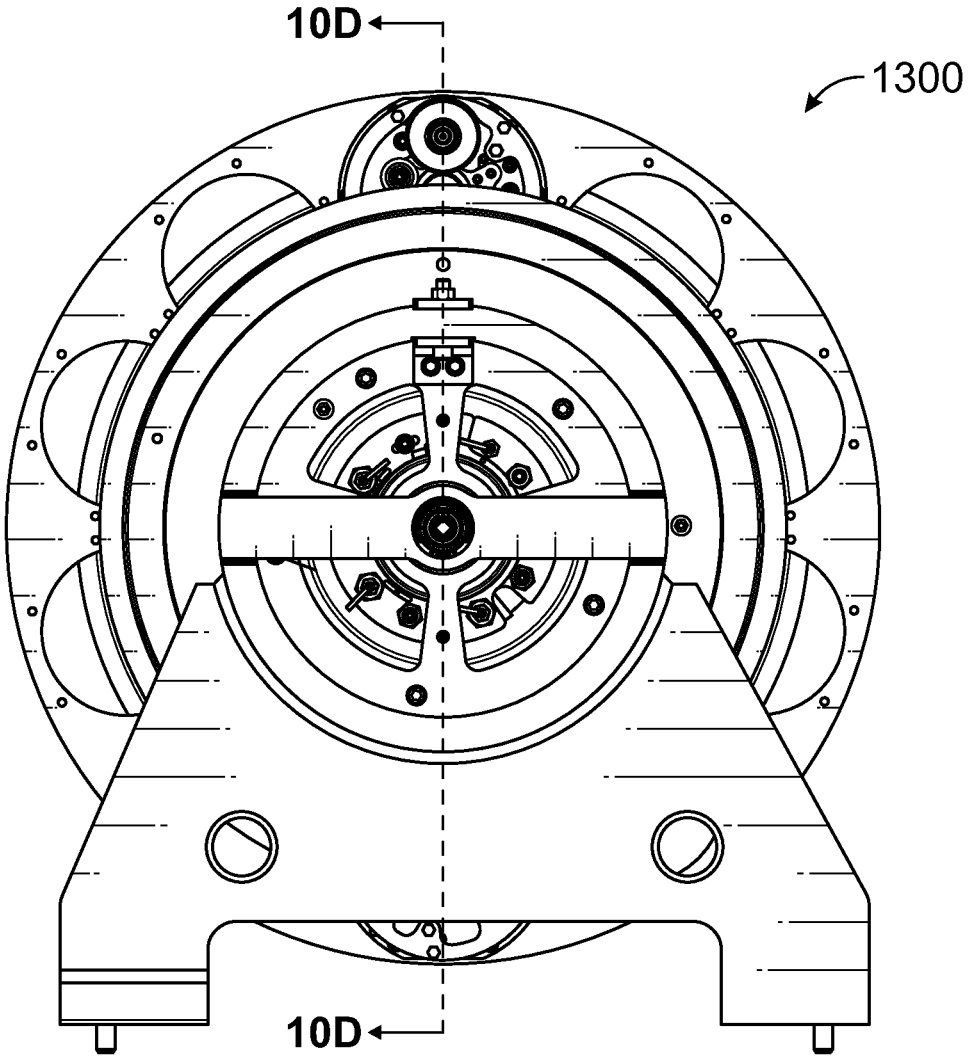
FIG. 10C is a front view of the turret-head assembly and forming turret of FIGS. 10A-10B mounted to a base.
Figure 10D:
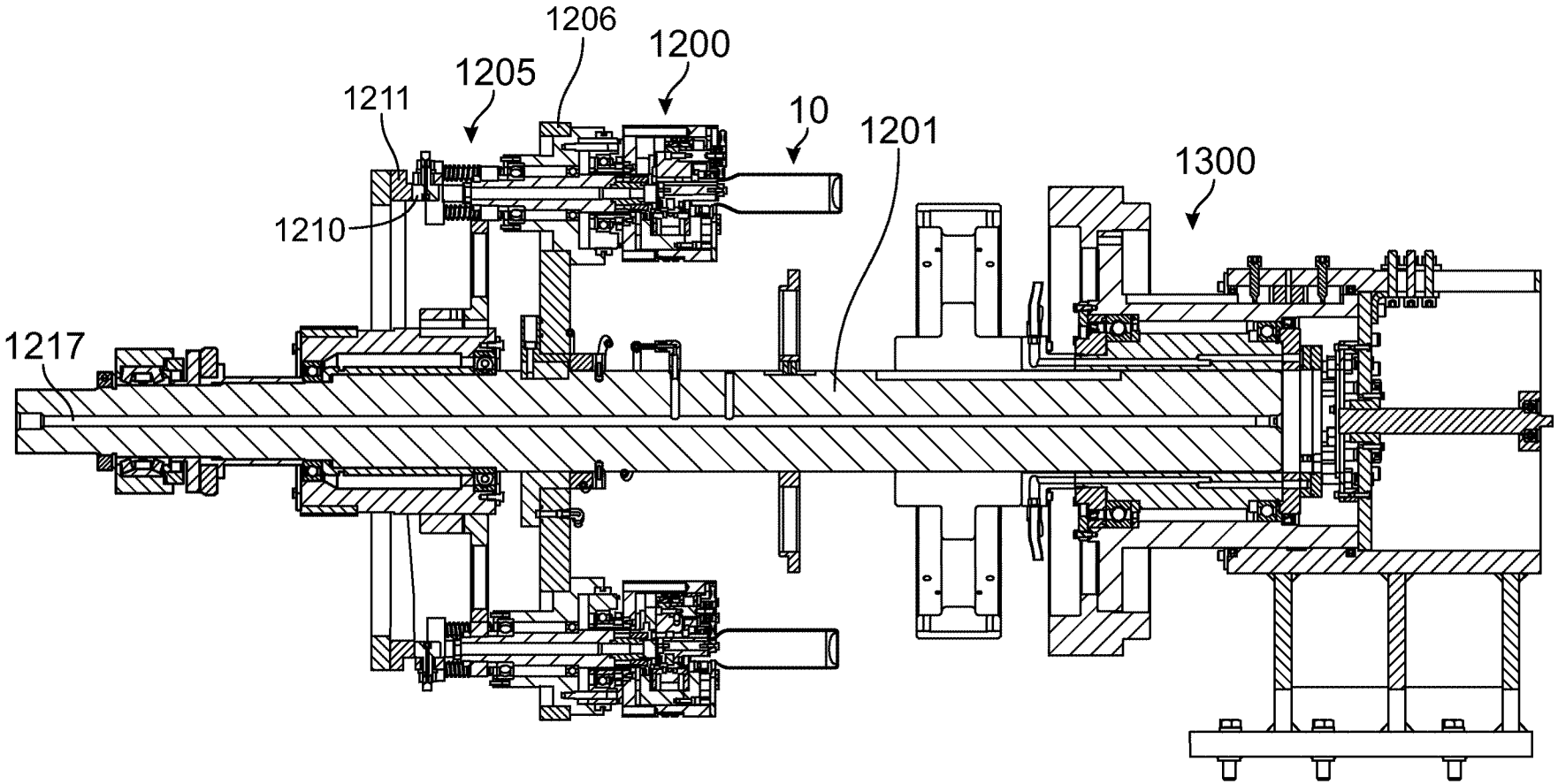
FIG. 10D is a cross-sectional view generally through line 10D-10D of FIG. 10C.
Figure 11A:
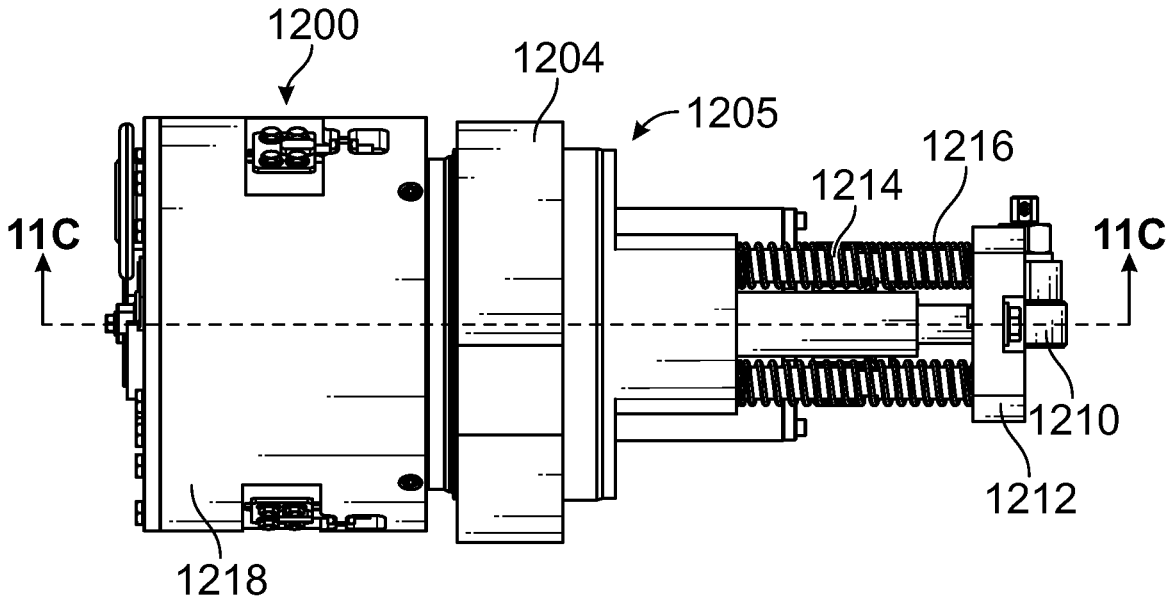
FIG. 11A illustrates a side view of the turret-head assembly of FIGS. 9A-9B coupled to an actuator, according to one embodiment.
Figure 11B:
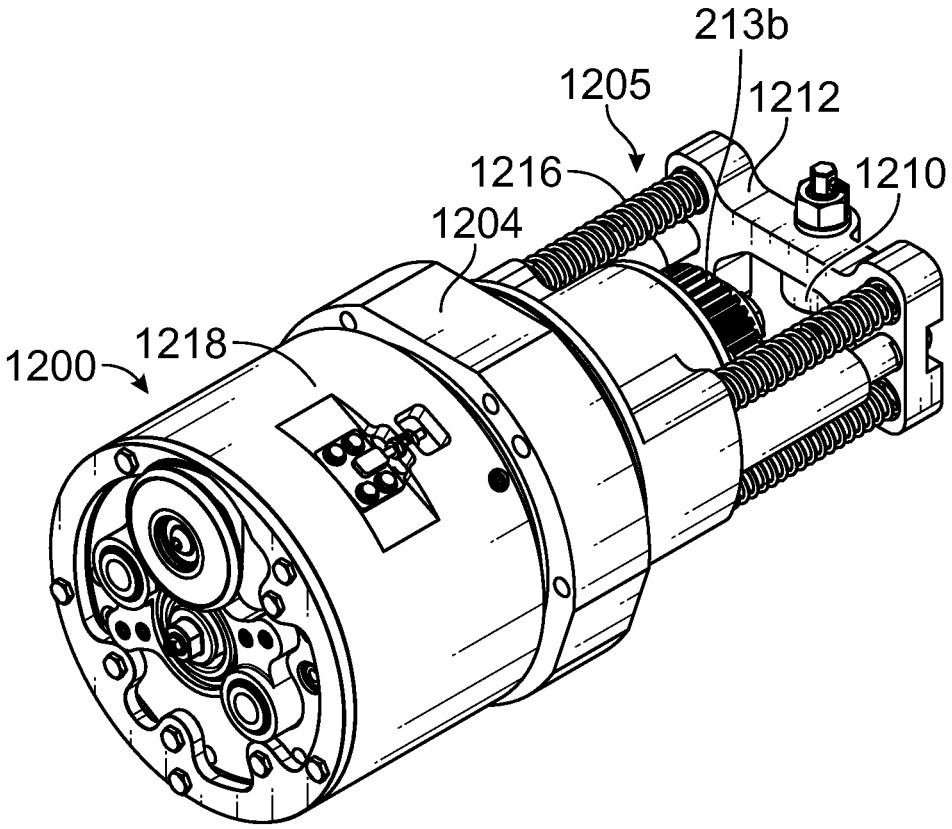
FIG. 11B illustrates a perspective side view of the turret-head assembly of FIG. 11A.
Figure 11C:
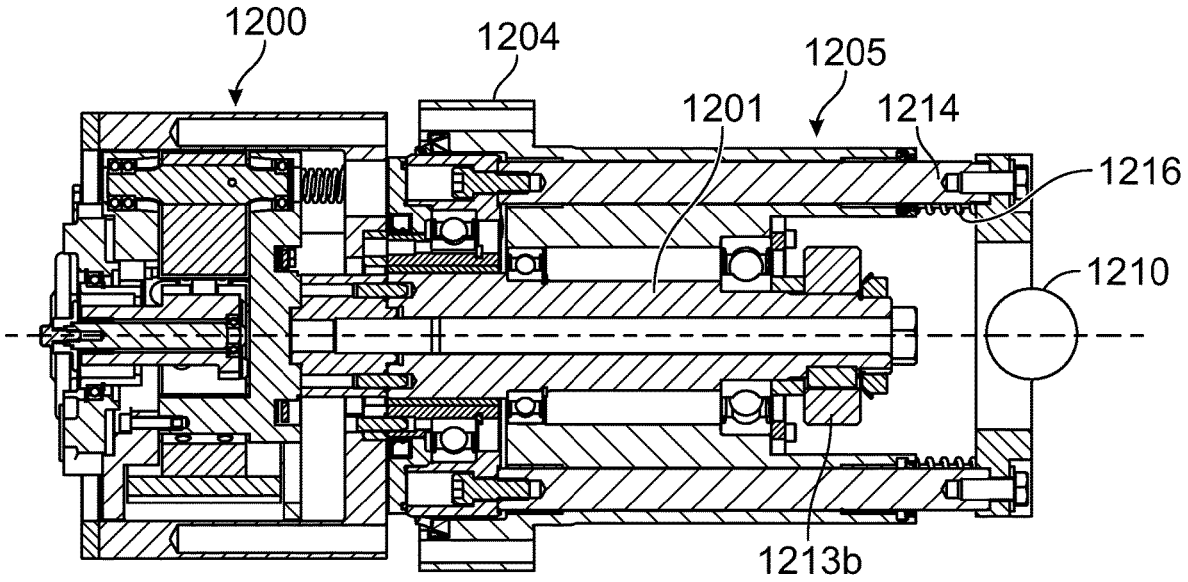
FIG. 11C illustrates a cross-sectional view of the turret-head assembly of FIGS. 11A-11B along the line 11C-11C of FIG. 11A.

In some embodiments, the turret-head assembly 200, 1200, 1200' is rotated about the turret-head assembly axis 203 by an independent motor. In some embodiments, as shown in FIG. 10A, the turret-head assembly is in a planetary gear configuration such that rotation of the forming turret drives rotation of the turret-head assemblies mounted thereon. As shown, a bull gear 1213*a* positioned on the forming turret 1300 may be used to drive spindle pinion gears 1213*b* coupled to the actuators 1205 of the respective turret-head assemblies. The bull gear 1213*a* is mounted on a housing that is, in turn, mounted to the shaft with bearings. The housing may be driven via a belt and motor. This allows the spindle speed to be varied with the motor as needed during the carrier ring-forming process.

In some embodiments, the turret-head assembly continuously rotates during axial movement of the turret-head assembly and/or the article 10. In some embodiments, the turret-head assembly is rotated about the turret-head assembly axis 203 by a servo motor.

Beneficially, the turret-head assemblies 200 disclosed herein can be added to existing modules in an existing machine line 102. Beneficially, the free-spinning of the rollers contributes to increased longevity of the turret-head assembly and decreased likelihood of creating additional aberrations as compared to tooling or non-rotational members.

In some embodiments described herein, the article is axially advanced (e.g., via a push ram assembly) toward the turret-head mechanism. In other embodiments, the article 10 is generally stationary and the turret-head assembly 200 is axially advanced along the turret-head assembly axis 203 (e.g., via cam actuation) to engage the article 10. In other embodiments, both the article 10 and the turret-head assembly 200 are axially advanced along the turret-head assembly axis 203 in opposite directions toward one another to engage a portion of the article 10 with a component of the turret-head assembly 200.

It is contemplated that the preform necked article of the embodiments described herein may be formed of any suitable material including, but not limited to Aluminum 3104 alloy. Non-limiting examples of tempers that may be used include H-10, H2E27, H-24, and H-26.

It is contemplated that the carrier ring-forming operations described herein may account for "spring back" of the material. Specifically, the rollers may be configured to distort the material to a degree slightly greater than what is needed for the final article/carrier ring, to account for the fact that the material may slightly retract after the rolling process is completed and the rollers break contact with the article.

It is contemplated that the embodiments detailed herein may also be used with containers not having a narrowed neck (e.g., a generally straight-walled container).

It is contemplated that the turret-head assemblies of the embodiments described herein may process articles at various speeds. The speeds may depend on the length of the neck portion and, accordingly, how long of a stroke is needed for the article to contact the turret-head assembly. In some embodiments, the turret-head assemblies 200 may process articles at about 400-800 bottles/minute. In other embodiments, the turret-head assemblies 200 may process articles at about 500-700 bottles/minute. In still other embodiments, may process articles at about 600 bottles/minute.

It is contemplated that the turret-head assemblies (or components thereof) of the embodiments described herein may make any suitable number of forming revolutions after contacting the article such that the desired amount of shaping is achieved. For example, Stage 1 may include 2-7 revolutions, 3-6 revolutions, or 4-5 revolutions after contact with the article. Stage 2 may include 1-5 revolutions, 2-4 revolutions, or about 3 revolutions after contact with the article. Stage 3 may include 1-6 revolutions, 2-5 revolutions, or 3-4 revolutions after contact with the article. Stage 4 may include 1-4 revolutions or 2-3 revolutions after contact with the article.

The metal containers of the embodiments of the present disclosure have the ability to be used in existing process lines for similarly shaped plastic containers. For example, the metal containers can be transported through processing lines by the carrier rings supporting the metal containers on air conveyor channels. This allows the metal containers to be filled with liquids using the same technology that is currently used to fill a PET container. The carrier rings on the metal containers of the present disclosure can also be used for clamping and anti-rotation during a capping process. The carrier rings can also be used for accurate placement of the metal containers in machinery of the processing lines. Thus, the washing, filling, and capping, processing lines do not need changes to accept the metal containers. Instead, the metal containers of the present disclosure can be used as full replacements of the plastic containers by simply switching out the containers.

It is contemplated that the articles resulting from the processes described herein may further include a tamper-evident feature to indicate when the container has been previously opened/unsealed. For example, the neck 16 of the article 10 may include a pilfer band at its lower end positioned over and wrapped around a groove in the neck of the article to generally axially lock the pilfer band. In some instances, the groove is formed below an annular bead positioned below or at the bottom of the threaded portion but generally above the carrier ring. Typically, due to processing requirements, the radius of the carrier band is larger than that of the annular bead.

Beneficially, the processes for forming a carrier ring described herein do not require localized annealing, e.g., at the neck of the article. Put another way, once the standard preform necked article (e.g., article 10' of FIG. 2B) is supplied, the carrier ring according to the embodiments described herein may be formed using mechanical processes, and no thermal processes or annealing is required. Rather, the geometry of the rollers, the profiles of the cams used to move the article and the tooling toward one another, and/or the percentage and rate of material being displaced during each rolling stage assist in forming the carrier ring 18 without requiring annealing. For example, in some embodiments, a specific geometry is used on the portion of the roller that contacts the article such that the article is less likely to collapse. In other embodiments, the cam profile is such that the article engages with the tooling multiple times/in multiple iterations. In some embodiments, the metal alloy used for the articles onto which the carrier ring is to be formed may be selected to assist in forming the carrier ring 18 without requiring additional annealing steps. For example, a material having enhanced malleability (less brittle) may be used.

Each of the above embodiments and obvious variations thereof are contemplated as falling within the spirit and scope of the claimed invention, which is set forth in the following claims. Moreover, the present concepts expressly include any and all combinations and sub-combinations of the preceding elements and aspects.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the terms "exemplary" and "example" as used herein to describe various embodiments are intended to indicate that such embodiments are possible examples, representations, and/or illustrations of possible embodiments (and such terms are not intended to connote that such embodiments are necessarily extraordinary or superlative examples).

Any references herein to the positions of elements (e.g., "top," "bottom," "above," "below," etc.) are merely used to describe the orientation of various elements in the Figures. It should be noted that the orientation of various elements may differ according to other exemplary embodiments and that such variations are intended to be encompassed by the present disclosure.

Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes, and omissions may also be made in the design, operating conditions, and arrangement of the various exemplary embodiments without departing from the scope of the present invention.

The invention claimed is:

1. A metal container comprising:

a base;

an open top end; and a unitary sidewall bridging the base and the open top end, the sidewall including a first portion having a first diameter, a neck having a second diameter, the second diameter being smaller than the first diameter, a first end of the neck terminating at the open top end, and a curved shoulder bridging the first portion and a second end of the neck, the neck including a carrier ring forming a protrusion in the sidewall, the carrier ring including a top and a bottom sidewall portion, interior surfaces of the top and bottom sidewall portions being in contact with one another, the carrier ring having a second diameter, the second diameter being about 7% to about 45% greater than a diameter of the open top end, a first groove adjacent to the top sidewall portion of the carrier ring, the first groove having a third diameter, the third diameter being smaller than the diameter of the open top end, and a second groove adjacent to the bottom sidewall portion of the carrier ring, the neck having a wall thickness of between about 0.025 and 0.356 mm.

2. The metal container of claim 1, wherein the first groove has a radius of about 0.76 to about 3.05 mm.

3. The metal container of claim 1, wherein the second groove has a radius of about 1.27 to about 6.35 mm.

4. The metal container of claim 1, wherein the top and bottom sidewall portions form a thickness of at least a portion of the carrier ring, the thickness being about 0.33 mm to about 0.46 mm.

5. The metal container of claim 1, wherein the open top end includes a curl formed thereon.

6. The metal container of claim 1, wherein the second groove has a fourth diameter, the fourth diameter being smaller than the diameter of the open top end.

7. The metal container of claim 1, wherein a thickness of an outer portion of the carrier ring is greater than a thickness of an inner portion of the carrier ring.

8. A metal container comprising:

a base;

an open top end; and a unitary sidewall bridging the base and the open top end, the sidewall including a first portion having a first diameter, a neck having a second diameter, the second diameter being smaller than the first diameter, a first end of the neck terminating at the open top end, and a curved shoulder bridging the first portion and a second end of the neck, the neck including a carrier ring forming a protrusion in the sidewall, the carrier ring including a top and a bottom sidewall portion, interior surfaces of the top and bottom sidewall portions being in contact with one another, the carrier ring having a second diameter, the second diameter being about 7% to about 45% greater than a diameter of the open top end, a first groove adjacent to the top sidewall portion of the carrier ring, and a second groove adjacent to the bottom sidewall portion of the carrier ring, the neck having a wall thickness of between about 0.025 and 0.356 mm, wherein the second groove has a fourth diameter, the fourth diameter being smaller than the diameter of the open top end.

9. The metal container of claim 8, wherein the first groove has a radius of about 0.76 to about 3.05 mm.

10. The metal container of claim 8, wherein the second groove has a radius of about 1.27 to about 6.35 mm.

11. The metal container of claim 8, wherein the top and bottom sidewall portions form a thickness of at least a portion of the carrier ring, the thickness being about 0.33 mm to about 0.46 mm.

12. The metal container of claim 8, wherein the open top end includes a curl formed thereon.

13. The metal container of claim 8, the first groove having a third diameter, the third diameter being smaller than the diameter of the open top end.

14. The metal container of claim 8, wherein a thickness of an outer portion of the carrier ring is greater than a thickness of an inner portion of the carrier ring.

15. A metal container comprising:

a base;

an open top end; and a unitary sidewall bridging the base and the open top end, the sidewall including a first portion having a first diameter, a neck having a second diameter, the second diameter being smaller than the first diameter, a first end of the neck terminating at the open top end, and a curved shoulder bridging the first portion and a second end of the neck, the neck including a carrier ring forming a protrusion in the sidewall, the carrier ring including a top and a bottom sidewall portion, interior surfaces of the top and bottom sidewall portions being in contact with one another, the carrier ring having a second diameter, the second diameter being about 7% to about 45% greater than a diameter of the open top end, a first groove adjacent to the top sidewall portion of the carrier ring, and a second groove adjacent to the bottom sidewall portion of the carrier ring, the neck having a wall thickness of between about 0.025 and 0.356 mm, wherein a thickness of an outer portion of the carrier ring is greater than a thickness of an inner portion of the carrier ring.

16. The metal container of claim 15, wherein the first groove has a radius of about 0.76 to about 3.05 mm.

17. The metal container of claim 15, wherein the second groove has a radius of about 1.27 to about 6.35 mm.

18. The metal container of claim 15, wherein the top and bottom sidewall portions form a thickness of at least a portion of the carrier ring, the thickness being about 0.33 mm to about 0.46 mm.

19. The metal container of claim 15, wherein the open top end includes a curl formed thereon.

20. The metal container of claim 15, the first groove having a third diameter, the third diameter being smaller than the diameter of the open top end.

21. The metal container of claim 15, wherein the second groove has a fourth diameter, the fourth diameter being smaller than the diameter of the open top end.

* * * * *